US011371229B2

(12) United States Patent
Hayashi et al.

(10) Patent No.: US 11,371,229 B2
(45) Date of Patent: Jun. 28, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Nobuhiro Hayashi, Kitakyushu (JP); Hidekazu Kitaura, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/212,401

(22) Filed: Mar. 25, 2021

(65) Prior Publication Data

US 2021/0270025 A1 Sep. 2, 2021

Related U.S. Application Data

(63) Continuation of application No. PCT/JP2021/004323, filed on Feb. 5, 2021.

(30) Foreign Application Priority Data

Feb. 28, 2020 (JP) ..... JP2020-033885
Feb. 28, 2020 (JP) ..... JP2020-033887
Jan. 22, 2021 (JP) ..... JP2021-008640

(51) Int. Cl.
*E03D 5/02* (2006.01)

(52) U.S. Cl.
CPC ..... *E03D 5/024* (2013.01)

(58) Field of Classification Search
CPC ..... E03D 5/024; E03D 5/022; E03D 5/02; E03D 5/10

(Continued)

(56) References Cited

U.S. PATENT DOCUMENTS 4,651,359 A * 3/1987 Battle ..... E03D 1/144 4/324
4,809,367 A * 3/1989 Scott ..... E03D 1/144 4/324

(Continued)

FOREIGN PATENT DOCUMENTS

JP 2009-257061 A 11/2009

OTHER PUBLICATIONS

International Search Report issued in PCT/JP2021/004323; dated Apr. 13, 2021.

(Continued)

*Primary Examiner* — Huyen D Le
(74) *Attorney, Agent, or Firm* — Studebaker & Brackett PC

(57) ABSTRACT

There are provided a flush water tank apparatus capable of accurately setting the amount of flush water to be discharged while opening a discharge valve by a discharge valve hydraulic drive unit. A flush water tank apparatus includes a valve controller, where, in a case where a first amount of flush water is selected, the valve controller causes the timing control mechanism to be engaged with the discharge valve and causes the timing control mechanism to operate such that engagement is released after a lapse of a first period of time, and in a case where a second amount of flush water is selected, the valve controller causes the timing control mechanism to be engaged with the discharge valve and causes the timing control mechanism to operate such that engagement is released after lapse of a second period of time shorter than the first period of time.

17 Claims, 17 Drawing Sheets

(58) Field of Classification Search
USPC ..... 4/388
See application file for complete search history.

(56) References Cited

U.S. PATENT DOCUMENTS

| | | | | |
|---|---|---|---|---|
| 5,157,795 | A * | 10/1992 | Pasquin | E03D 1/145 4/324 |
| 6,934,976 | B2 * | 8/2005 | Parsons | E03D 5/024 4/367 |
| 2010/0064427 | A1 * | 3/2010 | Mehmet | E03D 5/10 4/406 |
| 2019/0194922 | A1 * | 6/2019 | Burkhardt | E03D 3/12 |
| 2021/0062488 | A1 * | 3/2021 | Gilde | E03D 5/10 |

OTHER PUBLICATIONS

Written Opinion issued in PCT/JP2021/004323; dated Apr. 13, 2021.

* cited by examiner

FLUSH WATER TANK APPARATUS AND FLUSH TOILET APPARATUS PROVIDED WITH THE SAME

TECHNICAL FIELD

The present invention relates to a flush water tank apparatus and, in particular, to a flush water tank apparatus that supplies flush water to a flush toilet, and a flush toilet apparatus provided with the flush water tank apparatus.

BACKGROUND ART

In Japanese Patent Laid-Open No. 2009-257061, a low tank apparatus is described. In this low tank apparatus, a hydraulic cylinder device having a piston and a drain unit is arranged inside a low tank provided with a discharge valve, and the piston and the discharge valve are coupled via a coupling unit. At the time of discharging flush water in the low tank, water is supplied to the hydraulic cylinder device by opening a solenoid value, and the piston is pushed up. Since the piston is connected to the discharge valve via the coupling unit, the discharge valve is pulled up by movement of the piston, the discharge valve is opened, and the flush water in the low tank is discharged. The water supplied to the hydraulic cylinder device flows out from the drain unit and flows into the low tank.

Furthermore, in the case of causing the discharge valve to be closed, supply of water to the hydraulic cylinder device is stopped by causing the solenoid valve to be closed. Thereby, the pushed-up piston descends, and, accompanying this, the solenoid valve returns to a valve closed position due to its own weight. At this time, since the water in the hydraulic cylinder device flows out from the drain unit little by little, the piston slowly descends, and the discharge valve gradually returns to the valve closed position. Further, in the low tank apparatus described in Japanese Patent Laid-Open No. 2009-257061, a time during which the discharge valve is opened is changed by adjusting a time during which the solenoid valve is open, and, thereby, washings with different amounts of flush water, such as large washing and small washing, are realized.

SUMMARY OF INVENTION

Technical Problem

The low tank apparatus described in Japanese Patent Laid-Open No. 2009-257061, however, has a problem that it is difficult to accurately set the amount of flush water to be discharged. In other words, since water in the hydraulic cylinder device flows out from the drain unit little by little after the solenoid valve is closed to cause the discharge valve to be closed, in the low tank apparatus described in Japanese Patent Laid-Open No. 2009-257061, descent of the piston is gradual, and it is difficult to set the time during which the discharge valve is open short. Further, since the descent speed of the piston is dependent on the outflow rate of the water from the drain unit and sliding resistance of the piston, there is a possibility that variation occurs, and there is a possibility that change over time occurs. Therefore, it is difficult to accurately set the amount of flush water to be discharged, in the low tank apparatus described in Japanese Patent Laid-Open No. 2009-257061.

Therefore, an object of the present invention is to provide a flush water tank apparatus capable of accurately setting the amount of flush water to be discharged while having a configuration opening the discharge valve using water pressure of supplied water, and a flush toilet apparatus provided with the flush water tank apparatus.

Solution to Problem

To solve the problems described above, an embodiment of the present invention is a flush water tank apparatus for supplying flush water to a flush toilet, the flush water tank apparatus including: a storage tank which stores the flush water to be supplied to the flush toilet and in which a drain port for discharging the stored flush water to the flush toilet is formed; a discharge valve opening and closing the drain port and suppling flush water and stopping the supply of the flush water to the flush toilet; a discharge valve hydraulic drive unit for driving the discharge valve by using a water supply pressure of tap water that is supplied; a clutch mechanism coupling the discharge valve and the discharge valve hydraulic drive unit to pull up the discharge valve by a driving force of the discharge valve hydraulic drive unit, and disconnecting at a predetermined timing to lower the discharge valve; a flush water amount selection portion capable of selecting between a first amount of flush water for flushing the flush toilet and a second amount of flush water smaller than the first amount of flush water; a timing control mechanism stopping lowering of the discharge valve while engaging with the discharge valve and controlling a timing of closing the drain port; and a valve controller coupled to the timing control mechanism, the valve controller being provided to operate at a timing according to an amount of flush water selected by the flush water amount selection portion, where in a case where the first amount of flush water is selected by the flush water amount selection portion, the valve controller causes the timing control mechanism to be engaged with the discharge valve, causes the timing control mechanism to operate such that engagement between the timing control mechanism and the discharge valve is released according to a first period of time having passed, and causes the discharge valve to be lowered according to the first period of time having passed, and in a case where the second amount of flush water is selected by the flush water amount selection portion, the valve controller causes the timing control mechanism to be engaged with the discharge valve, causes the timing control mechanism to operate such that engagement between the timing control mechanism and the discharge valve is released according to a second period of time shorter than the first period of time having passed, and causes the discharge valve to be lowered according to the second period of time having passed.

According to an embodiment of the present invention configured in the above manner, the discharge valve and the discharge valve hydraulic drive unit are coupled to each other by the clutch mechanism and are disconnected at a predetermined timing, and thus, the discharge valve may be moved regardless of an operation speed of the discharge valve hydraulic drive unit, and the discharge valve may thus be closed. Thereby, it becomes possible to, even if the operation speed of the discharge valve hydraulic drive unit varies at the time of causing the discharge valve to descend, control the timing of causing the discharge valve to be closed without being influenced by the variation. Furthermore, in a case where the first amount of flush water is selected by the flush water amount selection portion, the valve controller causes the timing control mechanism to be engaged with the discharge valve and causes the timing control mechanism to operate such that engagement between the timing control mechanism and the discharge valve is released according to the first period of time having passed, and in a case where the second amount of flush water is selected by the flush water amount selection portion, the valve controller causes the timing control mechanism to be engaged with the discharge valve and causes the timing control mechanism to operate such that engagement between the timing control mechanism and the discharge valve is released according to the second period of time shorter than the first period of time having passed. In this manner, the valve controller may operate the timing control mechanism in such a way that a timing when the drain port is closed is earlier in a case where the second amount of flush water is selected by the flush water amount selection portion than a timing in a case where the first amount of flush water is selected. Therefore, according to an embodiment of the present invention, the first or the second amount of flush water may be set using the clutch mechanism.

According to an embodiment of the present invention, preferably, a flush water tank apparatus for supplying flush water to a flush toilet comprises: a storage tank which stores the flush water to be supplied to the flush toilet and in which a drain port for discharging the stored flush water to the flush toilet is formed; a discharge valve opening and closing the drain port and suppling flush water and stopping the supply of the flush water to the flush toilet; a discharge valve hydraulic drive unit for driving the discharge valve by using a water supply pressure of tap water that is supplied; a clutch mechanism coupling the discharge valve and the discharge valve hydraulic drive unit to pull up the discharge valve by a driving force of the discharge valve hydraulic drive unit, and disconnecting to lower the discharge valve; a flush water amount selection portion capable of selecting between a first amount of flush water for flushing the flush toilet and a second amount of flush water smaller than the first amount of flush water; and a valve controller formed to be capable of disconnecting the clutch mechanism at a predetermined timing, where in a case where the first amount of flush water is selected by the flush water amount selection portion, the valve controller is operated to disconnect the clutch mechanism according to a first period of time to lower the discharge valve according to the first period of time having passed, and in a case where the second amount of flush water is selected by the flush water amount selection portion, the valve controller is operated to disconnect the clutch mechanism according to a second period of time shorter than the first period of time to lower the discharge valve according to the second period of time having passed.

According to an embodiment of the present invention configured in the above manner, the discharge valve and the discharge valve hydraulic drive unit are coupled to each other by the clutch mechanism and are disconnected at a predetermined timing, and thus, the discharge valve may be moved regardless of an operation speed of the discharge valve hydraulic drive unit, and the discharge valve may thus be closed. Furthermore, in a case where the first amount of flush water is selected by the flush water amount selection portion, the valve controller is operated to disconnect the clutch mechanism according to the first period of time to lower the discharge valve according to the first period of time having passed, and in a case where the second amount of flush water is selected by the flush water amount selection portion, the valve controller is operated to disconnect the clutch mechanism according to the second period of time shorter than the first period of time having passed to lower the discharge valve according to the second period of time having passed. In this manner, the valve controller may disconnect the clutch mechanism in such a way that a timing when the drain port is closed is earlier in a case where the second amount of flush water is selected by the flush water amount selection portion than a timing in a case where the first amount of flush water is selected. Therefore, according to an embodiment of the present invention, the discharge valve may be lowered according to a predetermined period of time having passed and the first or the second amount of flush water may be set while using a configuration of the clutch mechanism.

Advantageous Effects of Invention

According to the present invention, it is possible to provide a flush water tank apparatus capable of accurately setting the amount of flush water to be discharged while having a configuration opening a discharge valve by a discharge valve hydraulic drive unit, and a flush toilet apparatus provided with the flush water tank apparatus.

DESCRIPTION OF EMBODIMENTS

Next, a flush toilet apparatus according to a first embodiment will be described with reference to accompanying drawings.

Figure 1:
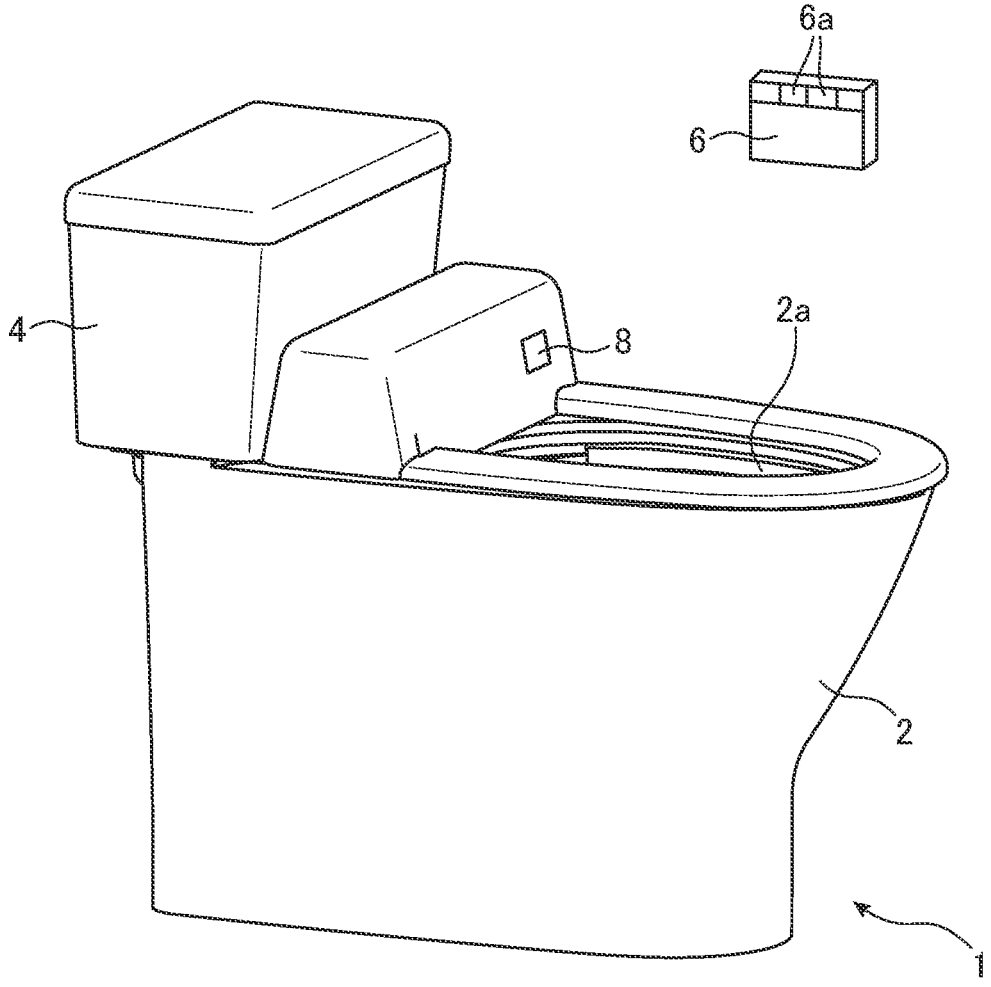
FIG. 1 is a perspective view showing an overall flush toilet apparatus provided with a flush water tank apparatus according to a first embodiment of the present invention.
Figure 2:
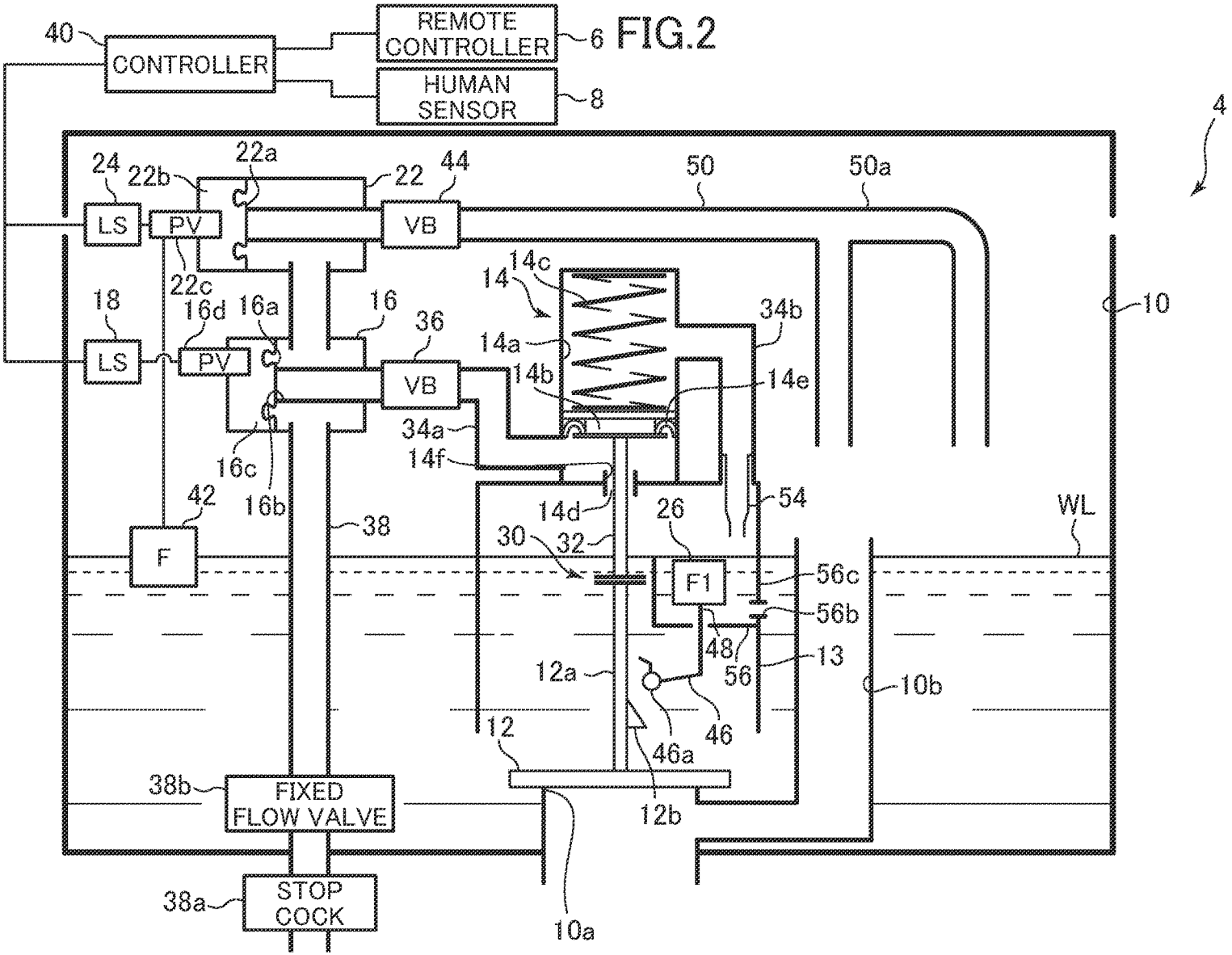
FIG. 2 is a sectional view showing a schematic configuration of the flush water tank apparatus according to the first embodiment of the present invention.

FIG. 1 is a perspective view showing an overall flush toilet apparatus provided with a flush water tank apparatus according to a first embodiment of the present invention. FIG. 2 is a sectional view showing a schematic configuration of the flush water tank apparatus according to the first embodiment of the present invention.

As shown in FIG. 1, a flush toilet apparatus 1 according to the first embodiment of the present invention is configured with a flush toilet main body 2, which is a flush toilet, and a flush water tank apparatus 4 according to the first embodiment of the present invention, which is placed at the back of the flush toilet main body 2. The flush toilet main body 2 is washed by flush water supplied from the flush water tank apparatus 4. The flush toilet apparatus 1 of the present embodiment is configured so that washing of a bowl 2*a* of the flush toilet main body 2 is performed by a remote controller 6 attached to a wall surface being operated after use or by a predetermined time having passed after a human sensor 8 provided on a toilet seat detecting a user leaving the toilet seat. The flush water tank apparatus 4 according to the present embodiment is configured to discharge flush water stored inside to the flush toilet main body 2 based on an instruction signal from the remote controller 6 or the human sensor 8 and wash the bowl 2*a* by the flush water.

Further, "large washing" or "small washing" for washing the bowl 2*a* is executed by the user pressing a push button 6*a* on the remote controller 6. Accordingly in the present embodiment, the remote controller 6 functions as a flush water amount selection portion that is capable of selecting between a first amount of flush water for flushing the flush toilet main body 2 and a second amount of flush water smaller than the first amount of flush water. As a modification, the remote controller 6 may be a flush water amount selection portion that is capable of changing the amount of flush water to another existing setting, or may be a flush water amount selection portion that is capable of arbitrarily changing the amount of flush water. Note that, though the human sensor 8 is provided on the toilet seat in the present embodiment, the present invention is not limited to this form. The human sensor 8 is only required to be provided at a position where it is possible to detect the user's motions of sitting on, standing from, approach to and leaving from the toilet seat, and holding his hand. For example, the human sensor 8 may be provided on the flush toilet main body 2 or the flush water tank apparatus 4. Further, the human sensor 8 may be anything that can detect the user's motions of sitting on, standing from, approach to and leaving from the toilet seat, and holding his hand over it, and, for example, an infrared sensor or a microwave sensor can be used as the human sensor 8. Further, the remote controller 6 may be changed to an operation lever device or an operation button device having such a structure that is capable of mechanically controlling opening/closing of a first control valve 16 and a second control valve 22 described later.

As shown in FIG. 2, the flush water tank apparatus 4 has a storage tank 10 for storing flush water to be supplied to the flush toilet main body 2, a discharge valve 12 for opening/closing a drain port 10*a* provided on the storage tank 10, and a discharge valve hydraulic drive unit 14 that drives the discharge valve 12. Further, the flush water tank apparatus 4 has the first control valve 16 that controls water supply to the discharge valve hydraulic drive unit 14 and a solenoid valve 18 attached to the first control valve 16 inside thereof. Furthermore, the flush water tank apparatus 4 has the second control valve 22 for supplying flush water to the storage tank 10 and a solenoid valve 24 attached to the second control valve 22 inside the storage tank 10. Further, the flush water tank apparatus 4 has a clutch mechanism 30, and the clutch mechanism 30 couples the discharge valve 12 and the discharge valve hydraulic drive unit 14 to pull up the discharge valve 12 by driving force of the discharge valve hydraulic drive unit 14. A casing 13 is formed above the discharge valve 12, the casing 13 being formed into a cylindrical shape whose lower side is opened. The casing 13 is connected and fixed to the discharge valve hydraulic drive unit 14 and a discharge portion 54.

The storage tank 10 is a tank configured to store flush water to be supplied to the flush toilet main body 2, and the drain port 10*a* for discharging the stored flush water to the flush toilet main body 2 is formed on a bottom portion of the storage tank 10. Inside the storage tank 10, an overflow pipe 10*b* is connected to the downstream side of the drain port 10*a*. The overflow pipe 10*b* vertically rises from near the drain port 10*a* and extends above a full water level WL of the flush water stored in the storage tank 10. Therefore, flush water that has flowed in from the upper end of the overflow pipe 10*b* bypasses the drain port 10*a* and flows out directly to the flush toilet main body 2.

The discharge valve 12 is a valve body arranged so as to open/close the drain port 10*a*. The discharge valve 12 is opened by being pulled upward, and flush water in the storage tank 10 is discharged to the flush toilet main body 2, so that the bowl 2*a* is washed. The discharge valve 12 supplies and stops flush water to the flush toilet main body 2. The discharge valve 12 is pulled up by driving force of the discharge valve hydraulic drive unit 14. When the discharge valve 12 is pulled up to a predetermined height, the clutch mechanism 30 is disconnected, and the discharge valve 12 descends due to its own weight. At the time of lowering of the discharge valve 12, the discharge valve 12 is held by a holding mechanism 46 described later for a predetermined period of time, and a period of time until the discharge valve 12 is seated on the drain port 10*a* is adjusted.

The discharge valve hydraulic drive unit 14 is configured to utilize water supply pressure of tap water (flush water) supplied from a tap water pipe to drive the discharge valve 12. Specifically, the discharge valve hydraulic drive unit 14 has a cylinder 14*a* into which flush water supplied from the first control valve 16 flows, a piston 14*b* slidably arranged in the cylinder 14*a*, and a rod 32 that projects from the lower end of the cylinder 14*a* to drive the discharge valve 12.

Furthermore, a spring 14*c* is arranged inside the cylinder 14*a* and energizes the piston 14*b* downward. A packing 14*e* is attached to the piston 14*b* so that watertightness between the inner wall surface of the cylinder 14*a* and the piston 14*b* is ensured. Furthermore, the clutch mechanism 30 is provided at the lower end of the rod 32, and the rod 32 and a valve stem 12*a* of the discharge valve 12 are coupled/released by the clutch mechanism 30.

The cylinder 14*a* is a cylindrical-shaped member, which is arranged with its axis in the vertical direction and accepts the piston 14*b* inside in a slidable state. A drive unit water supply passage 34*a* is connected to a lower end portion of the cylinder 14*a* so that flush water flowing out of the first control valve 16 flows into the cylinder 14*a*. Therefore, the piston 14*b* in the cylinder 14*a* is pushed up against energizing force of the spring 14*c* by the flush water flowing into the cylinder 14*a*.

On an upper part of the cylinder 14*a*, an outflow hole is provided, and a drive unit discharge passage 34*b* communicates with the inside of the cylinder 14*a* via the outflow hole. Therefore, when flush water flows into the cylinder 14*a* from the drive unit water supply passage 34*a* connected to a lower part of the cylinder 14*a*, the piston 14*b* is pushed upward from the lower part of the cylinder 14*a* which is a first position. The piston 14*b* is driven by pressure from the flush water flowing into the cylinder. Then, when the piston 14*b* is pushed up to a second position above the outflow hole, the water that flowed into the cylinder 14*a* flows through the drive unit discharge passage 34*b* from the outflow hole. In other words, when the piston 14*b* is moved to the second position, the drive unit water supply passage 34*a* and the drive unit discharge passage 34*b* are caused to communicate with each other via the inside of the cylinder 14*a*. At a distal end portion of the drive unit discharge passage 34*b* extending from the cylinder 14*a*, a discharge portion 54 is formed. As described above, the drive unit discharge passage 34*b* forms a flow channel extending up to the discharge portion 54.

The rod 32 is a rod-shaped member connected to the lower surface of the piston 14*b*. The rod 32 passes through a through hole 14*f* formed in the bottom surface of the cylinder 14*a* and extends in a manner of projecting downward from inside the cylinder 14*a*. The rod 32 is connected to the piston 14*b*, and drives the discharge valve 12. Between the rod 32 projecting downward from the cylinder 14*a* and the inner wall of the through hole 14*f* of the cylinder 14*a*, a gap 14*d* is provided, and a part of flush water flowing into the cylinder 14*a* flows out from the gap 14*d*. The water flowing out from the gap 14*d* flows into the storage tank 10. Note that, since the gap 14*d* is relatively narrow, and flow channel resistance is large, pressure inside the cylinder 14*a* increases due to the flush water flowing into the cylinder 14*a* from the drive unit water supply passage 34*a* even in the state of water flowing out from the gap 14*d*, and the piston 14*b* is pushed up, being against the energizing force of the spring 14*c*.

Next, based on operation of the solenoid valve 18, the first control valve 16 controls supply of flush water to the discharge valve hydraulic drive unit 14, and also controls supply and stop of water to the discharge portion 54. For this purpose, the first control valve 16 is provided on a flow channel supplying flush water to the discharge portion 54 and the like as a valve controller described later, and controls supply of flush water to the discharge portion 54 and the like as the valve controller. The first control valve 16 thus supplies flush water to the discharge portion 54 and the like as the valve controller via the discharge valve hydraulic drive unit 14.

The first control valve 16 is provided with a main valve body 16*a*, a main valve port 16*b* opened/closed by the main valve body 16*a*, a pressure chamber 16*c* for causing the main valve body 16*a* to move, and a pilot valve 16*d* for switching pressure in the pressure chamber 16*c*.

The main valve body 16*a* is configured so as to open/close the main valve port 16*b* of the first control valve 16. When the main valve port 16*b* is opened, tap water supplied from a water supply pipe 38 flows into the discharge valve hydraulic drive unit 14. The pressure chamber 16*c* is provided adjacent to the main valve body 16*a* in a case of the first control valve 16. The pressure chamber 16*c* is configured so that a part of the tap water supplied from the water supply pipe 38 flows in so that internal pressure increases. When the pressure in the pressure chamber 16*c* increases, the main valve body 16*a* is moved toward the main valve port 16*b*, and the main valve port 16*b* is closed.

The pilot valve 16*d* is configured to open/close a pilot valve port (not shown) provided for the pressure chamber 16*c*. When the pilot valve port (not shown) is opened by the pilot valve 16*d*, water in the pressure chamber 16*c* flows out, and the internal pressure decreases. When the pressure in the pressure chamber 16*c* decreases, the main valve body 16*a* leaves from the main valve port 16*b*, and the first control valve 16 is opened. When the pilot valve 16*d* is closed, the pressure in the pressure chamber 16*c* increases, and the first control valve 16 is closed.

The pilot valve 16*d* is moved by the solenoid valve 18 attached to the pilot valve 16*d* to open/close the pilot valve port (not shown). The solenoid valve 18 is electrically connected to a controller 40 and causes the pilot valve 16*d* to move, based on a command signal from the controller 40. Specifically, the controller 40 as a controller receives a signal from the remote controller 6 or the human sensor 8, and the controller 40 transmits an electric signal to the solenoid valve 18 to cause the solenoid valve 18 to operate. The first control valve 16 is thus controlled by the controller 40.

Further, the drive unit water supply passage 34*a* between the first control valve 16 and the discharge valve hydraulic drive unit 14 is provided with a vacuum breaker 36. When negative pressure occurs on the first control valve 16 side, backflow of water to the first control valve 16 side is prevented by the vacuum breaker 36.

The second control valve 22 is configured to control water supply/stop to the storage tank 10 based on operation of the solenoid valve 24. Though the second control valve 22 is connected to the water supply pipe 38 via the first control valve 16, tap water supplied from the water supply pipe 38 always flows into the second control valve 22 irrespective of whether the first control valve 16 is open or closed. The second control valve 22 is provided with a main valve body 22*a*, a pressure chamber 22*b* and a pilot valve 22*c*, and the pilot valve 22*c* is opened/closed by the solenoid valve 24. When the pilot valve 22*c* is opened by the solenoid valve 24, the main valve body 22*a* of the second control valve 22 is opened, and tap water flowing in from the water supply pipe 38 is supplied into the storage tank 10 or to the overflow pipe 10*b*. Further, the solenoid valve 24 is electrically connected to the controller 40 and causes the pilot valve 22*c* to move, based on a command signal from the controller 40. Specifically, the controller 40 sends an electrical signal to the solenoid valve 24 based on an operation of the remote controller 6 to cause the solenoid valve 24 to operate. The second control valve 22 is thus controlled by the controller 40. Additionally, the solenoid valve 24 may be omitted, and in the case where the solenoid valve 24 is omitted, the pilot valve 22*c* is controlled by a float switch 42 as described later.

A float switch 42 is connected to the pilot valve 22*c*. The float switch 42 is configured to control the pilot valve 22*c* based on a water level in the storage tank 10 to open/close a pilot valve port (not shown). In other words, when the water level in the storage tank 10 reaches a predetermined water level, the float switch 42 sends a signal to the pilot valve 22*c* to cause the pilot valve port (not shown) to be closed. In other words, the float switch 42 is configured to set the water storage level in the storage tank 10 to the predetermined full water level WL which is a stopped water level. The float switch 42 is arranged in the storage tank 10 and is configured to, when the water level of the storage tank 10 increases to the full water level WL, stop water supply from the first control valve 16 to the discharge valve hydraulic drive unit 14. Additionally the float switch 42 may be changed to a ballcock mechanism. The ballcock mechanism includes a ballcock float that moves vertically according to a water level, and a support arm that is connected to the ballcock float and that acts on the pilot valve 22*c*. With the ballcock mechanism, when the water level in the storage tank 10 rises to the full water level WL, the ballcock float rises and the support arm connected to the ballcock float is rotated upward, and the pilot valve port of the pilot valve 22*c* is mechanically closed. With the ballcock mechanism, when the water level in the storage tank 10 falls below the full water level WL, the ballcock float is lowered and the support arm connected to the ballcock float is rotated downward, and the pilot valve port of the pilot valve 22*c* is mechanically opened.

A water supply passage 50 extending from the second control valve 22 is provided with a water supply passage branch portion 50*a*. One of branched water supply passages 50 is configured to cause water to flow out into the storage tank 10, and the other is configured to cause water to flow out into the overflow pipe 10*b*. Therefore, a part of flush water supplied from the second control valve 22 is discharged into the flush toilet main body 2 through the overflow pipe 10*b*, and the remaining flush water is stored in the storage tank 10.

Further, the water supply passage 50 is provided with a vacuum breaker 44. When negative pressure occurs on the second control valve 22 side, backflow of water to the second control valve 22 is prevented by the vacuum breaker 44.

Water supplied from the tap water pipe is supplied to each of the first control valve 16 and the second control valve 22 via a stop cock 38*a* arranged outside the storage tank 10 and a fixed flow valve 38*b* arranged in the storage tank 10 on the downstream side of the stop cock 38*a*. The stop cock 38*a* is provided to stop supply of water to the flush water tank apparatus 4 at the time of maintenance and the like, and is usually used in an open state. The fixed flow valve 38*b* is provided so as to cause water supplied from the tap water pipe to flow into the first control valve 16 and the second control valve 22 at a predetermined flow rate, and is configured so that water at a certain flow rate is supplied regardless of the installation environment of the flush toilet apparatus 1.

The controller 40 includes a CPU, a memory and the like and controls connected equipment to execute a large washing mode and/or a small washing mode described later, based on a predetermined control program recorded in the memory or the like. The controller 40 is electrically connected to the remote controller 6, the human sensor 8, the solenoid valve 18, the solenoid valve 24 and the like.

Next, a configuration and operation of the clutch mechanism 30 will be described, newly referring to FIGS. 3A to 3H.

FIGS. 3A to 3H schematically show the configuration of the clutch mechanism 30 and shows operation at the time of being pulled up by the discharge valve hydraulic drive unit 14.

Figure 3A:
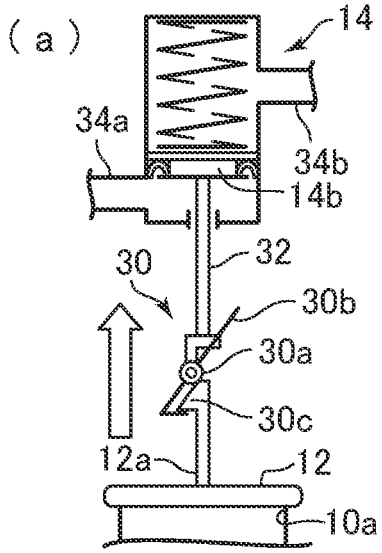
FIG. 3A is a diagram schematically showing a configuration and operation of a clutch mechanism provided in the flush water tank apparatus according to the first embodiment of the present invention.

First, as shown in FIG. 3A, the clutch mechanism 30 is provided at the lower end of the rod 32 extending downward from the discharge valve hydraulic drive unit 14, and is configured so as to couple/release the lower end of the rod 32 and the upper end of the valve stem 12*a* of the discharge valve 12. The clutch mechanism 30 has a rotary shaft 30*a* attached to the lower end of the rod 32, a hook member 30*b* supported by the rotary shaft 30*a*, and an engaging claw 30*c* provided at the upper end of the valve stem 12*a*. Due to such a structure, the clutch mechanism 30 is adapted to be disconnected at a predetermined timing and at a predetermined pull-up height to cause the discharge valve 12 to descend.

The rotary shaft 30*a* is attached at the lower end of the rod 32 in the horizontal direction and supports the hook member 30*b* in a rotatable state. The hook member 30*b* is a plate-shaped member, and an intermediate part of the hook member 30*b* is rotatably supported by the rotary shaft 30*a*. The lower end of the hook member 30*b* is bent in a hook shape to form a hook portion. The engaging claw 30*c* provided on the upper end of the valve stem 12*a* of the discharge valve 12 is a claw in a right-angle triangular shape. The base of the engaging claw 30*c* is almost in the horizontal direction, and the side face is formed to be sloped downward.

In the state shown in FIG. 3A, the discharge valve 12 seats on the drain port 10*a*, and the drain port 10*a* is closed. In this state, the discharge valve hydraulic drive unit 14 and the discharge valve 12 are coupled. In this coupled state, the claw portion of the hook member 30*b* is engaged with the base of the engaging claw 30*c*, and the discharge valve 12 can be pulled up by the rod 32.

Figure 3B:
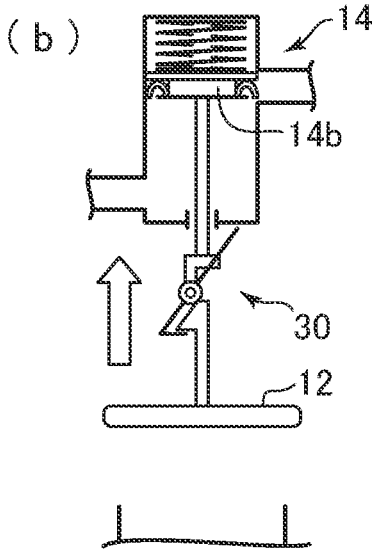
FIG. 3B is a diagram schematically showing a configuration and operation of a clutch mechanism provided in the flush water tank apparatus according to the first embodiment of the present invention.
Figure 3C:
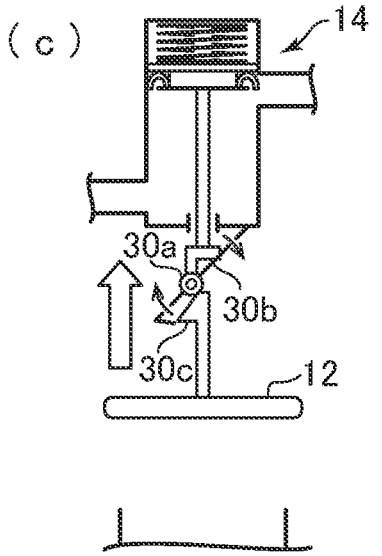
FIG. 3C is a diagram schematically showing a configuration and operation of a clutch mechanism provided in the flush water tank apparatus according to the first embodiment of the present invention.
Figure 3D:
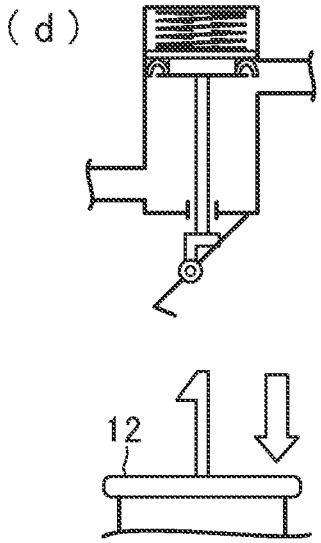
FIG. 3D is a diagram schematically showing a configuration and operation of a clutch mechanism provided in the flush water tank apparatus according to the first embodiment of the present invention.

Next, as shown in FIG. 3B, when flush water is supplied to the discharge valve hydraulic drive unit 14, the piston 14*b* moves upward, and, accordingly, the discharge valve 12 is pulled up by the rod 32. Furthermore, as shown in FIG. 3C, when the discharge valve 12 is pulled up to a predetermined position, the upper end of the hook member 30*b* comes into contact with the bottom surface of the discharge valve hydraulic drive unit 14, and the hook member 30*b* is rotated around the rotary shaft 30*a*. By this rotation, the claw portion at the lower end of the hook member 30*b* is moved in a direction of disengaging from the engaging claw 30*c*, and engagement between the hook member 30*b* and the engaging claw 30*c* is released. When the engagement between the hook member 30*b* and the engaging claw 30*c* is released, the discharge valve 12 descends toward the drain port 10*a* in flush water stored in the storage tank 10 as shown in FIG. 3D. (Additionally, as described later, the discharge valve 12 that is lowered is temporarily held at a predetermined height by the holding mechanism 46 before being seated on the drain port 10*a*.)

Figure 3E:
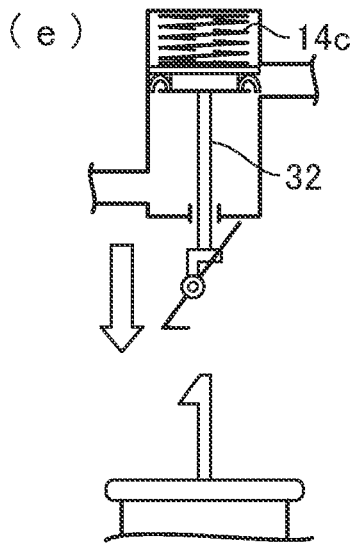
FIG. 3E is a diagram schematically showing a configuration and operation of a clutch mechanism provided in the flush water tank apparatus according to the first embodiment of the present invention.
Figure 3F:
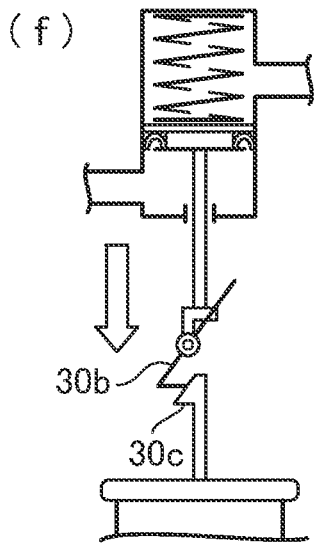
FIG. 3F is a diagram schematically showing a configuration and operation of a clutch mechanism provided in the flush water tank apparatus according to the first embodiment of the present invention.
Figure 3G:
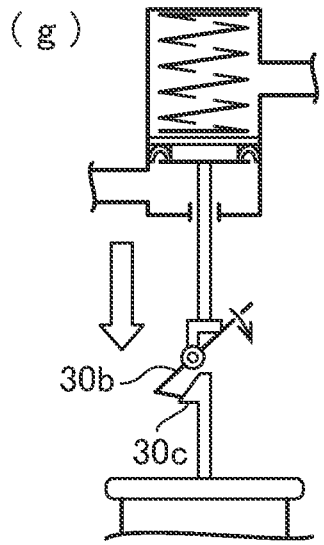
FIG. 3G is a diagram schematically showing a configuration and operation of a clutch mechanism provided in the flush water tank apparatus according to the first embodiment of the present invention.
Figure 3H:
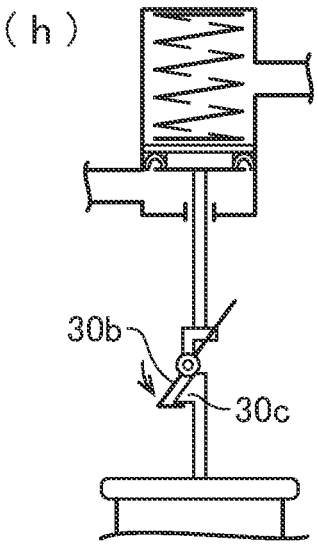
FIG. 3H is a diagram schematically showing a configuration and operation of a clutch mechanism provided in the flush water tank apparatus according to the first embodiment of the present invention.

Furthermore, as shown in FIG. 3E, when flush water supplied to the discharge valve hydraulic drive unit 14 is stopped, the rod 32 descends due to the energizing force of the spring 14*c*. When the rod 32 descends, the distal end of the hook member 30*b* attached to the lower end of the rod 32 comes into contact with the engaging claw 30*c* as shown in FIG. 3F. When the rod 32 descends more, the claw portion of the hook member 30*b* is pushed by the sloped surface of the engaging claw 30*c* as shown in FIG. 3G, and the hook member 30*b* is rotated. When the rod 32 descends more, the claw portion of the hook member 30*b* gets over the engaging claw 30*c*, the hook member 30*b* is rotated to the original position by the gravity, and the claw portion of the hook member 30*b* and the engaging claw 30*c* engage with each other again as shown in FIG. 3H and return to the state shown in FIG. 3A.

Referring back to FIGS. 2 and 4, a water storage portion and the like of the flush water tank apparatus 4 will be described.

Figure 4A:
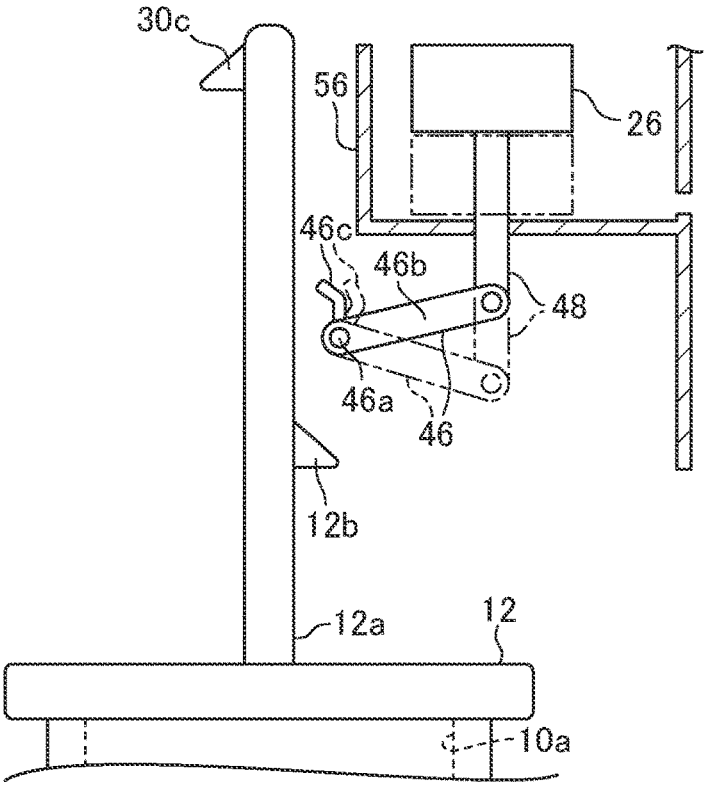
FIG. 4A is a diagram showing, in an enlarged manner, parts corresponding to a discharge valve, a water storage portion and the like provided in the flush water tank apparatus according to the first embodiment of the present invention.
Figure 4B:
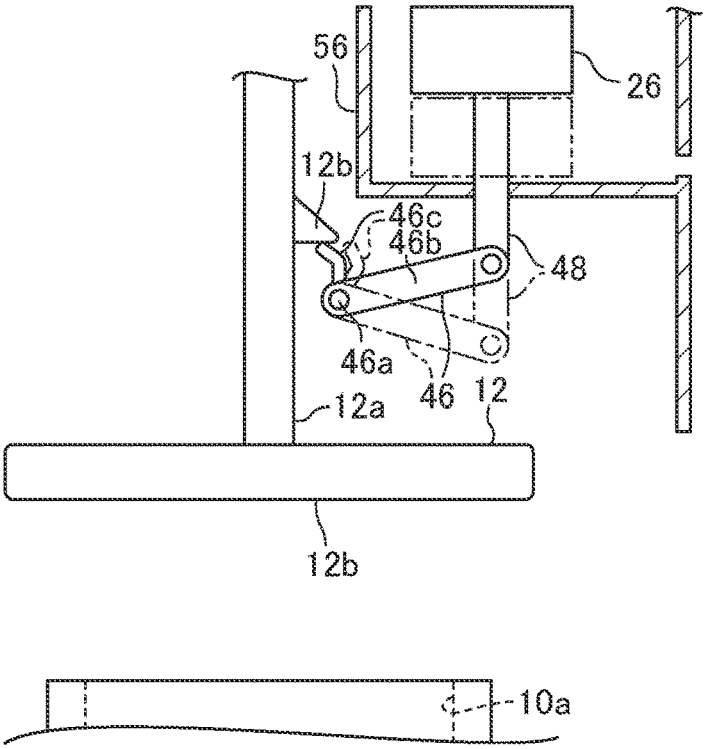
FIG. 4B is a diagram showing, in an enlarged manner, parts corresponding to a discharge valve, a water storage portion and the like provided in the flush water tank apparatus according to the first embodiment of the present invention.

FIGS. 4A and 4B are diagrams showing, in an enlarged manner, parts corresponding to the discharge valve 12, a water storage portion 56, a float 26, and the holding mechanism 46 in FIG. 2. FIG. 4A shows a state where the discharge valve 12 is closed, and FIG. 4B shows a state where the discharge valve 12 is opened and held by the holding mechanism 46.

As shown in FIG. 2, the flush water tank apparatus 4 further includes the discharge portion 54 for discharging supplied flush water, the water storage portion 56 for storing the flush water that is discharged through the discharge portion 54, the float 26 that is provided inside the water storage portion 56, and that moves vertically according to a water level in the water storage portion 56, a transmission portion 48 that is coupled to the float 26, and the holding mechanism 46 as a timing control mechanism that moves in conjunction with movement of the transmission portion 48 to move between a holding state where lowering of the discharge valve 12 is restricted and a non-holding state where lowering of the discharge valve 12 is not restricted (a state where engagement with a holding claw 12*b* of the discharge valve 12 is released). Additionally, as a modification, the flush water tank apparatus 4 may be described to include the discharge portion 54, the water storage portion 56, the float 26, and a timing control mechanism that is coupled to the float 26, that is operated according to a vertical movement of the float 26, and that controls a timing of lowering of the discharge valve 12 such that a timing when the drain port 10*a* is closed is earlier in a case where the second amount of flush water is selected than a timing in a case where the first amount of flush water is selected. Such a timing control mechanism may be described to include the transmission portion 48 that is coupled to the float 26, and the holding mechanism 46 that moves in conjunction with movement of the transmission portion 48 to move between the holding state where lowering of the discharge valve 12 is restricted and the non-holding state where lowering of the discharge valve 12 is not restricted (a state where engagement with the holding claw 12*b* of the discharge valve 12 is released).

Again, in the present embodiment, the discharge portion 54, the water storage portion 56, the float 26, and the transmission portion 48 function as the valve controller. The valve controller is provided coupled to the holding mechanism 46, and operates at a timing according to the amount of flush water selected by the remote controller 6 or the like. The flush water tank apparatus 4 includes such a valve controller. In a case where the first amount of flush water is selected by the remote controller 6 or the like, the valve controller causes the holding mechanism 46 to be engaged with the discharge valve 12 for a first period of time, and then, causes the holding mechanism 46 to operate such that engagement between the holding mechanism 46 and the discharge valve 12 is released, and the discharge valve 12 is thus lowered according to the first period of time. Furthermore, in a case where the second amount of flush water is selected by the remote controller 6 or the like, the valve controller causes the holding mechanism 46 to be engaged with the discharge valve 12 for a second period of time shorter than the first period of time, and then, causes the holding mechanism 46 to operate such that engagement between the holding mechanism 46 and the discharge valve 12 is released, and the discharge valve 12 is thus lowered after a lapse of the second period of time. Moreover, in a case where an arbitrary amount of flush water is selected by the remote controller 6 or the like, the valve controller causes the holding mechanism 46 to be engaged with the discharge valve 12 for a predetermined period of time according to the arbitrary amount of flush water, and then, causes the holding mechanism 46 to operate such that engagement between the holding mechanism 46 and the discharge valve 12 is released, and the discharge valve 12 is thus lowered after a lapse of the predetermined period of time. In this manner, the amount of flush water may be relatively easily changed according to a use state of a user, without being limited to the first amount of flush water (the amount of flush water for the large washing mode) and the second amount of flush water (the amount of flush water for the small washing mode), and an arbitrary amount of flush water may be supplied to the flush toilet main body 2. In this manner, the valve controller formed from the discharge portion 54, the water storage portion 56, the float 26, and the transmission portion 48 is formed to be operated by flush water that is supplied.

The discharge portion 54 discharges the flush water that is supplied, in a case where the second amount of flush water is selected by the remote controller 6. Furthermore, the discharge portion 54 is provided to also discharge the flush water in a case where the first amount of flush water is selected by the remote controller 6. The discharge portion 54 is formed at a lower end of the drive unit discharge passage 34*b* in a manner extending downward. The discharge portion 54 penetrates an upper surface of the casing 13 while being fixed to the upper surface of the casing 13. The discharge portion 54 forms a tapering and downward discharge port. Therefore, flush water is accelerated downward by the gravity, and its flow velocity is further accelerated because the flow channel is narrowed at the discharge port. The discharge portion 54 is disposed more inward than a side wall of the water storage portion 56, above the full water level WL.

In a standby state before start of flushing, at least a part of the water storage portion 56 is positioned below the stopped water level (the full water level WL) in the storage tank 10. More desirably, in the standby state before start of flushing, the water storage portion 56 is positioned below the stopped water level (the full water level WL) in the storage tank 10. The water storage portion 56 is formed as a hollow box, and an upper surface thereof is open. A part of the side wall of the water storage portion 56 is formed by the casing 13, and the water storage portion 56 is fixed to the casing 13. The water storage portion 56 is disposed below the discharge portion 54 formed to receive flush water that is discharged through the discharge portion 54. Furthermore, the water storage portion 56 is disposed to surround the float 26 from an outer side. Inside the water storage portion 56, a volume of flush water that can be stored between the water storage portion 56 and the float 26 is smaller than a volume of the cylinder 14*a*. A discharge hole 56*b* through which stored flush water is drained is formed in the water storage portion 56. The discharge hole 56*b* is formed in a lower part of a side wall 56*c* of the water storage portion 56 and forms an opening facing the opposite side of the valve stem 12*a* of the discharge valve 12 in a plan view. The discharge hole 56*b* forms a small hole with a relatively small diameter. Accordingly, an instantaneous flow rate A1 (see FIG. 7) of flush water that is drained from the discharge hole 56*b* to outside the water storage portion 56 (inside the storage tank 10) is smaller than an instantaneous flow rate A2 (see FIG. 7) of flush water that is discharged through the discharge portion 54.

The float 26 is disposed inside the water storage portion 56. The float 26 is a hollow cuboid member, and is configured to receive buoyancy from flush water that is stored in the water storage portion 56. Due to this buoyancy, when the water level in the water storage portion 56 is at or above a predetermined water level (an approximate water level at the float 26), the float 26 is placed in a state indicated by a solid line in FIG. 4A. The float 26 is driven based on the water level in the water storage portion 56 and is indirectly related to the water level in the storage tank 10, but is basically independently driven.

The transmission portion 48 forms a rod-shaped member that extends downward in a vertical direction from a lower surface of the float 26. The transmission portion 48 is fixed to the lower surface of the float 26. The transmission portion 48 penetrates a bottom surface of the water storage portion 56 to extend to below the water storage portion 56. The transmission portion 48 is not fixed to the water storage portion 56, and is slidably disposed relative to the water storage portion 56. A lower end of the transmission portion 48 is coupled to the holding mechanism 46. Accordingly, the transmission portion 48 vertically moves according to vertical movement of the float 26 to cause the holding mechanism 46 to operate.

The holding mechanism 46 is coupled to the transmission portion 48, is operated according to vertical movement of the float 26 and the transmission portion 48, and controls the timing of lowering of the discharge valve 12 such that the timing when the drain port 10*a* is closed is earlier in a case where the second amount of flush water is selected than a timing in a case where the first amount of flush water is selected. Accordingly, the holding mechanism 46 stops lowering of the discharge valve 12 while engaged with the discharge valve 12, and controls the timing when the drain port 10*a* is closed.

The holding mechanism 46 is moved between the holding state and the non-holding state in conjunction with movement of the transmission portion 48. The holding mechanism 46 is configured to, when moved to the holding state, engage with the discharge valve 12 to hold the discharge valve 12 at a predetermined height. The holding mechanism 46 is a mechanism that is coupled to the transmission portion 48 by a link mechanism or the like, and includes a support shaft 46*a*, an arm member 46*b* supported by the support shaft 46*a*, and an engaging member 46*c* as an engaging portion. The support shaft 46*a* is a rotary shaft fixed to the storage tank 10 by an arbitrary member (not shown) and supports the arm member 46*b* and the engaging member 46*c* in a rotatable state. At a proximal end portion of the valve stem 12*a* of the discharge valve 12, a holding claw 12*b* formed to be engageable with the engaging member 46*c* is formed. The holding claw 12*b* is a projection in a right-angle triangular shape, which extends toward the engaging member 46*c* from the valve stem 12*a*. Its base is in the horizontal direction, and its side face is formed to be sloped downward.

The support shaft 46*a* is a shaft extending in a direction orthogonal to the surface of FIGS. 4A and 4B. Both of its end portions are fixed to the storage tank 10 by an arbitrary member (not shown), and an intermediate part is formed being curved to be away from the valve stem 12*a*. The arm member 46*b* is a beam-shaped member that is bent, and its lower end portion is configured to branch into two. These branched lower ends of the arm member 46*b* are rotatably supported by both end portions of the support shaft 46*a*, respectively. Therefore, even when the discharge valve 12 is moved in the vertical direction, it does not happen that the support shaft 46*a* and the arm member 46*b* interfere with the holding claw 12*b* provided on the valve stem 12*a* of the discharge valve 12.

For its part, an upper end portion of the arm member 46*b* is rotatably coupled to the transmission portion 48. Therefore, in a state of receiving buoyancy, the float 26 is held in the state shown by the solid lines in FIG. 4A. Furthermore, when the water level in the water storage portion 56 drops, the float 26 and the transmission portion 48 are lowered due to their own weights, and the arm member 46*b* and the engaging member 46*c* are rotated around the support shaft 46*a* to reach a state indicated by an imaginary line in FIG. 4A. Additionally, rotation of the arm member 46*b* and the engaging member 46*c* is limited to between the holding state of the holding mechanism 46 indicated by the solid line in FIG. 4A and the non-holding state indicated by the imaginary line.

Furthermore, the engaging member 46*c* is a member rotatably attached to the support shaft 46*a*, and its proximal end portion is rotatably supported by both end portions of the support shaft 46*a*. The engaging member 46*c* is formed such that the engaging member 46*c* can be engaged with the discharge valve 12 depending on the position of the float 26. A distal end portion of the engaging member 46*c* curvedly extends towards the valve stem 12*a* of the discharge valve 12. In a case where flush water is stored in the water storage portion 56 and the float 26 is raised, the holding mechanism 46 is at a position where the engaging member 46*c* can be engaged with the discharge valve 12. Therefore, in the holding state of having been rotated to the position shown by the solid lines of FIG. 4A, the distal end portion of the engaging member 46*c* interferes with the holding claw 12*b* provided on the valve stem 12*a*. On the other hand, in a case where the float 26 is lowered, the holding mechanism 46 moves the engaging member 46*c* to a position at which engagement with the discharge valve 12 is released, as indicated by the imaginary line in FIG. 4A. In this manner, in the non-holding state reached by rotation to the position indicated by the imaginary line in FIG. 4A, the distal end portion of the engaging member 46*c* and the holding claw 12*b* do not interfere with each other.

The engaging member 46*c* is configured to be rotated around the support shaft 46*a* in conjunction with the arm member 46*b*. That is, in a case where the float 26, the transmission portion 48 and the arm member 46*b* are moved from the state indicated by the solid line in FIG. 4A to the state indicated by the imaginary line, the engaging member 46*c* is also rotated to the state indicated by the imaginary line in conjunction with the arm member 46*b*. However, if the distal end of the engaging member 46*c* is pushed upward by the holding claw 12*b* of the discharge valve 12 in the state shown by the solid lines in FIG. 4A, only the engaging member 46*c* can rotate idle. In other words, when the distal end portion of the engaging member 46*c* is pushed upward by the holding claw 12*b*, only the engaging member 46*c* can rotate to the position shown by the imaginary lines of FIGS. 4A and 4B while the float 26, the transmission portion 48, and the arm member 46*b* keep holding the position shown by the solid lines.

In a state in which the discharge valve 12 is pulled upward, and the holding claw 12*b* is positioned above the engaging member 46*c* as shown by solid lines in FIG. 4B, the holding claw 12*b* and the engaging member 46*c* engage with each other, and descent of the discharge valve 12 is prevented. In other words, the engaging member 46*c* constituting the holding mechanism 46 engages with the discharge valve 12 and holds the discharge valve 12 at a predetermined height. Therefore, the discharge valve 12 is pulled up by the rod 32 (FIGS. 3A to 3H) connected to the discharge valve hydraulic drive unit 14, and, after that, the discharge valve 12 descends when the clutch mechanism 30 is disconnected. The holding claw 12*b* of the discharge valve 12 and the engaging member 46*c* of the holding mechanism 46 engage with each other during the descent, and the discharge valve 12 is held at the predetermined height.

Next, when the water level in the water storage portion 56 drops, the position of the float 26 is lowered, and the float 26, the transmission portion 48 and the arm member 46*b* are moved to positions indicated by an imaginary line in FIG. 4B. Since the engaging member 46*c* is also rotated to the position shown by the imaginary lines in FIG. 4B in conjunction with this movement, the engagement between the holding claw 12*b* and the engaging member 46*c* is released. Thereby, the discharge valve 12 descends and seats on the drain port 10*a*, and the drain port 10*a* is closed.

Next, a description will be made on operation of the flush water tank apparatus 4 according to the first embodiment of the present invention and operation of the flush toilet apparatus 1 provided with the flush water tank apparatus 4, newly referring to FIG. 2 and FIGS. 5 to 10.

First, in the toilet washing standby state shown in FIG. 2, the water level in the storage tank 10 is the predetermined full water level WL. In this state, both of the first control valve 16 and the second control valve 22 are closed. The holding mechanism 46 is in the holding state shown by the solid lines in FIG. 4A. In such a standby state before flush water is discharged through the discharge portion 54, the flush water is stored in the water storage portion 56, the float 26 in the water storage portion 56 is raised due to the buoyancy from the flush water, the transmission portion 48 coupled to the float 26 is raised, and the holding mechanism 46 is in the holding state. Next, when the user pushes a large washing button on the remote controller 6 (FIG. 1), the remote controller 6 transmits an instruction signal for executing the large washing mode to the controller 40 (FIG. 2). When a small washing button is pushed, an instruction signal for executing the small washing mode is transmitted to the controller 40. Thus, in the present embodiment, the flush toilet apparatus 1 is provided with the two washing modes, the large washing mode and the small washing mode with different amounts of flush water, and the remote controller 6 functions as the flush water amount selection portion for selecting the amount of flush water.

Note that, in the flush toilet apparatus 1 of the present embodiment, if a predetermined time passes without the washing button on the remote controller 6 not being pressed after it is detected by the human sensor 8 (FIG. 1) that the user has left the toilet seat, an instruction signal for toilet washing is also transmitted to the controller 40. Further, if a time from the user sitting on the toilet seat until leaving the toilet seat is shorter than a predetermined time, the controller 40 judges that the user has urinated and executes the small washing mode. On the other hand, if the time from sitting on the toilet seat until leaving the toilet seat is longer than the predetermined time, the controller 40 executes the large washing mode. Therefore, in this case, since the large washing mode for performing washing with the first amount of flush water or the small washing mode for performing washing with the second amount of flush water is selected by the controller 40, the controller 40 functions as the flush water amount selection portion.

Next, operation of the large washing mode will be described with reference to FIG. 2, and FIGS. 5 to 10.

Figure 5:
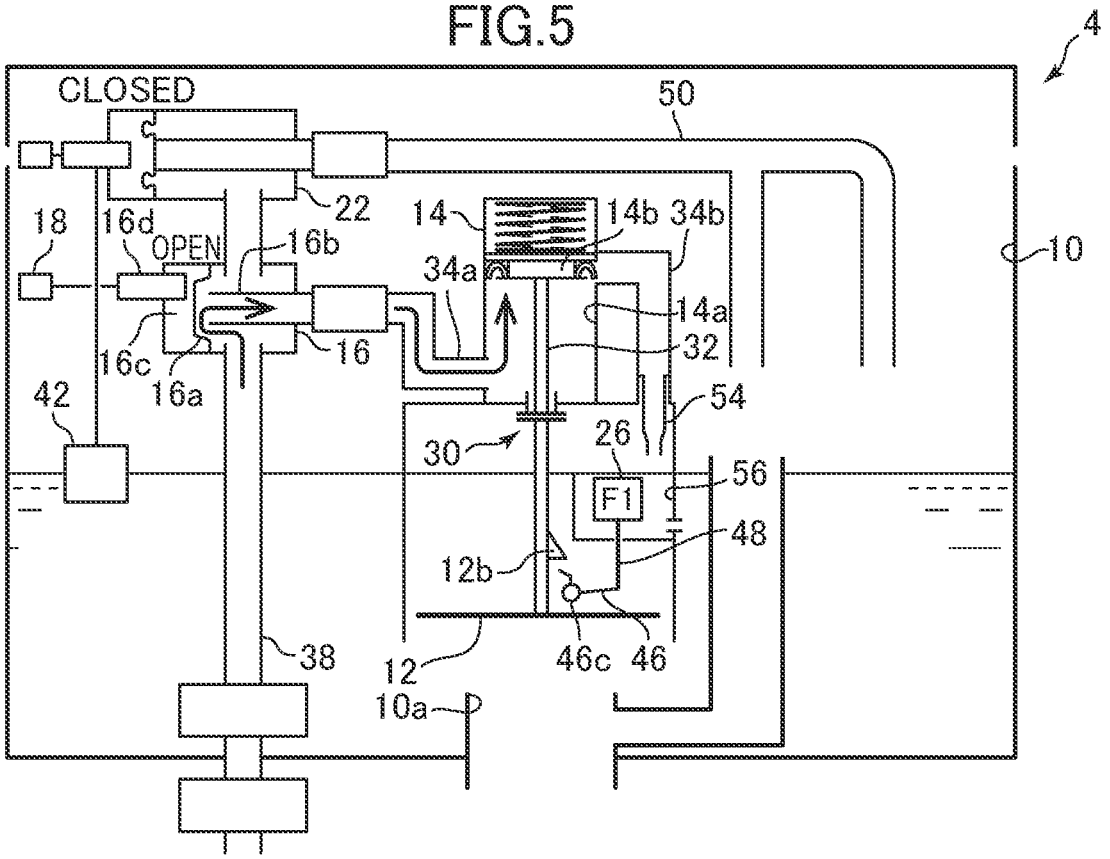
FIG. 5 is a diagram showing operation in a large washing mode of the flush water tank apparatus according to the first embodiment of the present invention.

When receiving an instruction signal to perform large washing, the controller 40 causes the solenoid valve 18 (FIG. 2) provided for the first control valve 16 to operate to cause the pilot valve 16*d* on the solenoid valve side to leave from the pilot valve port. Thereby, the pressure in the pressure chamber 16*c* drops; the main valve body 16*a* leaves from the main valve port 16*b*; and the main valve port 16*b* is opened. When the first control valve 16 is opened, flush water flowing in from the water supply pipe 38 is supplied to the discharge valve hydraulic drive unit 14 via the first control valve 16 as shown in FIG. 5. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2. At this time, the pilot valve 16*d* is still in an open state, and the flush water flowing in from the water supply pipe 38 keeps being supplied to the discharge valve hydraulic drive unit 14 through the first control valve 16. Because the piston 14*b* is raised to the second position, and the drive unit water supply passage 34*a* and the drive unit discharge passage 34*b* are caused to communicate with each other through the inside of the cylinder 14*a*, the flush water is discharged through the discharge portion 54 into the water storage portion 56. Accordingly, after the discharge valve hydraulic drive unit 14 raises the discharge valve 12, supply of flush water from the first control valve 16 to the water storage portion 56 is started. As described later, the clutch mechanism 30 is disconnected when the discharge valve 12 is raised, and supply of flush water from the first control valve 16 to the water storage portion 56 and the like as the valve controller is started after the clutch mechanism 30 is disconnected.

When the discharge valve 12 is pulled up, the holding claw 12*b* provided on the valve stem 12*a* of the discharge valve 12 causes the engaging member 46*c* of the holding mechanism 46 to be pushed up and rotated, and the holding claw 12*b* gets over the engaging member 46*c* (FIG. 4A-*FIG. 4B).

Figure 6:
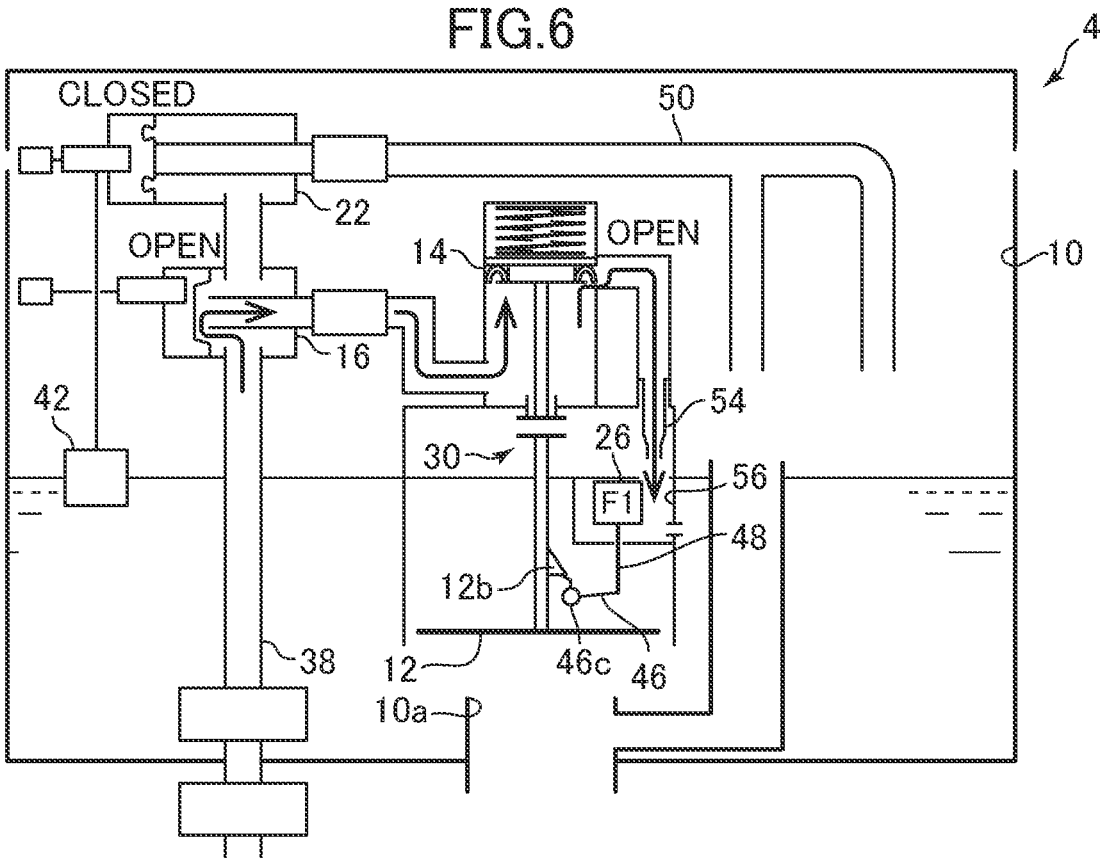
FIG. 6 is a diagram showing the operation in the large washing mode of the flush water tank apparatus according to the first embodiment of the present invention.

Next, when the discharge valve 12 is further pulled up, the clutch mechanism 30 is disconnected as shown in FIG. 6. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B→FIG. 3C).

When the clutch mechanism 30 is disconnected, the discharge valve 12 starts to descend toward the drain port 10*a* due to its own weight. Here, the water level in the water storage portion 56 is high immediately after the discharge valve 12 is opened, and thus, the float 26 is at a position where the float 26 is floating due to the buoyancy, the transmission portion 48 is in a raised state, and the holding mechanism 46 is at the holding state indicated by the solid line in FIG. 4B. Therefore, the holding claw 12*b* of the discharge valve 12 that has descended engages with the engaging member 46*c* of the holding mechanism 46, and the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept. Furthermore, also after the clutch mechanism 30 is disconnected and the drain port 10*a* is placed in the open state, the pilot valve 16*d* is kept in the open state, and flush water is discharged through the discharge portion 54 into the water storage portion 56. Accordingly, lowering of the float 26 in the water storage portion 56 is restricted, and lowering of the discharge valve 12 is restricted.

Figure 7:
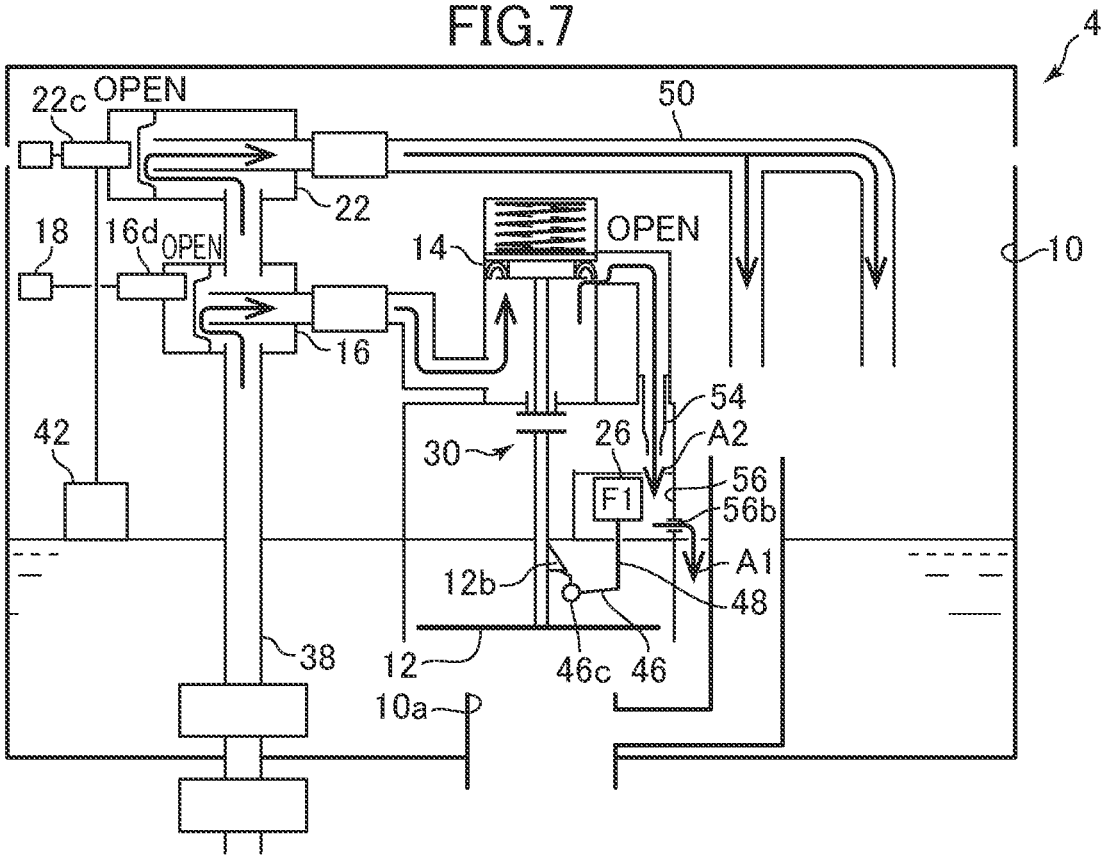
FIG. 7 is a diagram showing the operation in the large washing mode of the flush water tank apparatus according to the first embodiment of the present invention.

Then, when the water level in the storage tank 10 drops as shown in FIG. 7, the float switch 42 that detects the water level in the storage tank 10 is turned off. When the float switch 42 is turned off, the pilot valve 22*c* provided for the second control valve 22 is opened. Thereby, flush water is supplied from the second control valve 22 into the storage tank 10 via the water supply passage 50. When the pilot valve 22*c* is opened, if the large washing mode is selected, the controller 40 keeps the pilot valve 16*d* on the solenoid valve 18 side open. Flush water flowing in from the water supply pipe 38 keeps being discharged into the water storage portion 56 via the first control valve 16 and the discharge valve hydraulic drive unit 14 and through the discharge portion 54

The flush water that is discharged through the discharge portion 54 is stored in the water storage portion 56. At this time, a small amount of flush water is drained through the discharge hole 56*b* to outside the water storage portion 56 (inside the storage tank 10). The instantaneous flow rate A1 (see FIG. 7) of the flush water that is drained through the discharge hole 56*b* is smaller than the instantaneous flow rate A2 (see FIG. 7) of the flush water that is discharged through the discharge portion 54. Of the flush water that is discharged into the water storage portion 56, flush water flowing above an upper end of the water storage portion 56 flows into the storage tank 10. In this manner, the amount of flush water inside the water storage portion 56 is not reduced, and approximately the same water level as the water level in the standby state before start of flushing is maintained. Accordingly, because the water level in the water storage portion 56 is high, the float 26 is at a position where the float 26 is floating due to the buoyancy the transmission portion 48 is in the raised state, and the holding mechanism 46 is in the holding state indicated by the solid line in FIG. 4B. Accordingly, the holding claw 12*b* of the discharge valve 12 that is lowered engages with the engaging member 46*c* of the holding mechanism 46, and the discharge valve 12 is held at a predetermined height by the holding mechanism 46. When the discharge valve 12 is held by the holding mechanism 46, the drain port 10*a* is maintained in the open state, and flush water in the storage tank 10 keeps being drained to the flush toilet main body 2.

Figure 8:
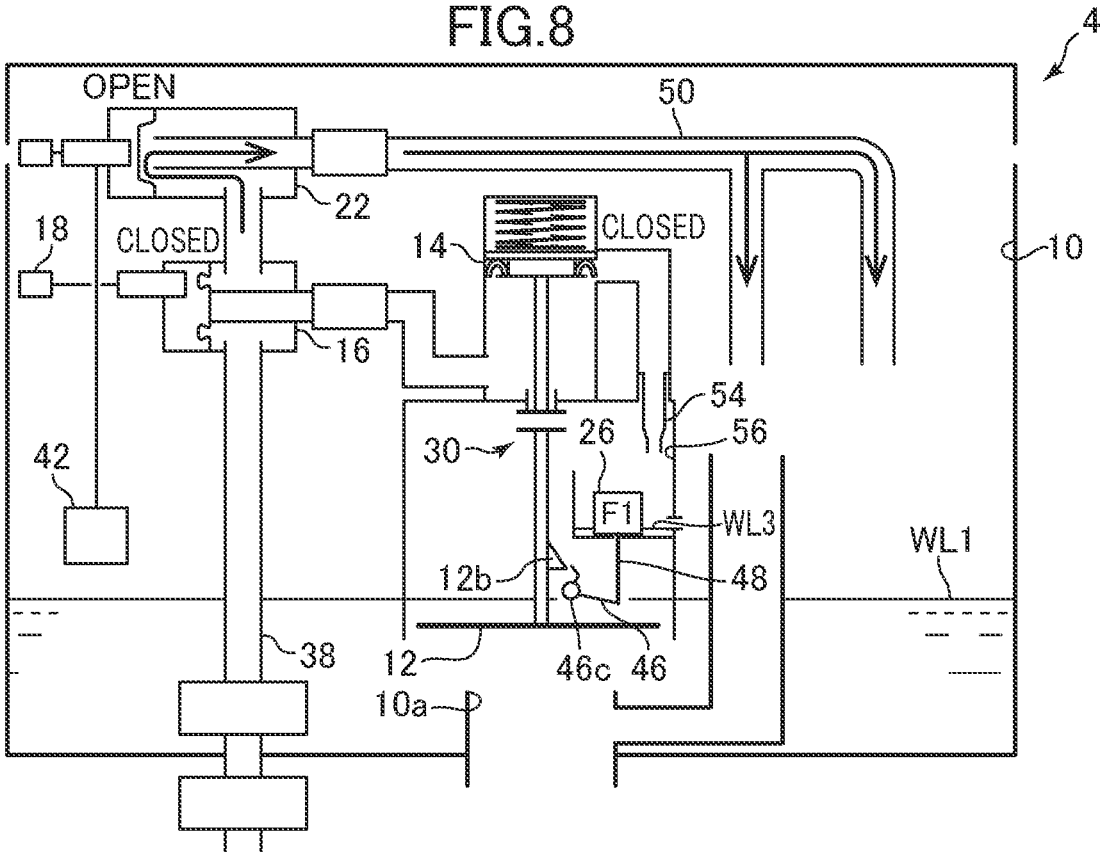
FIG. 8 is a diagram showing the operation in the large washing mode of the flush water tank apparatus according to the first embodiment of the present invention.

Next, as shown in FIG. 8, in a case where the large washing mode is selected, the controller 40 closes the solenoid valve 18 and closes the first control valve 16 after a lapse of the first period of time from when the solenoid valve 18 is opened (when flushing is started). As described later, the timing when the controller 40 closes the solenoid valve 18 (when the first period of time elapses) is set taking into account a timing of reducing the flush water in the water storage portion 56 and lowering the float 26 such that the discharge valve 12 is seated on the drain port 10*a* to block the drain port 10*a* when the water level in the storage tank 10 drops to a predetermined water level WL1. Because the first control valve 16 is closed, supply of flush water to the discharge valve hydraulic drive unit 14 and the discharge portion 54 is stopped. At a time immediately after supply of flush water is stopped, flush water is stored outside the float 26 in the water storage portion 56 almost up to full in the water storage portion 56, and the float 26 is in a state as shown in FIG. 7 (a floating state due to the buoyancy). Then, the flush water that is stored in the water storage portion 56 is gradually drained through the discharge hole 56*b*, and the water level of the flush water in the water storage portion 56 is lowered.

Furthermore, as shown in FIG. 8, at a time when the water level of the flush water in the water storage portion 56 drops to a predetermined water level WL3 (such a time corresponds to a time when the water level in the storage tank 10 drops to the predetermined water level WL1), the position of the float 26 connected to the transmission portion 48 and the holding mechanism 46 is lowered. The holding mechanism 46 thus shifts to the non-holding state indicated by the imaginary line in FIG. 4B. Engagement between the engaging member 46*c* and the holding claw 12*b* of the discharge valve 12 is thereby released. Because the holding mechanism 46 shifts to the non-holding state, the discharge valve 12 is separated from the holding mechanism 46 to start being lowered again. Flush water that is supplied from the second control valve 22 into the storage tank 10 via the water supply passage 50 keeps being supplied.

Figure 9:
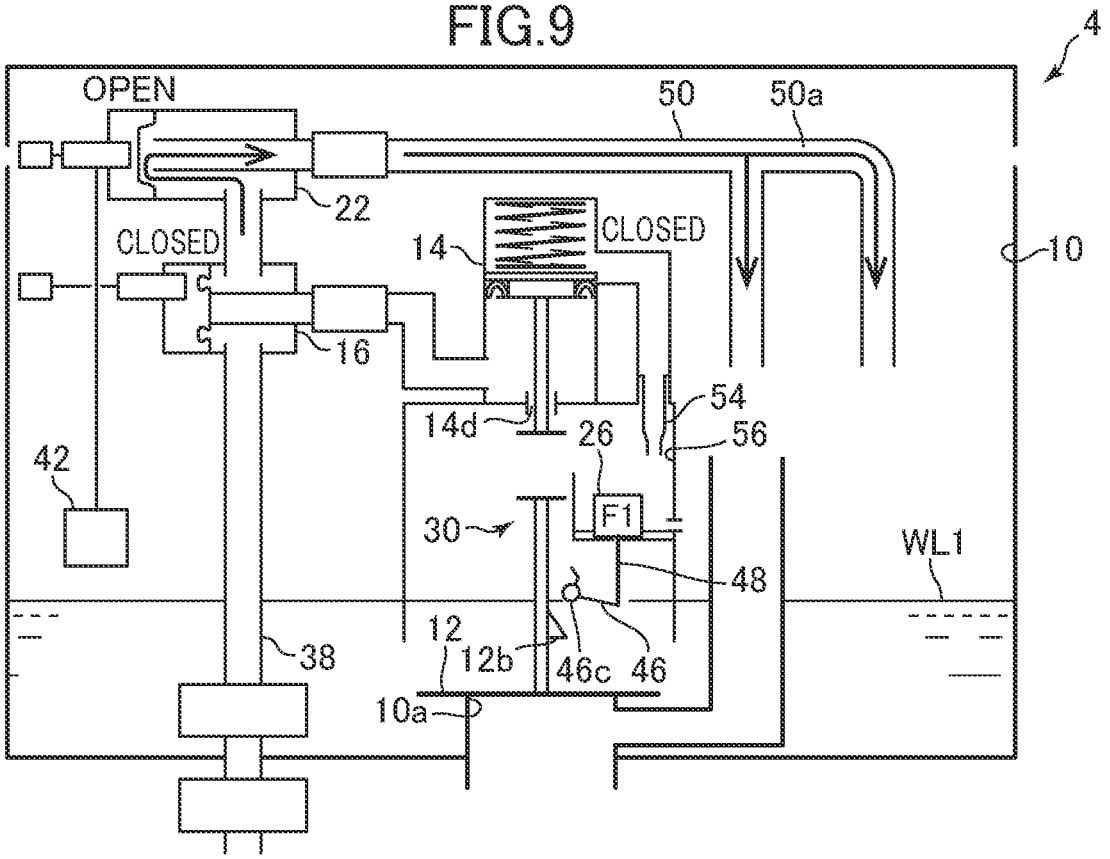
FIG. 9 is a diagram showing the operation in the large washing mode of the flush water tank apparatus according to the first embodiment of the present invention.

As shown in FIG. 9, the discharge valve 12 that is lowered is seated on the drain port 10*a*, and the drain port 10*a* is closed. Thus, when the large washing mode is executed, the discharge valve 12 is held until the water level in the storage tank 10 drops from the full water level WL to the predetermined water level WL1, and the first amount of flush water is discharged to the flush toilet main body 2.

Since the float switch 42 is still in the off state, the open state of the second control valve 22 is kept, and water supply to the storage tank 10 is continued. Flush water supplied via the water supply passage 50 reaches the water supply passage branch portion 50*a*, and a part of the flush water branched at the water supply passage branch portion 50*a* flows into the overflow pipe 10*b*, and the remaining flush water is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 10:
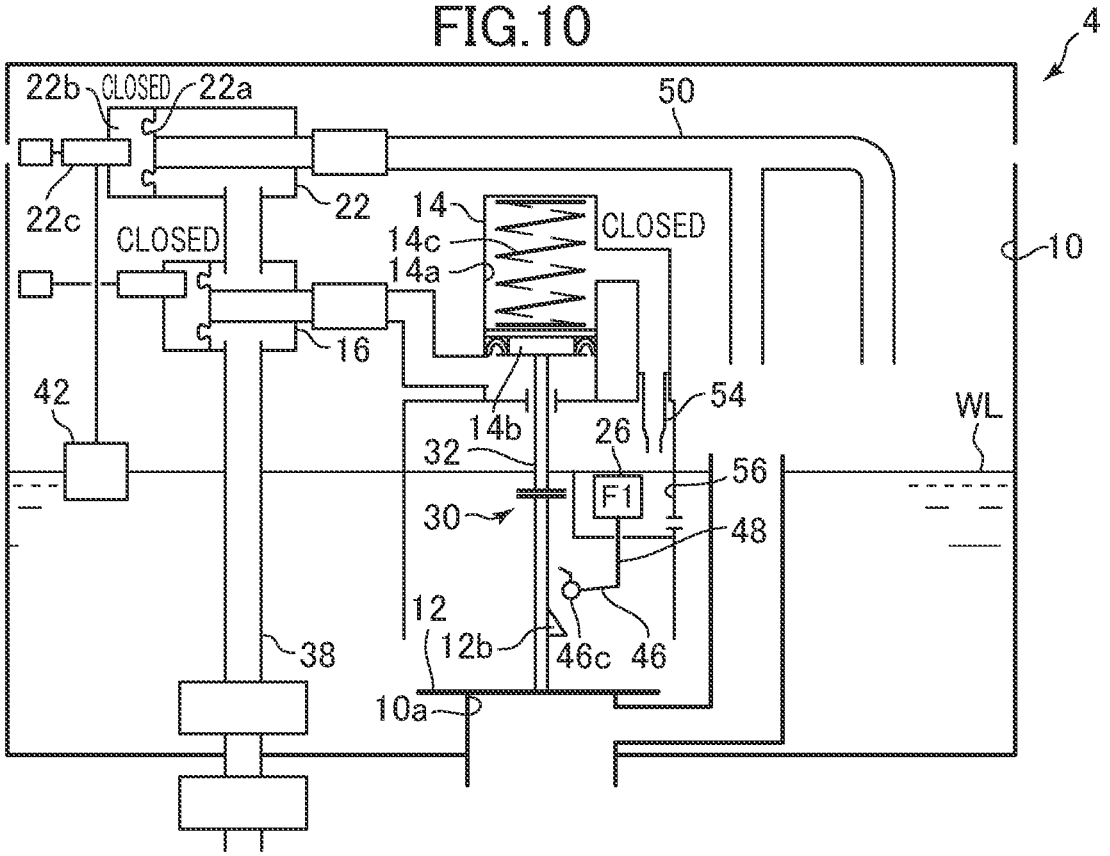
FIG. 10 is a diagram showing the operation in the large washing mode of the flush water tank apparatus according to the first embodiment of the present invention.

When the water level in the storage tank 10 rises to the full water level WL as shown in FIG. 10, the float switch 42 is turned on. When the float switch 42 is turned on, the pilot valve 22*c* on the float switch side is closed. Thereby, the pilot valve 22*c* enters the closed state. Therefore, pressure in the pressure chamber 22*b* rises, the main valve body 22*a* of the second control valve 22 is closed, and water supply is stopped. Because the water level in the storage tank 10 rises to the predetermined full water level WL, flush water flows into the water storage portion 56, the float 26 and the transmission portion 48 are raised, and the holding mechanism 46 is returned to the holding state.

After the first control valve 16 is closed and supply of water to the discharge valve hydraulic drive unit 14 is stopped, as shown in FIG. 8, the flush water in the cylinder 14*a* of the discharge valve hydraulic drive unit 14 gradually flows out from the gap 14*d*, and the piston 14*b* is pushed down by the energizing force from the spring 14*c*, and the rod 32 is thus lowered, as shown in FIGS. 9 and 10. Thereby, the clutch mechanism 30 is connected (FIG. 3E to FIG. 3H), and the standby state before starting toilet washing is returned to.

Next, operation of the small washing mode will be described with reference to FIG. 2, and FIGS. 11 to 15.

As shown in FIG. 2, the toilet washing standby state is similar to that of the large washing.

Figure 11:
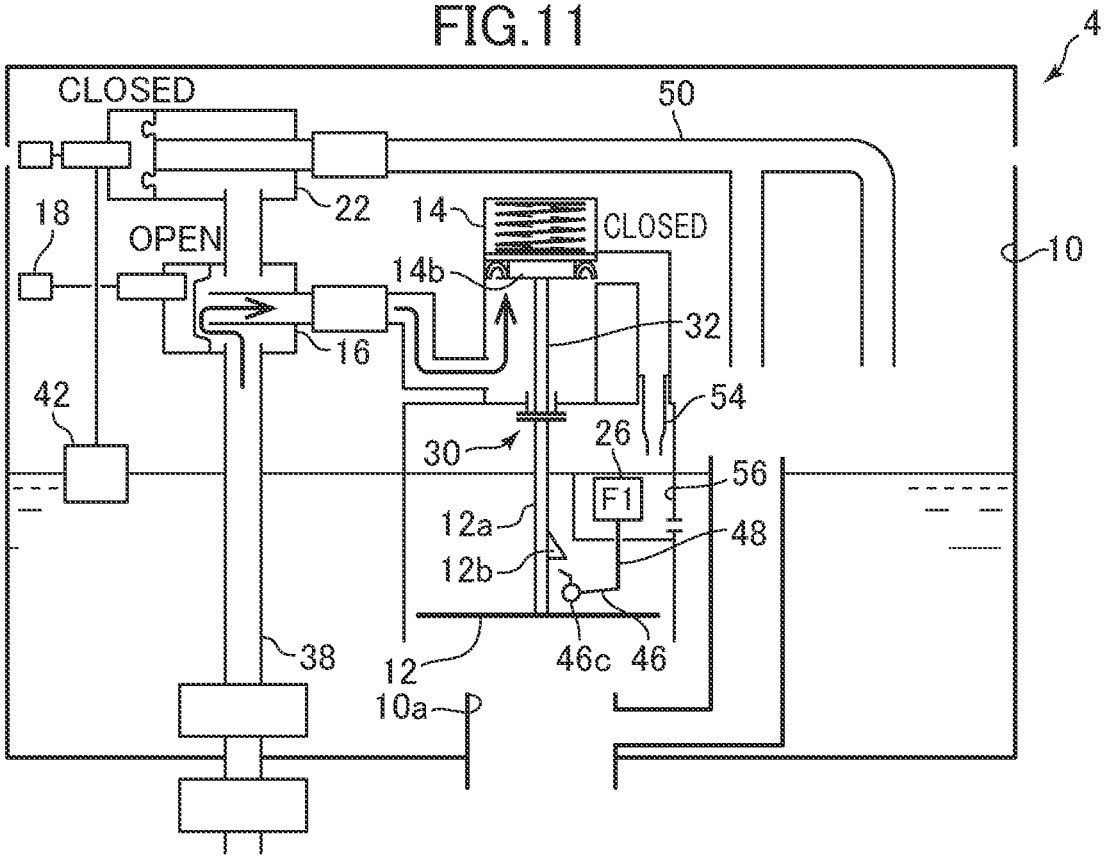
FIG. 11 is a diagram showing operation in a small large washing mode of the flush water tank apparatus according to the first embodiment of the present invention.

When receiving an instruction signal to perform small washing, the controller 40 causes the solenoid valve 18 provided for the first control valve 16 to operate to open the first control valve 16. The controller 40 leaves the second control valve 22 closed. When the first control valve 16 is opened, flush water flowing in from the water supply pipe 38 is supplied to the discharge valve hydraulic drive unit 14 via the first control valve 16 as shown in FIG. 11. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2. Note that, when the discharge valve 12 is pulled up, the holding claw 12*b* (FIG. 4A) provided on the valve stem 12*a* of the discharge valve 12 pushes up and rotates the engaging member 46*c* of the holding mechanism 46, and the holding claw 12*b* gets over the engaging member 46*c*.

Figure 12:
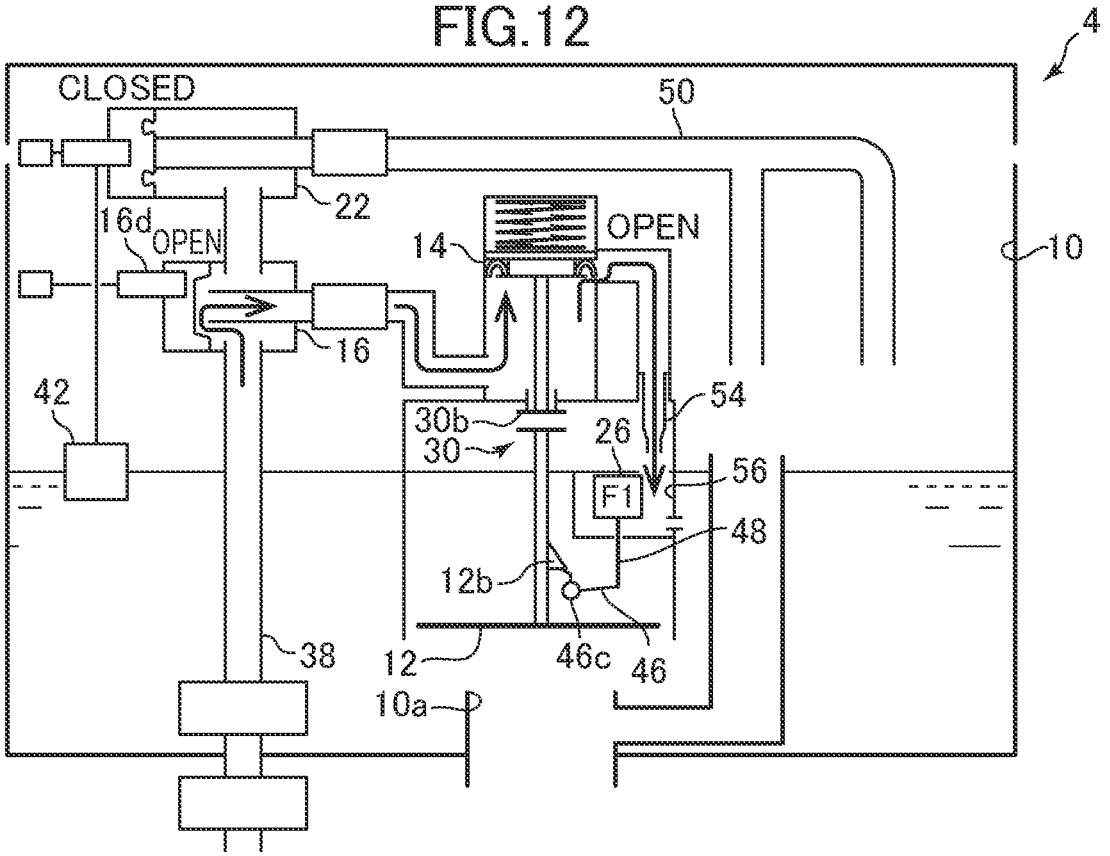
FIG. 12 is a diagram showing the operation in the small large washing mode of the flush water tank apparatus according to the first embodiment of the present invention.

Next, when the discharge valve 12 is further pulled up, the clutch mechanism 30 is disconnected as shown in FIG. 12. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B→FIG. 3C).

When the clutch mechanism 30 is disconnected, the discharge valve 12 starts to descend toward the drain port 10*a* due to its own weight. Here, because the water level in the water storage portion 56 is high immediately after the discharge valve 12 is opened, the float 26 is at a position where the float 26 is floating due to the buoyancy the transmission portion 48 is in the raised state, and the holding mechanism 46 is in the holding state indicated by the solid line in FIG. 4B. Accordingly, the holding claw 12*b* of the discharge valve 12 that is lowered engages with the engaging member 46*c* of the holding mechanism 46, and the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept. Furthermore, also after the clutch mechanism 30 is disconnected and the drain port 10*a* is placed in the open state, the pilot valve 16*d* is kept in the open state, and the flush water is discharged through the discharge portion 54 into the water storage portion 56. Accordingly, lowering of the float 26 in the water storage portion 56 is restricted, and lowering of the discharge valve 12 is restricted.

Discharge through the discharge portion 54 is continued for a predetermined period of time. The flush water that is discharged through the discharge portion 54 is stored in the water storage portion 56. At this time, a small amount of flush water is drained through the discharge hole 56*b* to outside the water storage portion 56 (inside the storage tank 10). The instantaneous flow rate A1 (see FIG. 7) of the flush water that is drained through the discharge hole 56*b* is smaller than the instantaneous flow rate A2 (see FIG. 7) of the flush water that is discharged through the discharge portion 54. Of the flush water that is discharged into the water storage portion 56, flush water flowing above the upper end of the water storage portion 56 flows into the storage tank 10. In this manner, the amount of flush water inside the water storage portion 56 is not reduced, and approximately the same water level as the water level in the standby state before start of flushing is maintained. Accordingly, because the water level in the water storage portion 56 is high, the float 26 is at a position where the float 26 is floating due to the buoyancy, the transmission portion 48 is in the raised state, and the holding mechanism 46 is in the holding state indicated by the solid line in FIG. 4B. Therefore, the holding claw 12*b* of the discharge valve 12 that has descended engages with the engaging member 46*c* of the holding mechanism 46, and the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept.

Figure 13:
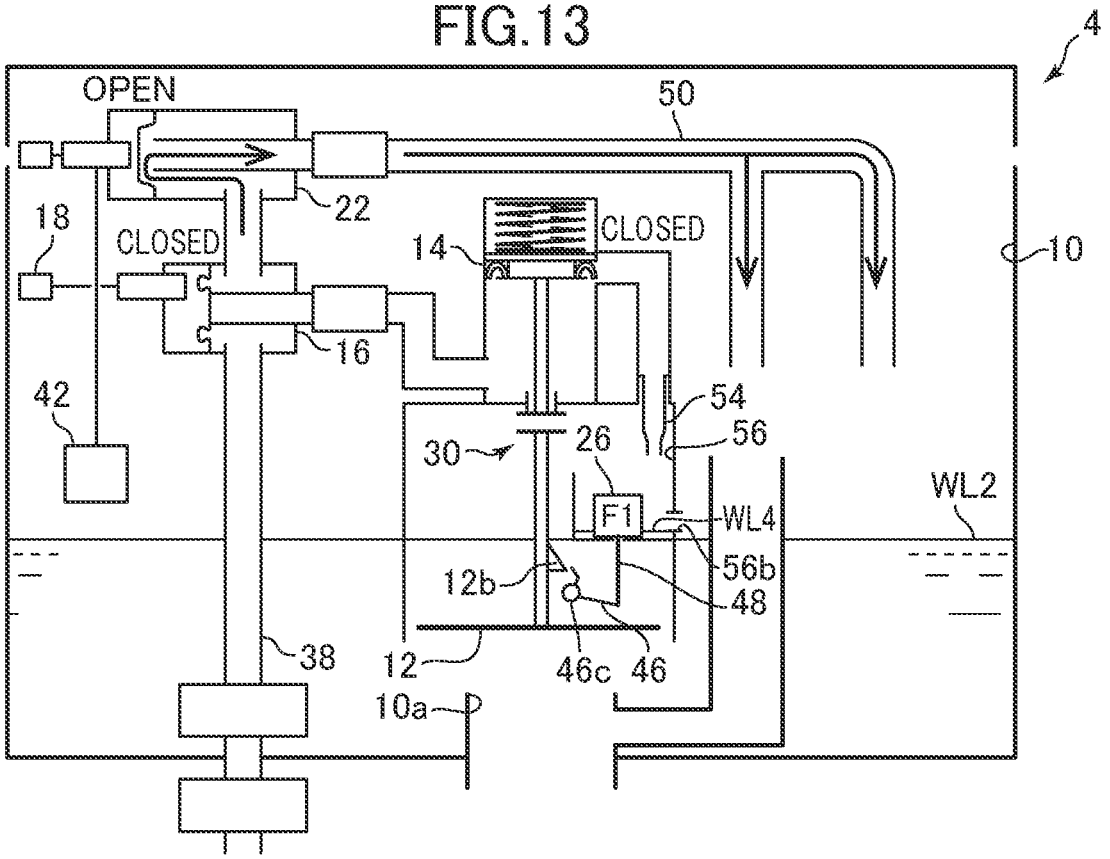
FIG. 13 is a diagram showing the operation in the small large washing mode of the flush water tank apparatus according to the first embodiment of the present invention.

Next, as shown in FIG. 13, in a case where the small washing mode is selected, after a lapse of the second period of time from opening the solenoid valve 18 (start of flushing), the controller 40 closes the solenoid valve 18, and closes the first control valve 16. The second period of time is shorter than the first period of time. As described later, the timing when the controller 40 closes the solenoid valve 18 (after a lapse of the second period of time) is set taking into account a timing of reducing the flush water in the water storage portion 56 and lowering the float 26 such that the discharge valve 12 is seated on the drain port 10*a* to block the drain port 10*a* when the water level in the storage tank 10 drops to a predetermined water level WL2. Because the first control valve 16 is closed, supply of flush water to the discharge valve hydraulic drive unit 14 and the discharge portion 54 is stopped. At a time immediately after supply of flush water is stopped, flush water is stored outside the float 26 in the water storage portion 56 almost up to full in the water storage portion 56, and the float 26 is in a state as shown in FIG. 12 (a floating state due to the buoyancy). Then, the flush water that is stored in the water storage portion 56 is gradually drained through the discharge hole 56*b*, and the water level of flush water in the water storage portion 56 is lowered.

Furthermore, as shown in FIG. 13, at a time when the water level of the flush water in the water storage portion 56 drops to a predetermined water level WL4 (a water level approximately the same as the predetermined water level WL3; such a time corresponds to a time when the water level in the storage tank 10 drops to the predetermined water level WL2), the position of the float 26 connected to the transmission portion 48 and the holding mechanism 46 is lowered. The holding mechanism 46 thus shifts to the non-holding state indicated by the imaginary line in FIG. 4B. Engagement between the engaging member 46*c* and the holding claw 12*b* of the discharge valve 12 is thereby released. Because the holding mechanism 46 shifts to the non-holding state, the discharge valve 12 is separated from the holding mechanism 46 to start being lowered again. Flush water that is supplied from the second control valve 22 into the storage tank 10 via the water supply passage 50 keeps being supplied.

Figure 14:
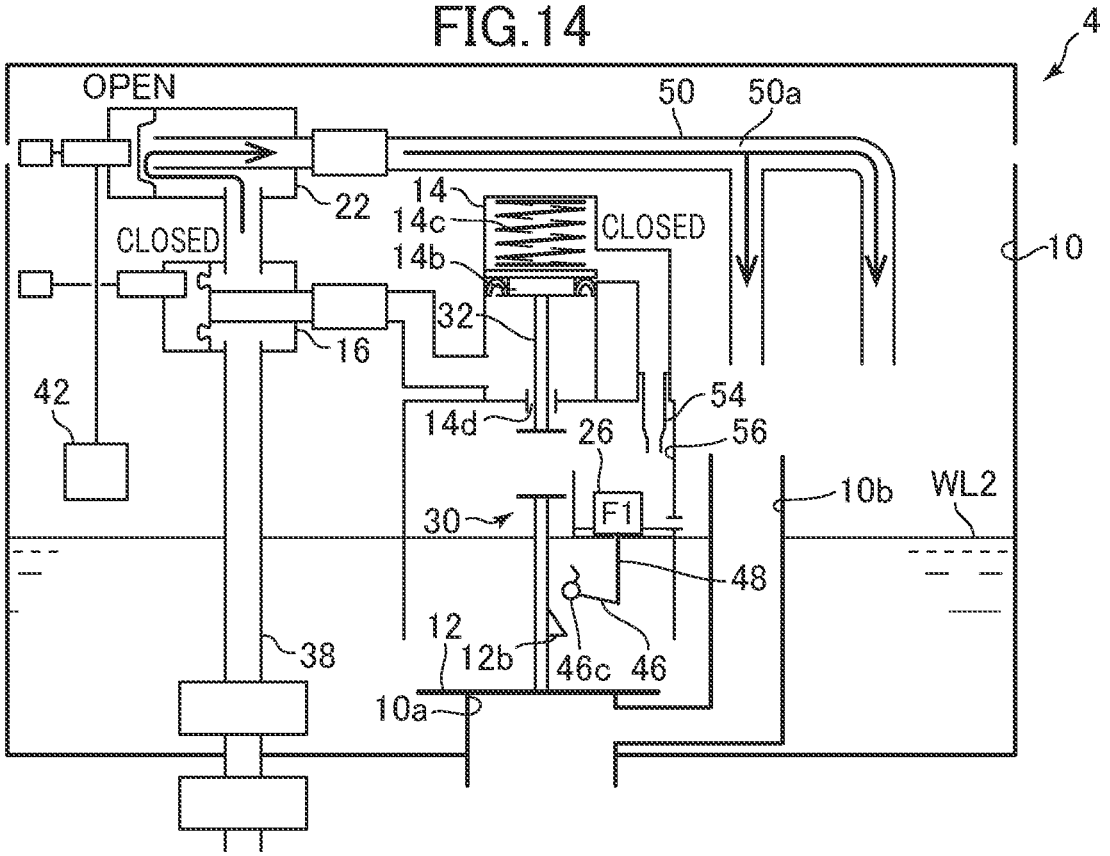
FIG. 14 is a diagram showing the operation in the small large washing mode of the flush water tank apparatus according to the first embodiment of the present invention.

As shown in FIG. 14, the discharge valve 12 that is lowered is seated on the drain port 10*a*, and the drain port 10*a* is closed. In this manner, in a case where the small washing mode is performed, the discharge valve 12 is held until the water level in the storage tank 10 drops from the full water level WL to the predetermined water level WL2, and the second amount of flush water is drained into the flush toilet main body 2.

Since the float switch 42 is still in the off state, the open state of the second control valve 22 is kept, and water supply to the storage tank 10 is continued. Flush water supplied via the water supply passage 50 reaches the water supply passage branch portion 50*a*, and a part of the flush water branched at the water supply passage branch portion 50*a* flows into the overflow pipe 10*b*, and the remaining flush water is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 15:
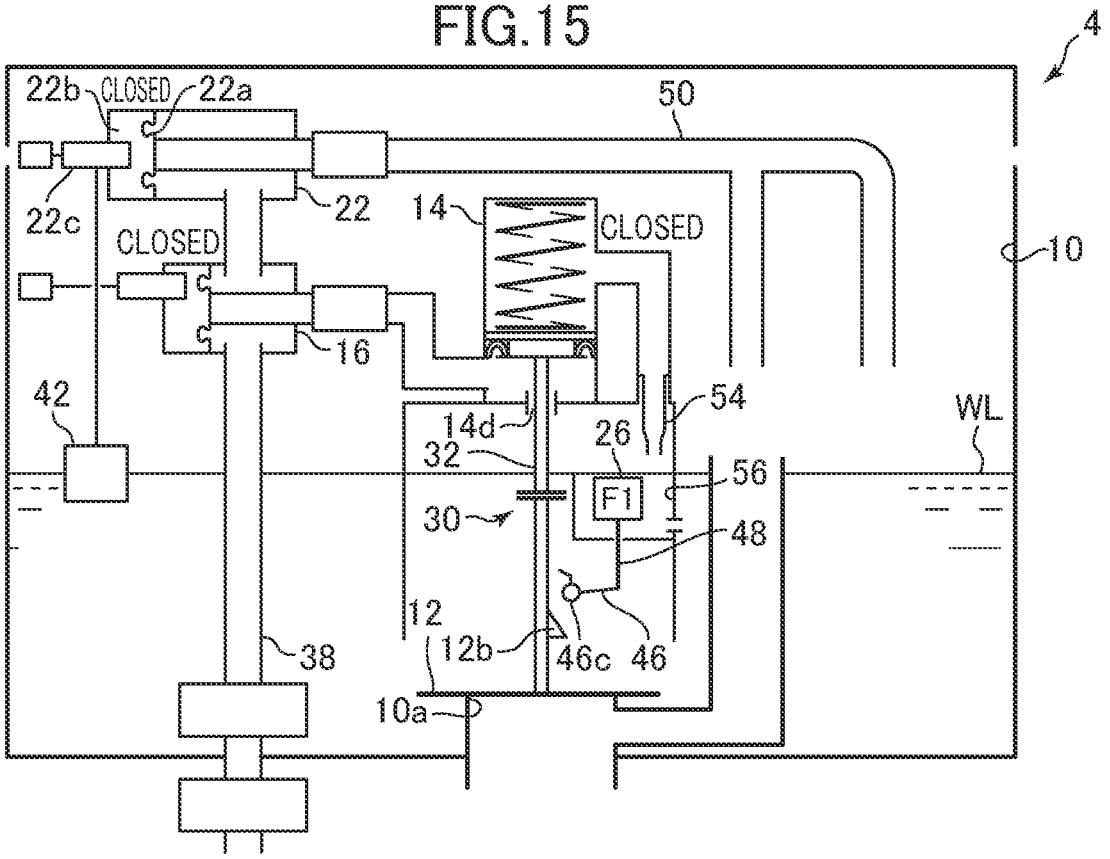
FIG. 15 is a diagram showing the operation in the small large washing mode of the flush water tank apparatus according to the first embodiment of the present invention.

When the water level in the storage tank 10 rises to the full water level WL as shown in FIG. 15, the float switch 42 is turned on. When the float switch 42 is turned on, the pilot valve 22*c* on the float switch side is closed. Since the pilot valve 22*c* enters the closed state thereby, the pressure in the pressure chamber 22*b* rises, the main valve body 22*a* of the second control valve 22 is closed, and water supply is stopped. Because the water level in the storage tank 10 rises to the predetermined full water level WL, flush water flows into the water storage portion 56, the float 26 and the transmission portion 48 are raised, and the holding mechanism 46 is returned to the holding state.

After the first control valve 16 is closed and supply of water to the discharge valve hydraulic drive unit 14 is stopped, as shown in FIG. 13, the flush water in the cylinder 14*a* of the discharge valve hydraulic drive unit 14 gradually flows out from the gap 14*d*, and the piston 14*b* is pushed down by the energizing force from the spring 14*c*, and the rod 32 is thus lowered, as shown in FIGS. 14 and 15. Thereby, the clutch mechanism 30 is connected (FIG. 3E to FIG. 3H), and the standby state before starting toilet washing is returned to.

According to the flush water tank apparatus 4 according to the first embodiment of the present invention described above, since the discharge valve 12 and the discharge valve hydraulic drive unit 14 are coupled by the clutch mechanism 30 and disconnected at the predetermined timing, it becomes possible to cause the discharge valve 12 to move regardless of the operation speed of the discharge valve hydraulic drive unit 14 and cause the discharge valve 12 to be closed. Accordingly, even if there is fluctuation in the operation speed of the discharge valve hydraulic drive unit at the time of lowering of the discharge valve, the timing of closing the discharge valve may be controlled without being affected by the fluctuation. Furthermore, in a case where the first amount of flush water is selected by the remote controller 6, the valve controller causes the holding mechanism 46 to be engaged with the discharge valve 12, and causes the holding mechanism 46 to operate such that engagement between the holding mechanism 46 and the discharge valve 12 is released after a lapse of the first period of time, and in a case where the second amount of flush water is selected by the remote controller 6, the valve controller causes the holding mechanism 46 to be engaged with the discharge valve 12, and causes the holding mechanism 46 to operate such that engagement between the holding mechanism 46 and the discharge valve 12 is released after a lapse of the second period of time shorter than the first period of time. In this manner, in a case where the second amount of flush water is selected by the remote controller 6, the valve controller may cause the holding mechanism 46 to operate in such a way that the timing when the drain port 10*a* is closed is earlier than a timing in a case where the first amount of flush water is selected. Therefore, according to an embodiment of the present invention, it is possible to set the first or second amount of flush water using the clutch mechanism 30.

Furthermore, with the flush water tank apparatus 4 according to the first embodiment of the present invention, the controller 40 is provided to control the first control valve 16, and the valve controller is operated by the flush water that is supplied from the first control valve 16. Therefore, the discharge valve 12 may be lowered according to a predetermined period of time having passed and the first or the second amount of flush water may be set by a relatively compact and simple configuration by using the clutch mechanism 30.

Furthermore, with the flush water tank apparatus 4 according to the first embodiment of the present invention, supply of the flush water from the first control valve 16 to the valve controller is started after the discharge valve 12 is raised by the discharge valve hydraulic drive unit 14. Therefore, the discharge valve 12 may be lowered after a lapse of a predetermined period of time and the first or the second amount of flush water may be set by a relatively compact and simple configuration by using the clutch mechanism 30, without obstructing an operation of the discharge valve hydraulic drive unit 14 for raising the discharge valve 12 with the flush water.

Furthermore, with the flush water tank apparatus 4 according to the first embodiment of the present invention, the first control valve 16 is provided to also control supply of the flush water to the discharge valve hydraulic drive unit 14, and thus, the discharge valve 12 may be lowered after a lapse of a predetermined period of time and the first or the second amount of flush water may be set by a relatively compact and simple configuration by using the clutch mechanism 30.

Furthermore, with the flush water tank apparatus 4 according to the first embodiment of the present invention, the first control valve 16 supplies the flush water to the valve controller via the discharge valve hydraulic drive unit 14. Accordingly, occurrence of relatively useless flush water that does not contribute to operation of either of the discharge valve hydraulic drive unit 14 and the valve controller, in the flush water that is supplied from the first control valve 16, may be suppressed by a relatively compact and simple configuration, and the flush water may be effectively used by the discharge valve hydraulic drive unit 14 and the valve controller.

Furthermore, with the flush water tank apparatus 4 according to the first embodiment of the present invention, in a case where the flush water is stored in the water storage portion 56 and the float 26 is raised, the holding mechanism 46 places the engaging member 46*c* at a position allowing engagement with the discharge valve 12, and in a case where the float 26 is lowered, the holding mechanism 46 moves the engaging member 46*c* to a position where engagement with the discharge valve 12 is released. By using the water storage portion 56 and the float 26 that is provided inside the water storage portion 56 in the above manner, an effect of fluctuation in a flow rate or the like of the flush water supplied to the water storage portion 56 may be suppressed, and relatively stable operation of the holding mechanism 46 may be achieved by a relatively simple configuration. Therefore, according to an embodiment of the present invention, the first or the second amount of flush water may be relatively stably set while using a configuration of the clutch mechanism 30.

Furthermore, with the flush water tank apparatus 4 according to the first embodiment of the present invention, supply of the flush water from the first control valve 16 to the valve controller is started after the clutch mechanism 30 is disconnected. Accordingly, the discharge valve 12 may be lowered according to a predetermined period of time having passed and the first or the second amount of flush water may be set by a relatively compact and simple configuration while using a configuration of the clutch mechanism 30, without obstructing an operation of the discharge valve hydraulic drive unit 14 for raising the discharge valve 12 with the flush water.

Moreover, a flush toilet apparatus including a plurality of flush modes with different amounts of flush water according to the first embodiment of the present invention, includes a flush toilet, and the flush water tank apparatus of the present invention supplying flush water to the flush toilet.

Further, according to the flush water tank apparatus 4 according to the first embodiment of the present invention described above, since the discharge valve 12 and the discharge valve hydraulic drive unit 14 are coupled by the clutch mechanism 30 and disconnected at the predetermined timing, regardless of the operation speed of the discharge valve hydraulic drive unit 14, it becomes possible to cause the discharge valve 12 to move and cause the discharge valve 12 to be closed. Thereby it becomes possible to, even if the operation speed of the discharge valve hydraulic drive unit varies at the time of causing the discharge valve to descend, control the timing of closing the discharge valve without being influenced by the variation. Furthermore, in a case where the second amount of flush water is selected by the remote controller 6, the flush water is supplied into the water storage portion 56 through the discharge portion 54, and the timing control mechanism is operated according to vertical movement of the float 26. The timing control mechanism lowers the discharge valve 12 such that a timing when the drain port 10*a* is closed is earlier in a case where the second amount of flush water is selected than a timing in a case where the first amount of flush water is selected. Therefore, the first or the second amount of flush water may be set while using a configuration of the clutch mechanism 30.

Furthermore, with the flush water tank apparatus 4 according to the first embodiment of the present invention, an amount of flush water that is smaller than an amount of flush water for driving the piston 14*b* of the discharge valve hydraulic drive unit 14 is stored between the water storage portion 56 and the float 26, and the float 26 is thereby vertically moved, and the timing control mechanism may be operated with a relatively small amount of flush water at a relatively early timing.

Furthermore, with the flush water tank apparatus 4 according to the first embodiment of the present invention, the discharge portion 54 forms the discharge port directing downward, and thus, the discharge portion 54 may easily supply the flush water to a lower part between the water storage portion 56 and the float 26, and the float 26 may be vertically moved with a relatively small amount of flush water at a relatively early timing and the timing control mechanism may be operated.

Furthermore, with the flush water tank apparatus 4 according to the first embodiment of the present invention, at least a part of the water storage portion 56 is positioned below the stopped water level in the storage tank 10, and thus, buoyancy of flush water at or below the stopped water level in the storage tank 10 may be applied to the float 26 in a state where the flush water is stored in the storage tank 10 up to the stopped water level, and by supply of a smaller amount of flush water to the water storage portion 56 and the timing control mechanism may be operated.

Furthermore, according to the flush water tank apparatus 4 according to the first embodiment of the present invention, since the discharge hole 56*b* for discharging stored flush water is formed in the water storage portion 56, the water storage portion 56 is capable of both of storing flush water and causing the flush water to be discharged by a relatively simple configuration.

Furthermore, with the flush water tank apparatus 4 according to the first embodiment of the present invention, an appliance that is provided on the discharge valve 12 side, such as the timing control mechanism, may be suppressed from operating erroneously due to being affected by a flow of the flush water drained through the discharge hole 56*b*.

Furthermore, with the flush water tank apparatus 4 according to the first embodiment of the present invention, because the instantaneous flow rate of the flush water that is drained through the discharge hole 56*b* is smaller than the instantaneous flow rate of the flush water that is discharged through the discharge portion 54, the flush water may be efficiently stored in the water storage portion 56, and the timing control mechanism may be operated by supply of a smaller amount of flush water to the water storage portion 56.

Furthermore, with the flush water tank apparatus 4 according to the first embodiment of the present invention, the timing control mechanism may stably operate with a relatively simple mechanical structure, and the discharge valve 12 may be lowered such that the timing when the drain port 10*a* is closed is earlier in a case where the second amount of flush water is selected than a timing in a case where the first amount of flush water is selected.

Next, a flush water tank apparatus 104 according to a second embodiment of the present invention will be described with reference to FIGS. 16 to 24.

In the present embodiment, same parts as those of the flush water tank apparatus 4 according to the first embodiment of the present invention described above will be denoted by the same reference numerals or signs, and a description thereof will be omitted.

Next, a flush toilet apparatus according to the second embodiment of the present invention will be described with reference to the appended drawings.

Figure 16:
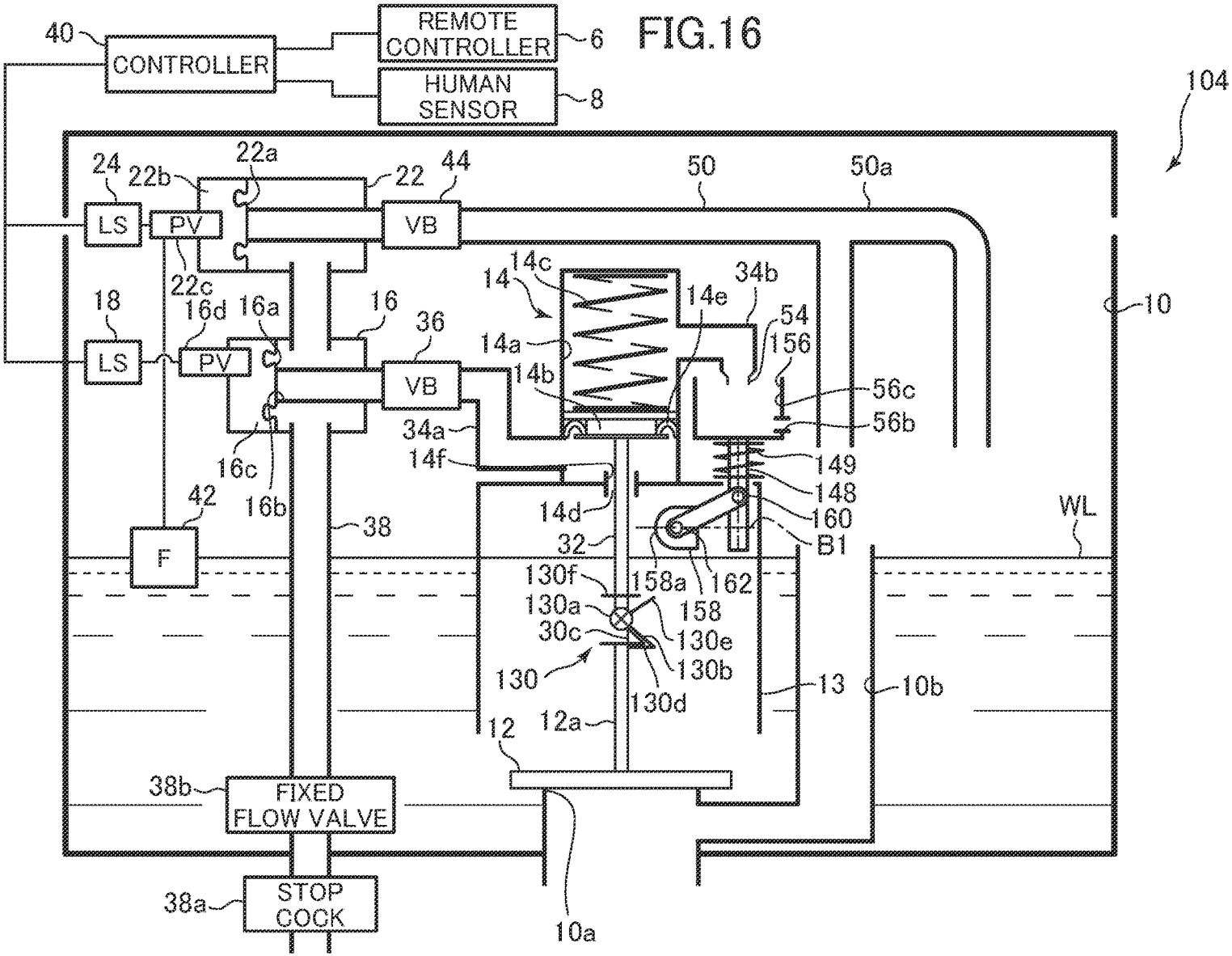
FIG. 16 is a sectional view showing a schematic configuration of a flush water tank apparatus according to a second embodiment of the present invention.

FIG. 16 is a cross-sectional diagram showing a schematic configuration of the flush water tank apparatus according to the second embodiment of the present invention.

As in the first embodiment of the present invention, the flush water tank apparatus 104 according to the second embodiment of the present invention as shown in FIG. 16 is provided on the flush toilet apparatus 1 (see FIG. 1).

The flush water tank apparatus 104 includes a clutch mechanism 130 for lowering the discharge valve 12 by being disconnected, and the clutch mechanism 130 couples the discharge valve 12 and the discharge valve hydraulic drive unit 14 to each other to pull up the discharge valve 12 by a driving force of the discharge valve hydraulic drive unit 14. The casing 13 is connected and fixed to the discharge valve hydraulic drive unit 14.

The discharge valve 12 is pulled up by the driving force of the discharge valve hydraulic drive unit 14, and is lowered due to its own weight when the clutch mechanism 130 is disconnected at a predetermined height or at a predetermined timing. A time until the discharge valve 12 is lowered and the discharge valve 12 is seated on the drain port 10*a* is adjusted by controlling a predetermined period of time until the clutch mechanism 130 is disconnected.

Next, a configuration and an operation of the clutch mechanism 130 will be described with reference to FIG. 17.

Figure 17:
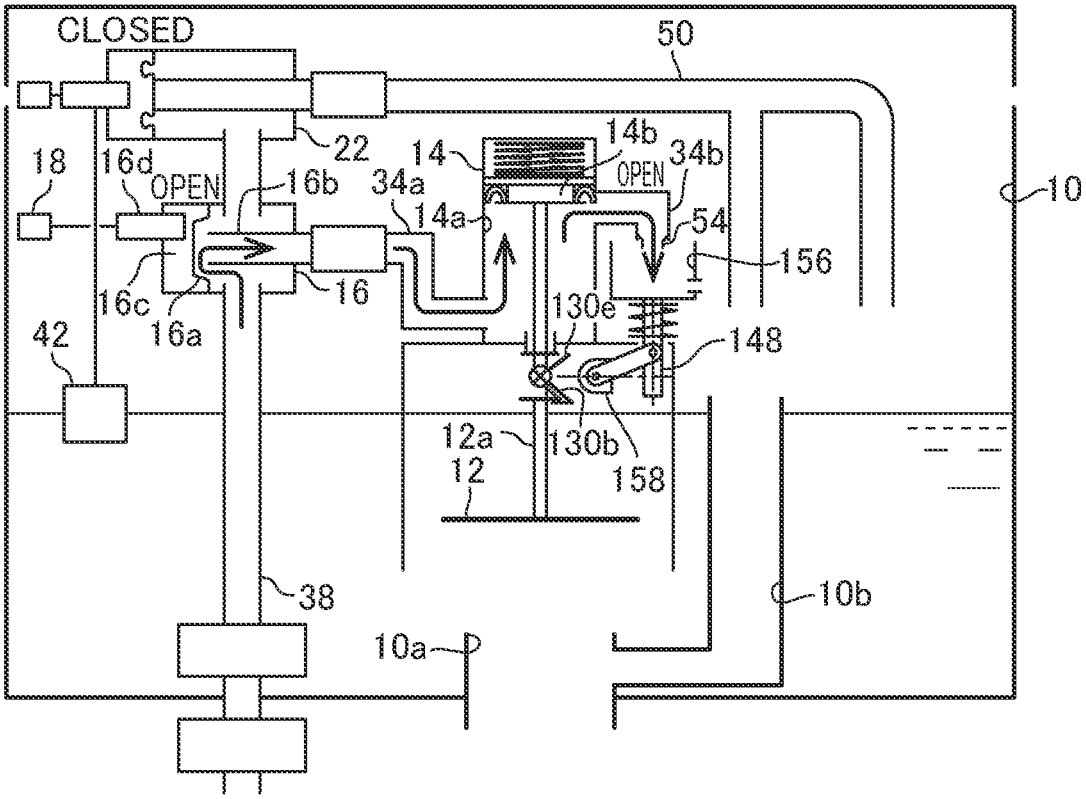
FIG. 17 is a diagram showing operation in the large washing mode of the flush water tank apparatus according to the second embodiment of the present invention.

FIG. 17 schematically shows a configuration of the clutch mechanism 130, and also shows an operation at the time of pulling up by the discharge valve hydraulic drive unit 14. The configuration and the operation of the clutch mechanism 130 in the second embodiment are partially similar to the configuration and the operation of the clutch mechanism 30 in the first embodiment, and in the following, differences will be mainly described while omitting description of same part.

First, as shown in FIG. 16, the clutch mechanism 130 is provided at a lower end of the rod 32 extending downward from the discharge valve hydraulic drive unit 14 to couple/uncouple the lower end of the rod 32 and the upper end of the valve stem 12*a* of the discharge valve 12. The clutch mechanism 130 includes a rotary shaft 130*a* attached to the lower end of the rod 32, a hook member 130*b* supported by the rotary shaft 130*a*, the engaging claw 30*c* provided at the upper end of the valve stem 12*a*, and a stop plate 130*f* defining an upper limit of a pull-up height of the clutch mechanism 130. According to such a configuration, the clutch mechanism 130 is disconnected at a predetermined timing and at a predetermined pull-up height to lower the discharge valve 12.

The rotary shaft 130*a* is attached to the lower end of the rod 32, in the horizontal direction, to rotatably support the hook member 130*b*. The hook member 130*b* is a plate-shaped member, and an intermediate part thereof is rotatably supported by the rotary shaft 130*a*. Furthermore, a lower end of the hook member 130*b* is bent in a hook shape to form a hook portion 130*d*. The hook member 130*b* is formed extending upward and downward in a V-shape from the rotary shaft 130*a*. Of the hook member 130*b*, an upper portion extending upward from the rotary shaft 130*a* forms an upper end portion of the hook member 130*b*, and an upper end portion 130*e* of the hook member 130*b* is formed at such a position and with such a length that the upper end portion 130*e* does not abut against the bottom surface of the discharge valve hydraulic drive unit 14 even in a state where the piston 14*b* is raised to the highest position. Of the hook member 130*b*, a lower portion extending downward from the rotary shaft 130*a* forms the hook portion 130*d* of the hook member 130*b* that is bent toward the valve stem 12*a* after extending obliquely downward as a lower portion of the V-shape. The engaging claw 30*c* provided at the upper end of the valve stem 12*a* of the discharge valve 12 is a plate-shaped claw. A bottom side of the engaging claw 30*c* is formed to be approximately horizontal. The stop plate 130*f* is formed to abut against the bottom surface of the discharge valve hydraulic drive unit 14 before the upper end portion 130*e* of the hook member 130*b* in a connected state comes into contact with the bottom surface of the discharge valve hydraulic drive unit 14, and the stop plate 130*f* thus stops pull-up.

In the state shown in FIG. 16, the discharge valve 12 is seated on the drain port 10*a*, and the drain port 10*a* is closed. Furthermore, in this state, the discharge valve hydraulic drive unit 14 and the discharge valve 12 are coupled to each other, and in this coupled state, the hook portion 130*d* of the hook member 130*b* is engaged with the bottom side of the engaging claw 30*c* and the discharge valve 12 can be pulled up by the rod 32.

Referring back to FIG. 16, a water storage portion and the like of the flush water tank apparatus 104 will be described.

The flush water tank apparatus 104 further includes the discharge portion 54 for discharging flush water that is supplied, a water storage portion 156 for storing the flush water that is discharged through the discharge portion 54, a transmission portion 148 that is coupled to the water storage portion 156, and an acting portion 158 that is coupled to the transmission portion 148 to be horizontally moved.

The discharge valve hydraulic drive unit 14, the discharge portion 54, the water storage portion 156, the transmission portion 148, and the acting portion 158 function, as a whole or in part, as the valve controller. The valve controller is formed to be able to disconnect the clutch mechanism 130 at a predetermined timing. The flush water tank apparatus 104 includes such a valve controller. In a case where the first amount of flush water is selected by the remote controller 6 or the like, the valve controller is operated to disconnect the clutch mechanism 130 after a lapse of the first period of time, and thus lowers the discharge valve 12 after a lapse of the first period of time. Furthermore, in a case where the second amount of flush water is selected by the remote controller 6 or the like, the valve controller is operated to disconnect the clutch mechanism 130 after a lapse of the second period of time shorter than the first period of time, and thus lowers the discharge valve 12 after a lapse of the second period of time. In this manner, the valve controller is formed to be operated with the flush water that is supplied.

In a case where the second amount of flush water is selected by the remote controller 6, the discharge portion 54 discharges the flush water that is supplied. Furthermore, the discharge portion 54 is provided to discharge the flush water also in a case where the first amount of flush water is selected by the remote controller 6. The discharge portion 54 is formed at the lower end of the drive unit discharge passage 34*b* and extends downward. The discharge portion 54 is provided above the upper surface of the casing 13. The discharge portion 54 is disposed outside the casing 13, above the full water level WL. The discharge portion 54 forms a discharge port that is tapered and that directs downward. Accordingly, flush water is accelerated downward by gravity and a flow rate is further increased at the discharge port due to the narrowed flow channel. The discharge portion 54 is disposed more inward than a side wall of the water storage portion 156, above the full water level WL.

In a standby state before start of flushing, at least a part of the water storage portion 156 is positioned above the stopped water level (the full water level WL) in the storage tank 10. More desirably in the standby state before start of flushing, the water storage portion 156 is positioned above the stopped water level (the full water level WL) in the storage tank 10. The water storage portion 156 is formed as a hollow box, and an upper surface thereof is open. The water storage portion 156 is disposed above the casing 13. The water storage portion 156 is disposed below the discharge portion 54, and is formed to receive flush water that is discharged through the discharge portion 54. A volume of flush water that can be stored in the water storage portion 156 is smaller than the volume of the cylinder 14*a*. The discharge hole 56*b* through which stored flush water is drained is formed in the water storage portion 156. The discharge hole 56*b* is formed at a lower part of a side wall 56*c* of the water storage portion 156, and is formed as an opening that directs toward an opposite direction from the valve stem 12*a* of the discharge valve 12 in a plan view. The discharge hole 56*b* is formed as a small hole with a relatively small diameter. Accordingly, the instantaneous flow rate A1 (see FIG. 7) of flush water that is drained through the discharge hole 56*b* to outside the water storage portion 156 (inside the storage tank 10) is smaller than the instantaneous flow rate A2 (see FIG. 7) of flush water that is discharged through the discharge portion 54.

The transmission portion 148 forms a rod-shaped member that extends downward in the vertical direction from a lower surface of the water storage portion 156. The transmission portion 148 is fixed to the lower surface of the water storage portion 156. The transmission portion 148 penetrates a top surface of the casing 13 to extend inside the casing 13. The transmission portion 148 is not fixed to the casing 13, and is slidably disposed relative to the casing 13. A spring 149 is disposed outside the transmission portion 148, the spring 149 being fixed to the water storage portion 156 and the casing 13. Accordingly when a weight of the water storage portion 156 is reduced after the water storage portion 156 and the transmission portion 148 are lowered, the water storage portion 156 and the transmission portion 148 are raised again by the spring 149 to return to a standby position. The transmission portion 148 is coupled to the acting portion 158 via a transmission-portion-side rotary shaft 160 that is capable of rotating. The transmission-portion-side rotary shaft 160 rotatably supports the acting portion 158 and the transmission portion 148. The transmission-portion-side rotary shaft 160 is a shaft that extends in a direction orthogonal to the surface of FIG. 16. The acting portion 158 further includes a distal-end-side rotary shaft 162 that enables a distal end side to rotate. The distal-end-side rotary shaft 162 rotatably supports a distal-end-side portion and a transmission-portion-side portion of the acting portion 158. The distal-end-side rotary shaft 162 is also a shaft that extends in the direction orthogonal to the surface of FIG. 16. The distal-end-side rotary shaft 162 is positioned on a virtual line B1, and is attached to the casing 13 in such a way as to move along the virtual line B1. The virtual line B1 approximately coincides with a height of the rotary shaft 130*a* in a state where the discharge valve 12 is pulled up the most. Accordingly, the transmission portion 148 vertically moves according to vertical movement of the float 26 to cause the acting portion 158 to be pushed out or pulled in in a horizontal direction.

The acting portion 158 is formed to be capable of moving in a left-right direction at a predetermined height below the bottom surface of the discharge valve hydraulic drive unit 14. When the transmission portion 148 is lowered, the acting portion 158 horizontally moves forward toward the valve stem 12*a*. A distal end portion 158*a* of the acting portion 158 is positioned in a space between the hook member 130*b* that is open in the V-shape, in a state where the acting portion 158 is moved forward and the hook member 130*b* is pulled up the most (see FIG. 18). Furthermore, when the transmission portion 148 is raised, the acting portion 158 horizontally moves to retract in a direction away from the valve stem 12*a*. The distal end portion 158*a* of the acting portion 158 is formed as a relatively large protruding portion with a semicircular cross-section. Together with operation of the transmission portion 148, the water storage portion 156 and the like, the acting portion 158 controls the timing of lowering the discharge valve 12 such that the timing when the drain port 10*a* is closed is earlier in a case where the second amount of flush water is selected than a timing in a case where the first amount of flush water is selected.

In a state where the water storage portion 156 and the transmission portion 148 are lowered, the acting portion 158 extends closer to the valve stem 12*a* than the upper end portion 130*e* of the hook member 130*b* does. The hook member 130*b* is not operated just by the acting portion 158 being moved to the space between the hook member 130*b* that is open in the V-shape. When supply of flush water to the discharge valve hydraulic drive unit 14 is stopped and the piston 14*b* is moved downward, the upper end portion 130*e* of the hook member 130*b* comes into contact with the acting portion 158, and the hook member 130*b* is rotated to disconnect the clutch mechanism 130.

Next, the flush water tank apparatus 104 according to the second embodiment of the present invention, and an operation of the flush toilet apparatus 1 provided with the flush water tank apparatus 104 will be described with reference to FIGS. 16 to 22.

First, in a standby state for toilet flushing shown in FIG. 16, the water level in the storage tank 10 is at the predetermined full water level WL, and in this state, the first control valve 16 and the second control valve 22 are both closed. Flush water is not stored in the water storage portion 156, and the water storage portion 156 and the transmission portion 148 are energized to an upper position by the spring 149. The acting portion 158 is pulled by the transmission portion 148, and is placed at a position retracted from the valve stem 12*a*. Next, when a user pushes the large washing button of the remote controller 6 (FIG. 1), the remote controller 6 transmits an instruction signal for performing the large washing mode to the controller 40 (FIG. 16).

Furthermore, when the small washing button is pushed, an instruction signal for performing the small washing mode is transmitted to the controller 40.

Next, operation in the large washing mode will be described with reference to FIGS. 16 to 22.

When the instruction signal to perform large washing is received, the controller 40 causes the solenoid valve 18 (FIG. 16) provided at the first control valve 16 to operate, and causes the pilot valve 16*d* on the solenoid valve side to separate from the pilot valve port. The pressure in the pressure chamber 16*c* is thus reduced, and the main valve body 16*a* is separated from the main valve port 16*b* and the main valve port 16*b* is opened. As shown in FIG. 17, when the first control valve 16 is opened, flush water flowing in from the water supply pipe 38 is supplied to the discharge valve hydraulic drive unit 14 via the first control valve 16. The piston 14*b* of the discharge valve hydraulic drive unit 14 is thereby pushed up and the discharge valve 12 is pulled up via the rod 32, and flush water in the storage tank 10 is drained through the drain port 10*a* into the flush toilet main body 2. At this time, the pilot valve 16*d* is maintained in the open state, and flush water flowing in from the water supply pipe 38 keeps being supplied to the discharge valve hydraulic drive unit 14 via the first control valve 16. The piston 14*b* is raised to the second position (a most pushed-up state), and the drive unit water supply passage 34*a* and the drive unit discharge passage 34*b* are caused to communicate with each other through the inside of the cylinder 14*a*, and thus, flush water is discharged through the discharge portion 54 to the water storage portion 156. Accordingly, supply of flush water from the first control valve 16 to the water storage portion 156 is started after the discharge valve 12 is raised by the discharge valve hydraulic drive unit 14. Even in a state where the discharge valve 12 is raised and the stop plate 130*f* is abutted against the bottom surface of the discharge valve hydraulic drive unit 14, the upper end portion 130*e* of the hook member 130*b* of the clutch mechanism 130 does no abut against the bottom surface of the discharge valve hydraulic drive unit 14. Accordingly, the clutch mechanism 130 stays connected. The discharge valve 12 is thus held in a pulled-up state. When supply of flush water to the water storage portion 156 is started, and the water storage portion 156 and the transmission portion 148 are gradually lowered, the acting portion 158 starts to move toward the valve stem 12*a*. Additionally, the controller 40 keeps the second control valve 22 closed.

Figure 18:
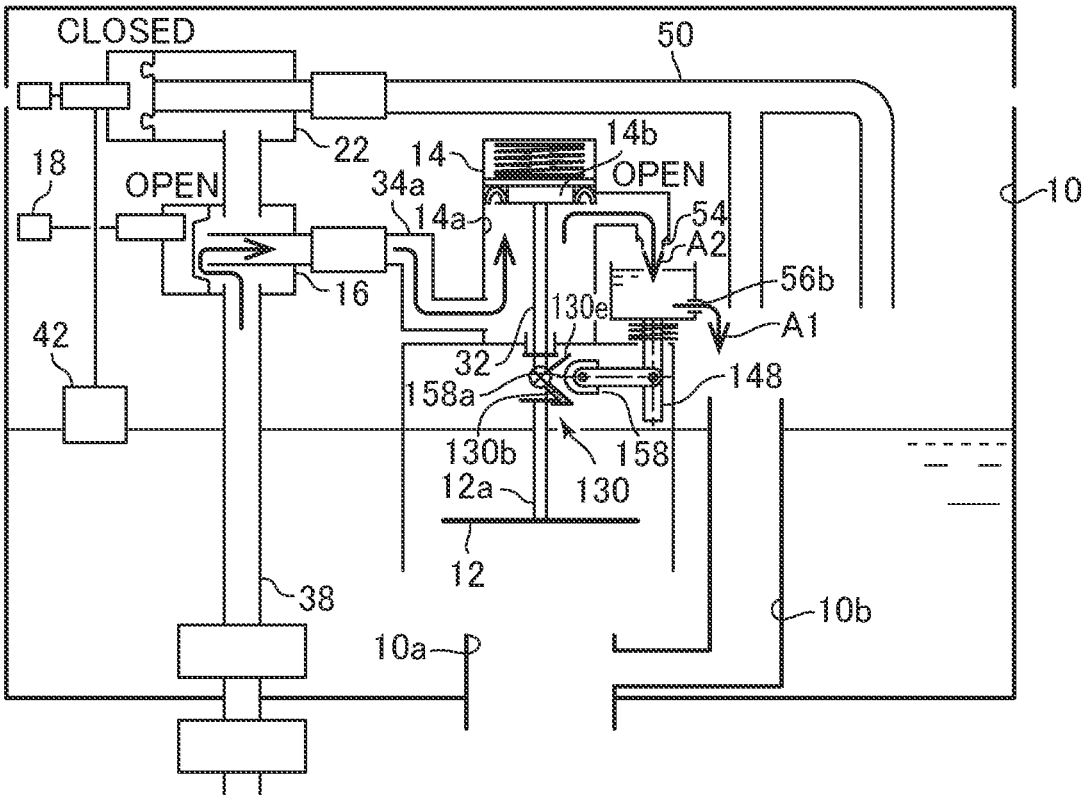
FIG. 18 is a diagram showing the operation in the large washing mode of the flush water tank apparatus according to the second embodiment of the present invention.

As shown in FIG. 18, flush water keeps being supplied to the discharge valve hydraulic drive unit 14 via the first control valve 16. The piston 14*b* of the discharge valve hydraulic drive unit 14 is in a state where it is pushed up the most, and the rod 32 and the clutch mechanism 130 are also in a state where they are pulled up the most. Because the piston 14*b* is at the second position (the most pushed-up state), flush water is supplied from the discharge valve hydraulic drive unit 14 to the discharge portion 54. Because the instantaneous flow rate A1 of flush water that is drained through the discharge hole 56*b* of the water storage portion 156 is smaller than the instantaneous flow rate A2 of flush water that is discharged through the discharge portion 54, the water level of the flush water in the water storage portion 156 is gradually increased. When the water level of the flush water in the water storage portion 156 is approximately at the full water level in the water storage portion 156, the water storage portion 156 and the transmission portion 148 are lowered due to the weight of the flush water. When the transmission portion 148 is lowered, the acting portion 158 is moved to further protrude in the horizontal direction. The distal end portion 158*a* of the acting portion 158 is positioned in the space between the hook member 130*b* that is kept still in a state where it is pulled up the most. The upper end portion 130*e* of the hook member 130*b* is positioned above the distal end portion 158*a* while being separated from the distal end portion 158*a*. Accordingly, the clutch mechanism 130 is not yet disconnected, and is kept in the holding state.

Figure 19:
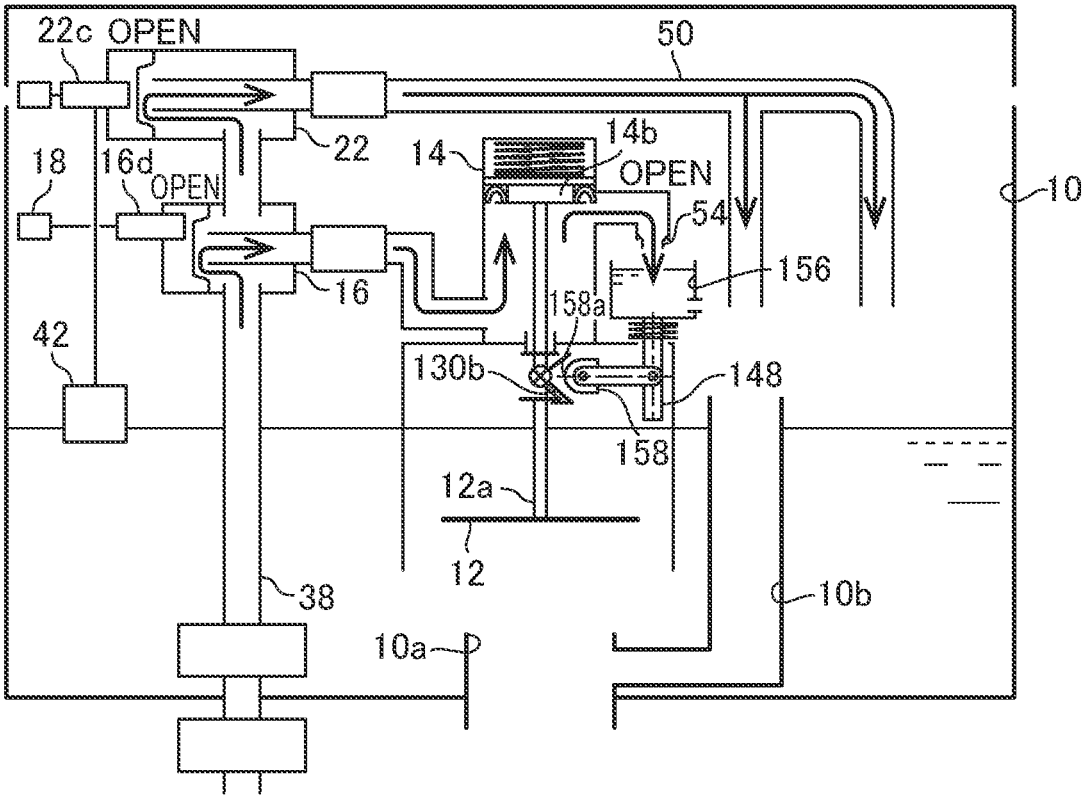
FIG. 19 is a diagram showing the operation in the large washing mode of the flush water tank apparatus according to the second embodiment of the present invention.

Next, as shown in FIG. 19, when the water level in the storage tank 10 drops, the float switch 42 detecting the water level in the storage tank 10 is switched off. When the float switch 42 is turned off, the pilot valve 22*c* provided for the second control valve 22 is opened. Thereby, flush water is supplied from the second control valve 22 into the storage tank 10 via the water supply passage 50. When the pilot valve 22*c* is opened, if the large washing mode is selected, the controller 40 keeps the pilot valve 16*d* on the solenoid valve 18 side open. Flush water flowing in from the water supply pipe 38 keeps being discharged into the water storage portion 156 via the first control valve 16 and the discharge valve hydraulic drive unit 14 and through the discharge portion 54. Accordingly, the amount of flush water inside the water storage portion 156 is not reduced, and an approximately full water level is maintained in the water storage portion 156. The water storage portion 156 and the transmission portion 148 are thus in a lowered state, and the distal end portion 158*a* of the acting portion 158 is positioned in the space between the hook member 130*b*.

Figure 20:
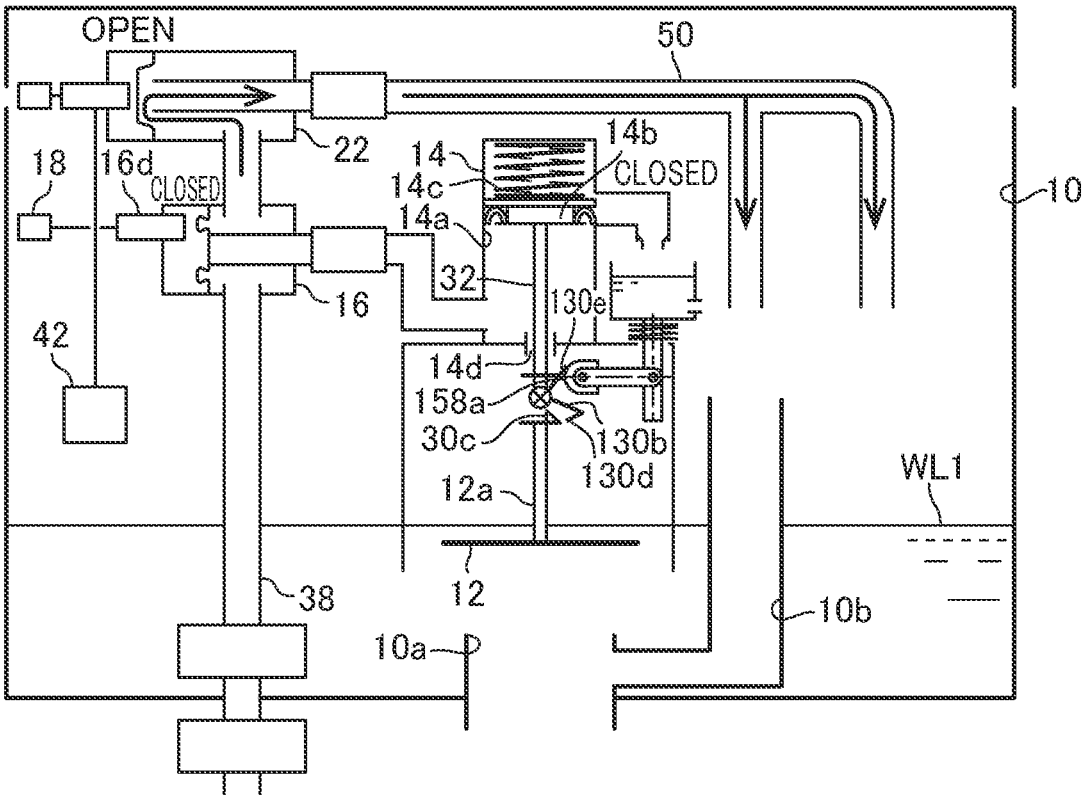
FIG. 20 is a diagram showing the operation in the large washing mode of the flush water tank apparatus according to the second embodiment of the present invention.

Next, as shown in FIG. 20, in a case where the large washing mode is selected, the controller 40 closes the solenoid valve 18 and closes the first control valve 16 after a lapse of the first period of time from when the solenoid valve 18 is opened (when flushing is started). The timing when the controller 40 closes the solenoid valve 18 (when the first period of time elapses) is set taking into account a timing of starting lowering of the piston 14*b* and disconnecting the clutch mechanism 130 in such a way that the discharge valve 12 is seated on the drain port 10*a* to block the drain port 10*a* when the water level in the storage tank 10 drops to the predetermined water level WL1, as described below. Because the first control valve 16 is closed, supply of the flush water to the discharge valve hydraulic drive unit 14 and the discharge portion 54 is stopped. At a time immediately after supply of the flush water is stopped, flush water is stored in the water storage portion 156 almost up to full in the water storage portion 156, and the water storage portion 156 is lowered by the weight of the flush water. Accordingly, the distal end portion 158*a* of the acting portion 158 is positioned in the space between the hook member 130*b* and is stopped.

Furthermore, because supply of flush water to the discharge valve hydraulic drive unit 14 is stopped, the flush water in the cylinder 14*a* gradually flows out from the gap 14*d*, and the piston 14*b* is pushed down by the energizing force from the spring 14*c*, and the rod 32 is thus lowered. Accordingly the upper end portion 130*e* of the hook member 130*b* abuts against the distal end portion 158*a*, and the upper end portion 130*e* is rotated counterclockwise around the rotary shaft 130*a*. This rotation causes the lower portion of the hook member 130*b* and the hook portion 130*d* to rotate and to be raised. Engagement between the hook portion 130*d* and the engaging claw 30*c* is thus released. The clutch mechanism 130 is thereby disconnected, and the discharge valve 12 is lowered. Flush water that is supplied from the second control valve 22 into the storage tank 10 via the water supply passage 50 keeps being supplied.

Figure 21:
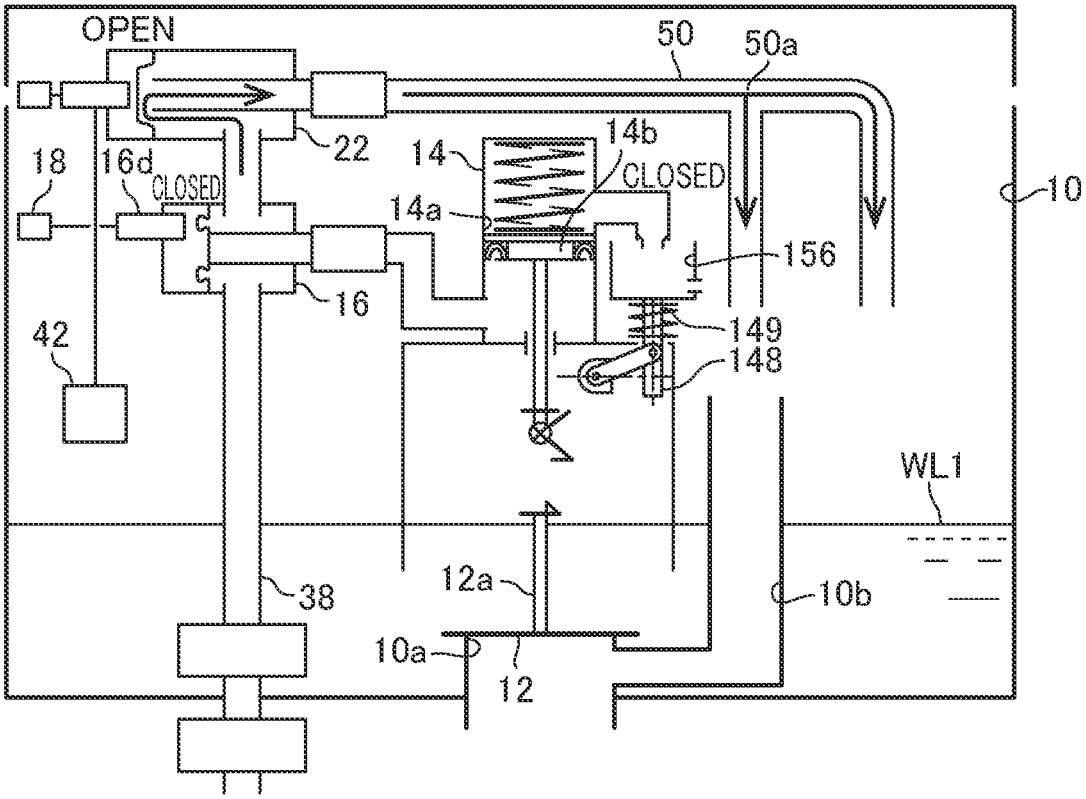
FIG. 21 is a diagram showing operation in the large washing mode of the flush water tank apparatus according to the second embodiment of the present invention.

As shown in FIG. 21, the discharge valve 12 that is lowered is seated on the drain port 10*a*, and the drain port 10*a* is closed. In this manner, in the case where the large washing mode is performed, the discharge valve 12 is held until the water level in the storage tank 10 drops from the full water level WL to the predetermined water level WL1, and the first amount of flush water is drained into the flush toilet main body 2. Then, flush water that is stored in the water storage portion 156 is gradually drained through the discharge hole 56*b*, and the water level of the flush water in the water storage portion 156 is lowered. When there is no more flush water in the water storage portion 156 or when the flush water is reduced, the water storage portion 156 and the transmission portion 148 are raised again by the spring 149 to return to the standby position. Accordingly, following the rise of the transmission portion 148, the acting portion 158 retracts in a direction away from the valve stem 12*a*. When the flush water in the cylinder 14*a* of the discharge valve hydraulic drive unit 14 flows out, the piston 14*b* is also further lowered.

Because the float switch 42 is still in the off state, the open state of the second control valve 22 is maintained, and supply of water to the storage tank 10 is continued. Flush water that is supplied via the water supply passage 50 reaches the water supply passage branch portion 50*a*, and a part of the flush water that is branched at the water supply passage branch portion 50*a* flows into the overflow pipe 10*b*, and the rest is stored in the storage tank 10. The flush water flowing into the overflow pipe 10*b* flows into the flush toilet main body 2, and is used to refill the bowl 2*a*. The water level in the storage tank 10 rises due to the flush water flowing into the storage tank 10 in a state where the discharge valve 12 is closed.

Figure 22:
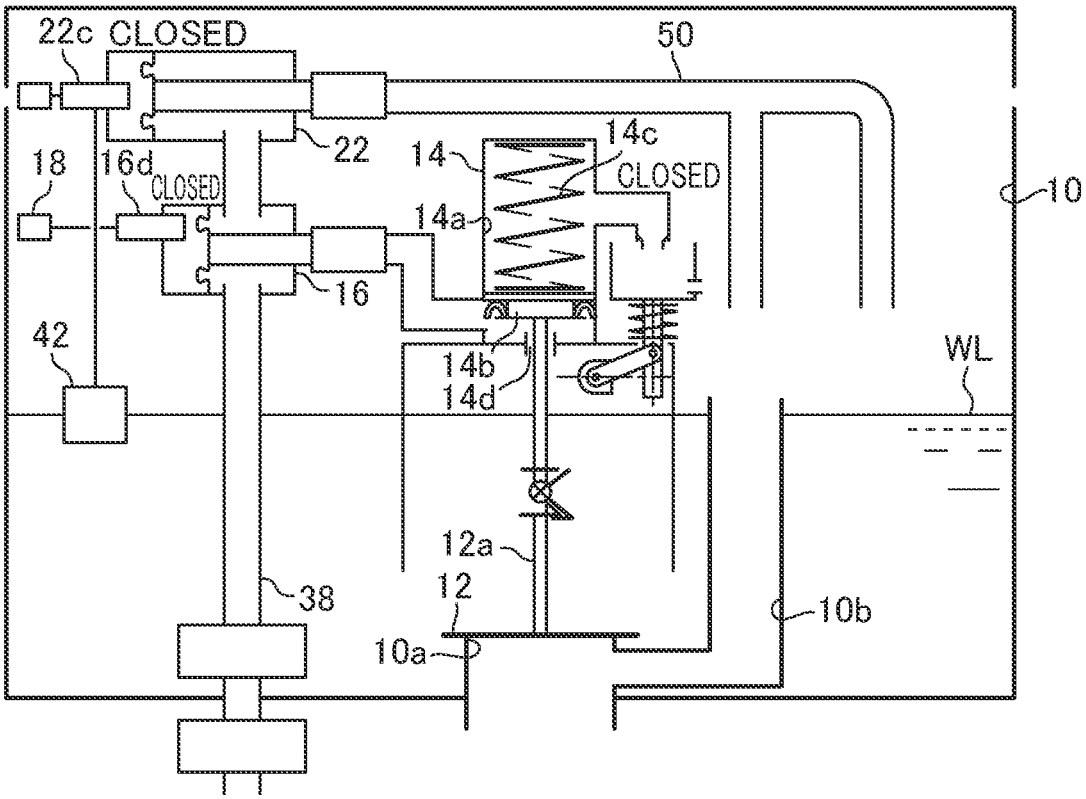
FIG. 22 is a diagram showing operation in the large washing mode of the flush water tank apparatus according to the second embodiment of the present invention.

When the water level in the storage tank 10 rises to the full water level WL as shown in FIG. 22, the float switch 42 is turned on. When the float switch 42 is turned on, the pilot valve 22*c* on the float switch side is closed. Thereby, the pilot valve 22*c* enters the closed state. Therefore, the pressure in the pressure chamber 22*b* rises, the main valve body 22*a* of the second control valve 22 is closed, and water supply is stopped.

Furthermore, the flush water in the cylinder 14*a* of the discharge valve hydraulic drive unit 14 gradually flows out from the gap 14*d*, and the piston 14*b* is pushed down by the energizing force from the spring 14*c*, and the rod 32 is thus lowered. When being lowered to the position of the engaging claw 30*c*, the hook portion 130*d* is lowered along the sloped surface of the engaging claw 30*c*, and is rotated to the original position due to gravity after climbing over the engaging claw 30*c* so as to be engaged again with the engaging claw 30*c*, and the clutch mechanism 130 is connected, and the rod 32 and the valve stem 12*a* are coupled. The standby state before toilet flushing is started is thus reached again.

Next, operation in the small washing mode will be described with reference to FIG. 16, FIGS. 17 to 19, FIG. 22, FIG. 23, and FIG. 24.

As shown in FIG. 16, the standby state for toilet flushing is the same as in the large washing mode.

When the instruction signal to perform small washing is received, the controller 40 causes the solenoid valve 18 provided at the first control valve 16 to operate, and opens the first control valve 16. Then, the operation until a state where the water storage portion 156 and the transmission portion 148 are lowered and the distal end portion 158*a* of the acting portion 158 is positioned in the space between the hook member 130*b* is reached, as shown in FIG. 16 and FIGS. 17 to 19, is the same as that in the large washing mode. Accordingly, description of the operation in the small washing mode up to this point is omitted by referring to FIG. 16, FIGS. 17 to 19, and to the description of the operation in the large washing mode.

Figure 23:
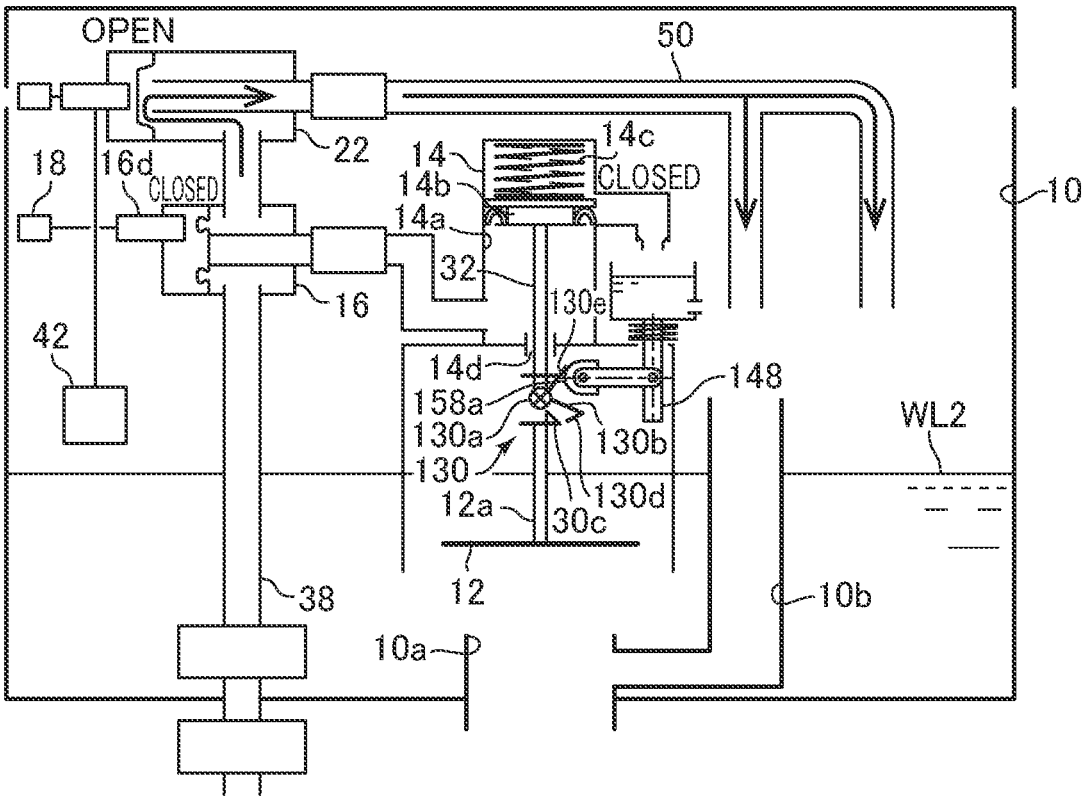
FIG. 23 is a diagram showing operation in the small washing mode of the flush water tank apparatus according to the second embodiment of the present invention.

Next, as shown in FIG. 23, in a case where the small washing mode is selected, the controller 40 closes the solenoid valve 18 and closes the first control valve 16 after a lapse of the second period of time from when the solenoid valve 18 is opened (when flushing is started). The second period of time is set as a period of time that is shorter than the first period of time. The timing when the controller 40 closes the solenoid valve 18 (when the second period of time elapses) is set taking into account a timing of starting lowering of the piston 14*b* and disconnecting the clutch mechanism 130 in such a way that the discharge valve 12 is seated on the drain port 10*a* to block the drain port 10*a* when the water level in the storage tank 10 drops to the predetermined water level WL2, as described later. Because the first control valve 16 is closed, supply of the flush water to the discharge valve hydraulic drive unit 14 and the discharge portion 54 is stopped. At a time immediately after supply of the flush water is stopped, flush water is stored in the water storage portion 156 almost up to full in the water storage portion 156, and the water storage portion 156 is lowered by the weight of the flush water. Accordingly the distal end portion 158*a* of the acting portion 158 is positioned in the space between the hook member 130*b* and is stopped.

Furthermore, because supply of flush water to the discharge valve hydraulic drive unit 14 is stopped, the flush water in the cylinder 14*a* gradually flows out from the gap 14*d*, and the piston 14*b* is pushed down by the energizing force from the spring 14*c*, and the rod 32 is thus lowered. Accordingly, the upper end portion 130*e* of the hook member 130*b* abuts against the distal end portion 158*a*, and the upper end portion 130*e* is rotated counterclockwise around the rotary shaft 130*a*. This rotation causes the lower portion of the hook member 130*b* and the hook portion 130*d* to rotate and to be raised. Engagement between the hook portion 130*d* and the engaging claw 30*c* is thus released. The clutch mechanism 130 is thereby disconnected, and the discharge valve 12 is lowered. Flush water that is supplied from the second control valve 22 into the storage tank 10 via the water supply passage 50 keeps being supplied.

Figure 24:
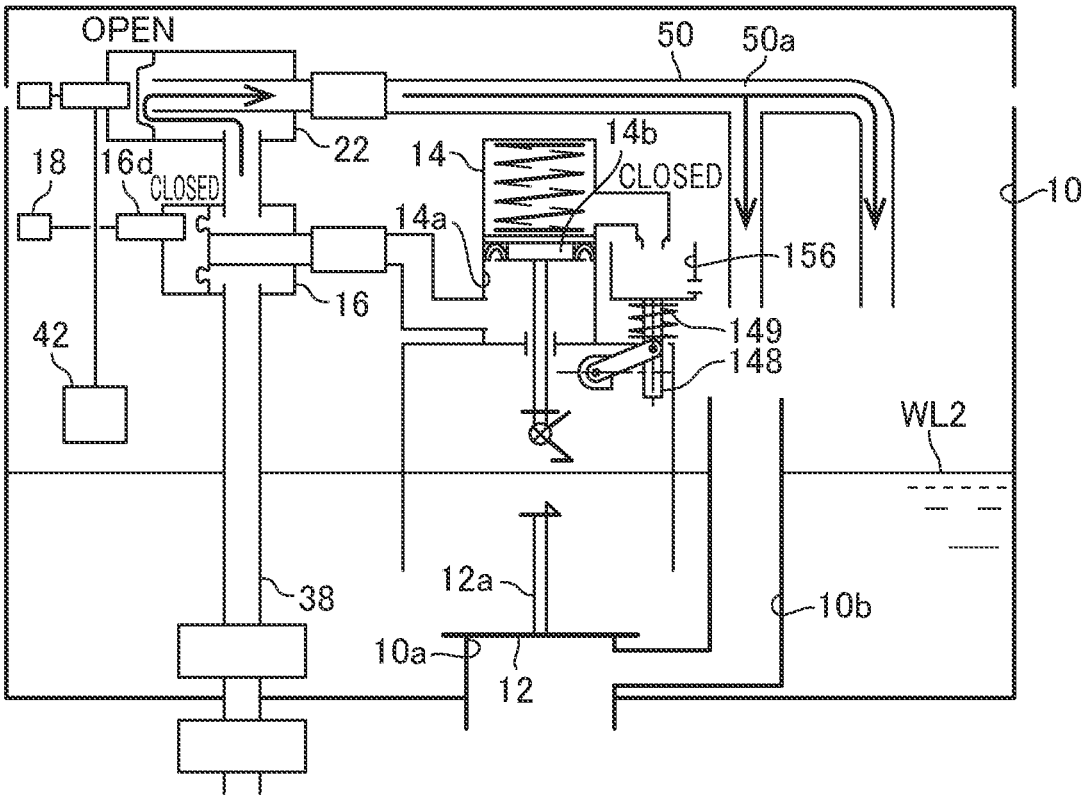
FIG. 24 is a diagram showing operation in the small washing mode of the flush water tank apparatus according to the second embodiment of the present invention.

As shown in FIG. 24, the discharge valve 12 that is lowered is seated on the drain port 10*a*, and the drain port 10*a* is closed. In this manner, in the case where the small washing mode is performed, the discharge valve 12 is held until the water level in the storage tank 10 drops from the full water level WL to the predetermined water level WL2, and the second amount of flush water smaller than the first amount of flush water is drained into the flush toilet main body 2. Then, flush water that is stored in the water storage portion 156 is gradually drained through the discharge hole 56*b*, and the water level of the flush water in the water storage portion 156 is lowered. When there is no more flush water in the water storage portion 156 or when the flush water is reduced, the water storage portion 156 and the transmission portion 148 are raised again by the spring 149 to return to the standby position. Accordingly, following the rise of the transmission portion 148, the acting portion 158 retracts in the direction away from the valve stem 12*a*. When the flush water in the cylinder 14*a* of the discharge valve hydraulic drive unit 14 flows out, the piston 14*b* is also further lowered.

Because the float switch 42 is still in the off state, the open state of the second control valve 22 is maintained, and supply of water to the storage tank 10 is continued. Flush water that is supplied via the water supply passage 50 reaches the water supply passage branch portion 50*a*, and a part of the flush water that is branched at the water supply passage branch portion 50*a* flows into the overflow pipe 10*b*, and the rest is stored in the storage tank 10. The flush water flowing into the overflow pipe 10*b* flows into the flush toilet main body 2, and is used to refill the bowl 2*a*. The water level in the storage tank 10 rises due to the flush water flowing into the storage tank 10 in a state where the discharge valve 12 is closed. Then, when the water level in the storage tank 10 rises to the predetermined full water level WL, the float switch 42 is switched on. The following operation of the flush water tank apparatus 104 and the like until the standby state is reached again is the same as the operation in the large washing mode as shown in FIG. 22, and a description thereof is omitted.

With the flush water tank apparatus 104 according to the second embodiment of the present invention as described above, the discharge valve 12 and the discharge valve hydraulic drive unit 14 are coupled to each other by the clutch mechanism 130 and are disconnected at a predetermined timing, and thus, the discharge valve 12 may be moved regardless of the operation speed of the discharge valve hydraulic drive unit 14, and the discharge valve 12 may thus be closed. Furthermore, in a case where the first amount of flush water is selected by the remote controller 6, the valve controller is operated to disconnect the clutch mechanism 130 after a lapse of the first period of time to lower the discharge valve 12 according to the first period of time having passed, and in a case where the second amount of flush water is selected by the remote controller 6, the valve controller is operated to disconnect the clutch mechanism 130 after a lapse of the second period of time shorter than the first period of time to lower the discharge valve 12 according to the second period of time having passed. In this manner, the valve controller may disconnect the clutch mechanism 130 in such a way that the timing when the drain port 10*a* is closed is earlier in a case where the second amount of flush water is selected by the remote controller 6 than a timing in a case where the first amount of flush water is selected. Therefore, according to an embodiment of the present invention, the discharge valve 12 may be lowered after a lapse of a predetermined period of time and the first or the second amount of flush water may be set using the clutch mechanism 130.

Heretofore, the first embodiment and the second embodiment of the present invention have been described, but various changes may be made in the first embodiment or the second embodiment described above. For example, in the second embodiment described above, the acting portion 158 moves toward the valve stem 12*a* when the water storage portion 156 and the transmission portion 148 are lowered, but in a modification, a rod member of a piston cylinder may move toward the valve stem 12*a* and the clutch mechanism 130 may be disconnected by the rod member at an arbitrary timing. According to such a configuration, a cylinder portion of the piston cylinder is connected to the water supply passage 50 extending from the second control valve 22, and the rod member is pressed and moved by the flush water that is supplied into the cylinder portion. The rod member is formed such that a part lower than the bottom surface of the discharge valve hydraulic drive unit 14 is moved in the horizontal direction toward the valve stem. A distal end of the rod member is formed into a T-shape, and an upper end of the T-shape is disposed near the bottom surface of the discharge valve hydraulic drive unit. The T-shaped part is formed as a flat plate extending in the vertical direction. The upper end portion 130*e* of the hook member 130*b* comes into contact with the upper end of the T-shape to disconnect the clutch mechanism 130 and lower the discharge valve 12.

In a case where the large washing mode is selected, the controller 40 opens the solenoid valve 24 and opens the second control valve 22 after a lapse of the first period of time from when the solenoid valve 18 is opened (when flushing is started). Flush water is thereby supplied from the second control valve 22 into the cylinder portion, and the rod member is horizontally moved toward the valve stem 12*a*. When the rod member comes into contact with the upper end portion 130*e* of the hook member 130*b*, the hook member is rotated, the clutch mechanism 130 is disconnected, and the discharge valve 12 is lowered. The timing when the controller 40 opens the solenoid valve (when the first period of time elapses) is set taking into account a timing of causing the rod member to abut against the hook member 130*b* and disconnecting the clutch mechanism 130 in such a way that the discharge valve 12 is seated on the drain port 10*a* to block the drain port 10*a* when the water level in the storage tank drops to the predetermined water level WL1. The discharge valve 12 may thus be lowered, and the large washing mode in which the first amount of flush water is drained may be performed.

In a case where the small washing mode is selected, the controller 40 opens the solenoid valve 24 and opens the second control valve 22 after a lapse of the second period of time shorter than the first period of time from when the solenoid valve 18 is opened (when flushing is started). Flush water is thereby supplied from the second control valve 22 into the cylinder portion, and the rod member is horizontally moved toward the valve stem 12*a*. When the rod member comes into contact with the upper end portion 130*e* of the hook member 130*b*, the hook member is rotated, the clutch mechanism 130 is disconnected, and the discharge valve 12 is lowered. The timing when the controller 40 opens the solenoid valve (when the second period of time elapses) is set taking into account a timing of causing the rod member to abut against the hook member and disconnecting the clutch mechanism 130 in such a way that the discharge valve 12 is seated on the drain port 10*a* to block the drain port when the water level in the storage tank 10 drops to the predetermined water level WL2, as described later. The discharge valve 12 may thus be lowered, and the small washing mode in which the second amount of flush water is drained may be performed.

For example, in the second embodiment described above, the acting portion 158 moves toward the valve stem 12*a* when the water storage portion 156 and the transmission portion 148 are lowered, but in a modification, flush water may be discharged through the discharge portion toward the clutch mechanism 130 such that the clutch mechanism 130 is lowered at an arbitrary timing and is disconnected by the discharged flush water. As in the second embodiment, the clutch mechanism 130 is not disconnected just by the discharge valve 12 being pulled up. When supply of flush water to the discharge valve hydraulic drive unit 14 is stopped and the piston 14*b* is moved downward, the clutch mechanism 130 is gradually lowered while being maintained in the connected state. For example, at a position that is lowered from the most pulled-up position, the hook member 130*b* of the clutch mechanism 130 is rotated with the flush water that is discharged through the discharge portion and the clutch mechanism 130 is thereby disconnected.

According to such a configuration, the first control valve 16, the discharge valve hydraulic drive unit 14, and the discharge portion function as the valve controller. The valve controller is formed to be able to disconnect the clutch mechanism 130 at a predetermined timing. The flush water tank apparatus 4 includes such a valve controller. In a case where the first amount of flush water is selected by the remote controller 6 or the like, the valve controller is operated to disconnect the clutch mechanism 130 after a lapse of the first period of time, with flush water discharged through the discharge portion acting on the clutch mechanism 130, and thus lowers the discharge valve 12 after a lapse of the first period of time. The discharge valve 12 may thus be lowered at an original timing according to the predetermined water level WL1, and the large washing mode may be performed. Furthermore, in a case where the second amount of flush water is selected by the remote controller 6 or the like, the valve controller is operated to disconnect the clutch mechanism 130 after a lapse of the second period of time shorter than the first period of time, with flush water discharged through the discharge portion acting on the clutch mechanism 130, and thus lowers the discharge valve 12 after a lapse of the second period of time. The discharge valve 12 may thus be lowered at an original timing according to the predetermined water level WL2, and the small washing mode may be performed. Modifications have been described above, but structures of each modification, the first embodiment and the second embodiment may be freely recombined or extracted to be changed.

Furthermore, for example, in the first embodiment described above, the transmission portion 48 is connected to the holding mechanism 46, but in a modification, a single float device may be connected to the holding mechanism 46, and the transmission portion 48 may be provided to push down an upper surface of the float device.

According to such a configuration, when the water level in the water storage portion 56 drops, the float device and the transmission portion 48 are lowered due to their own weights, and the float device is pushed down and the holding mechanism 46 is switched from the holding state to the non-holding state. The discharge valve 12 is thus lowered.

As in the present invention, in a case where the large washing mode is selected, the controller 40 keeps the solenoid valve 18 open. Accordingly, flush water flowing in from the water supply pipe 38 keeps being discharged into the water storage portion 56 via the first control valve 16 and the discharge valve hydraulic drive unit 14 and through the discharge portion 54. Accordingly the water level in the water storage portion 56 is high and the float is at a floating position, and the holding mechanism 46 is in the holding state.

Here, the discharge portion 54 keeps discharging water for a predetermined period of time, and thus, the transmission portion 48 is not operated to push down the float device, and the float device is lowered according to the water level (WL1) in the storage tank 10 as in normal circumstances, and the holding mechanism 46 is switched to the non-holding state. Accordingly, the discharge valve 12 may be lowered at a timing according to the predetermined water level WL1, and the large washing mode may be performed.

Furthermore, in a case where the small washing mode is selected, the controller 40 keeps the solenoid valve 18 open. Accordingly, flush water flowing in from the water supply pipe 38 keeps being discharged into the water storage portion 56 via the first control valve 16 and the discharge valve hydraulic drive unit 14 and through the discharge portion 54. Accordingly, the water level in the water storage portion 56 is high and the float is at a floating position, and the holding mechanism 46 is in the holding state. Next, in a case where the small washing mode is selected, the controller 40 closes the solenoid valve 18 and closes the first control valve 16 after a lapse of the second period of time from when the solenoid valve 18 is opened (when flushing is started). The second period of time is shorter than the first period of time. As described later, the timing when the controller 40 closes the solenoid valve 18 (when the second period of time elapses) is set taking into account a timing of reducing the flush water in the water storage portion 56 and lowering the float 26 in such a way that the discharge valve 12 is seated on the drain port 10*a* to block the drain port 10*a* when the water level in the storage tank 10 drops to a predetermined water level WL2. The flush water that is stored in the water storage portion 56 is gradually drained through the discharge hole 56*b*, and the water level of the flush water in the water storage portion 56 is lowered. At a time when the water level of the flush water in the water storage portion 56 drops to the predetermined water level WL4 (a water level approximately the same as the predetermined water level WL3; such a time corresponds to a time when the water level in the storage tank 10 drops to the predetermined water level WL2), positions of the transmission portion 48 and the float 26 are lowered. The float is thus pushed down, and the holding mechanism 46 shifts to the non-holding state. The discharge valve 12 is thus lowered, and the small washing mode in which the second amount of flush water is drained may be performed.

Furthermore, for example, in the first embodiment described above, the water storage portion 56 is provided below the full water level WL, but in a modification, the water storage portion 56 and the float 26 in the water storage portion 56 may be provided above the full water level WL. With such a water storage portion 56, flush water is not stored in the water storage portion 56 in the standby state, and when flush water is supplied through the discharge portion 54 into the water storage portion 56, the float 26 is raised and the transmission portion 48 is raised. Here, a seesaw-type force transmission device (a seesaw-shaped transmission portion) having a sideways Z-shape is provided instead of the holding mechanism 46. A central rotation shaft is provided at a center of the force transmission device, and when one end of the force transmission device is raised, the other end of the force transmission device is lowered in the manner of a seesaw, and an acting portion provided on the other end is caused to act on the clutch mechanism 30. The one end of the force transmission device forms the transmission portion 48, and the other end of the force transmission device forms the acting portion that acts on the clutch mechanism 30. Accordingly, when the float 26 is raised, the acting portion is lowered on the opposite side of the seesaw-shaped force transmission device to act on the clutch mechanism 30, and the clutch mechanism 30 may be disconnected at an early timing. Furthermore, at this time, instead of a configuration where the discharge portion 54 is connected to the drive unit discharge passage 34*b*, a configuration where the discharge portion 54 is connected to the water supply passage 50 is adopted. Accordingly, the controller 40 may supply flush water to the water storage portion 56 at an arbitrary timing, without using the discharge valve hydraulic drive unit 14.

In a case where the large washing mode is selected, the controller 40 does not cause the flush water to be discharged through the discharge portion 54 of the water supply passage 50 into the water storage portion 56 and does not cause a float device for the large washing mode to be lowered by the acting portion connected to the water storage portion 56, until the water level in the storage tank 10 is at least at the predetermined water level WL1 and the float device for the large washing mode is lowered according to the water level. Thereby, the discharge valve 12 is caused to descend at the original timing corresponding to the predetermined water level WL1 and the large washing mode can be executed.

Furthermore, in a case where the small washing mode is selected, the controller 40 causes the second control valve 22 to open at a predetermined timing to thereby supply flush water into the water storage portion 56 through the discharge portion of the water supply passage 50 to raise the float 26 in the water storage portion 56, lower the acting portion, and disconnect the clutch mechanism 30 at an early timing. Disconnecting the clutch mechanism 30 at an early timing allows the discharge valve 12 to be lowered at an early timing, and the small washing mode in which the second amount of flush water is drained may be performed.

In the case of adopting the configuration as described in the above modification where the acting portion is to act on the clutch mechanism 30, the flush water tank apparatus 4 may, as further another modification, include a float device separately for the large washing mode and the small washing mode. Additionally, a distal end of a horizontally extending rod of the acting portion that is to act on the clutch mechanism 30 is formed as a T-shaped plate, and the clutch mechanism 30 may be disconnected by this plate, for example.

With the flush water tank apparatus 4 having such a configuration, in a case where the large washing mode is selected, the controller 40 does not cause the flush water to be discharged through the discharge portion 54 of the water supply passage 50 into the water storage portion 56 and does not cause the float 26 and the transmission portion 48 to be raised, until the water level in the storage tank 10 is at least at the predetermined water level WL1 and the float device for the large washing mode is lowered according to the water level, and thus prevents the acting portion from disconnecting the clutch mechanism 30 at an early timing. Accordingly, the clutch mechanism 30 is disconnected as initially planned, and the discharge valve 12 is held by the holding mechanism 46 connected to the float device for the large washing mode. Thereafter, the discharge valve 12 is lowered at a timing according to the predetermined water level WL1 by an operation of the float device for the large washing mode, and the large washing mode may thus be performed.

Furthermore, in a case where the small washing mode is selected, the controller 40 causes the flush water to be discharged through the discharge portion 54 into the water storage portion 56 and causes the float 26 and the transmission portion 48 to be raised, and causes the acting portion to disconnect the clutch mechanism 30 at an early timing. When the float 26 in the water storage portion 56 is raised, the float 26 causes the rod of the acting portion to act in the horizontal direction, and the clutch mechanism 30 may be disconnected at a relatively early timing. With such a configuration, a height to which the discharge valve 12 is raised (a height at which the clutch mechanism 30 is disconnected) may be adjusted to a lower position, and in the small washing mode, the clutch mechanism 30 may be disconnected at an early timing to cause the discharge valve 12 to be held by the holding mechanism 46 connected to the float device for the small washing mode, and the small washing mode thus be performed.

As further another modification, a seesaw-type force transmission device as described above may be provided between the float 26 and the float device for the large washing mode, instead of the configuration of the modification described above where the acting portion is to act on the clutch mechanism 30. A central rotation shaft is provided at a center of the force transmission device, and when the transmission portion 48 at one end of the force transmission device is raised, a rod portion on the other end of the force transmission device is lowered, and the rod portion pushes down the float device for the large washing mode. According to such a configuration, when the float 26 is raised, the transmission portion 48 is raised, and the rod portion on the opposite side of the seesaw-shaped force transmission device is lowered to push down the float device, and the holding mechanism 46 extending from the float device for the large washing mode may be placed in the non-holding state.

With such a configuration, in a case where the large washing mode is selected, the controller 40 does not cause the flush water to be discharged through the discharge portion 54 into the water storage portion 56 and does not cause the float 26 and the transmission portion 48 to be raised, and thus prevents the rod portion from pushing down the float device for the large washing mode. Accordingly, the float device for the large washing mode is operated according to the predetermined water level WL1 as initially planned, and the discharge valve 12 is lowered at a predetermined timing, and the large washing mode may thus be performed.

Furthermore, in a case where the small washing mode is selected, the controller 40 causes the flush water to be discharged through the discharge portion 54 into the water storage portion 56 and causes the float 26 and the transmission portion 48 to be raised, and causes the rod portion to push down the float device for the large washing mode. The discharge valve 12 is released from engagement with the holding mechanism 46 of the float device for the large washing mode, and is lowered. Thereby, the holding claw 12*b* of the discharge valve 12 is in the holding state by the holding mechanism 46 of the float device for the small washing mode. After that, the float device for the small washing mode is caused to descend at the timing corresponding to the predetermined water level WL2; the holding mechanism 46 of the float device for the small washing mode enters the non-holding state and causes the discharge valve 12 to descend, and the small washing mode for discharging the second amount of flush water can be executed.

Note that modifications have been illustrated as described above, the structure of each modification and the structure of the first embodiment may be arbitrarily recombined, or extracted and changed.

Next, a flush toilet apparatus according to a third embodiment of the present invention will be described with reference to the appended drawing.

Figure 25:
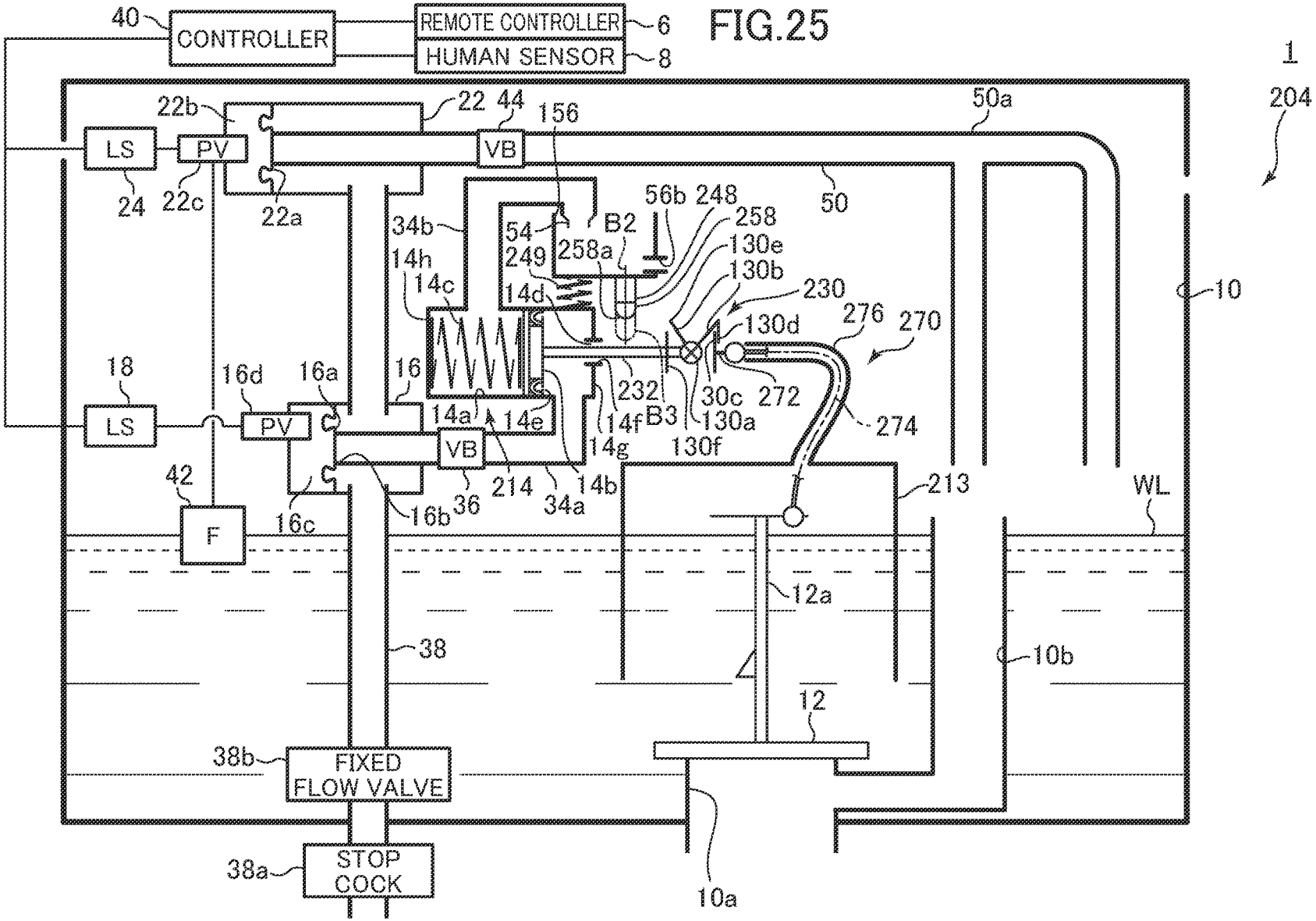
FIG. 25 is a cross-sectional diagram showing a schematic configuration of a flush water tank apparatus according to a third embodiment of the present invention.

The flush toilet apparatus 1 according to the third embodiment is different from that in the second embodiment described above in that a clutch mechanism 230 is disposed outside a discharge valve casing 213. Here, only the differences from the second embodiments will be described in relation to the third embodiment of the present invention, and same parts will be denoted by the same reference numerals or signs in the drawing, and a description thereof will be omitted. FIG. 25 is a cross-sectional diagram showing a schematic configuration of a flush water tank apparatus according to the third embodiment of the present invention.

As shown in FIG. 25, a flush water tank apparatus 204 according to the third embodiment of the present invention is provided on the flush toilet apparatus 1 (see FIG. 1) as in the first embodiment of the present invention.

The flush water tank apparatus 204 supplies flush water to the flush toilet main body 2. The flush water tank apparatus 204 includes a discharge valve hydraulic drive unit 214 for driving the discharge valve 12.

The flush water tank apparatus 204 includes the clutch mechanism 230 for lowering the discharge valve 12 by being disconnected, and the clutch mechanism 230 couples the discharge valve 12 and the discharge valve hydraulic drive unit 214 to each other so as to pull up the discharge valve 12 by the driving force of the discharge valve hydraulic drive unit 214.

The discharge valve 12 is pulled up by the driving force of the discharge valve hydraulic drive unit 214, and is lowered due to its own weight when the clutch mechanism 230 is disconnected at a predetermined height or at a predetermined timing. By controlling a predetermined period of time from when the discharge valve 12 is pulled up to until when the clutch mechanism 230 is disconnected, a time until the discharge valve 12 is lowered and is seated on the drain port 10*a* is adjusted. The discharge valve 12 is disposed inside the discharge valve casing 213. The discharge valve casing 213 is formed covering the discharge valve 12 from above and side. The discharge valve casing 213 is formed to have a cylindrical shape that covers the discharge valve 12 from above. The discharge valve casing 213 is formed in water below the full water level WL of flush water to a space above the full water level WL. Abase unit of the discharge valve casing 213 is fixed to a floor surface of the storage tank 10. The discharge valve casing 213 is not fixed to the discharge valve hydraulic drive unit 214, and is provided in the storage tank 10 independently of the discharge valve hydraulic drive unit 214.

The discharge valve hydraulic drive unit 214 drives the discharge valve 12 by using a water supply pressure of flush water that is supplied from a tap water pipe. Specifically, the discharge valve hydraulic drive unit 214 includes the cylinder 14*a* into which water that is supplied from the first control valve 16 flows, the piston 14*b* that is slidably disposed inside the cylinder 14*a*, and a rod 232 for driving the discharge valve 12, the rod 232 protruding from one end of the cylinder 14*a*. The discharge valve hydraulic drive unit 214 is a horizontally placed discharge valve hydraulic drive unit that drives the piston 14*b* and the rod 232 in the horizontal direction. The discharge valve hydraulic drive unit 214 is disposed outside the discharge valve casing 213 inside which the discharge valve 12 is disposed, the discharge valve hydraulic drive unit 214 being disposed so as to space out from the discharge valve casing 213.

Furthermore, the spring 14*c* is disposed inside the cylinder 14*a* to horizontally energize the piston 14*b* toward a first end portion 14*g* on the discharge valve 12 side. Moreover, the packing 14*e* is attached to the piston 14*b*, and watertightness is secured between the inner wall surface of the cylinder 14*a* and the piston 14*b*. Moreover, the clutch mechanism 230 is provided on the other end of the rod 232, and the rod 232 and a connecting member 270 connected to the valve stem 12*a* of the discharge valve 12 are coupled/uncoupled by the clutch mechanism 230.

The cylinder 14*a* is a cylindrical member, and is disposed with its axis aligned in the horizontal direction, such as the horizontal direction, and the piston 14*b* is received inside the cylinder 14*a* in a manner capable of sliding in the horizontal direction. Furthermore, the drive unit water supply passage 34*a* is connected to the first end portion 14*g* of the cylinder 14*a* on the discharge valve 12 side, and flush water flowing out from the first control valve 16 flows into the cylinder 14*a*. Accordingly, the piston 14*b* in the cylinder 14*a* is horizontally moved by the flush water flowing into the cylinder 14*a*, from the first end portion 14*g* toward a second end portion 14*h* against the energizing force of the spring 14*c*.

The outflow hole is provided in an upper part of the cylinder 14*a*, and the drive unit discharge passage 34*b* communicates with the inside of the cylinder 14*a* via this outflow hole. Accordingly, when flush water flows from the drive unit water supply passage 34*a* connected to the cylinder 14*a* into the cylinder 14*a*, the piston 14*b* is pushed and moved from the first end portion 14*g* side of the cylinder 14*a*, that is a first position, toward the second end portion 14*h*. The piston 14*b* is driven by pressure from the flush water flowing into the cylinder. Then, when the piston 14*b* is pushed and moved to a second position that is more to the second end portion 14*h* side than the outflow hole is, water flowing into the cylinder 14*a* flows out from the outflow hole, through the drive unit discharge passage 34*b*. That is, when the piston 14*b* is moved to the second position, the drive unit water supply passage 34*a* and the drive unit discharge passage 34*b* communicate with each other through the inside of the cylinder 14*a*. The discharge portion 54 is formed at a distal end portion of the drive unit discharge passage 34*b* extending from the cylinder 14*a*. The drive unit discharge passage 34*b* thus forms a flow channel that extends to the discharge portion 54.

The rod 232 is a bar-shaped member that is connected to a side surface of the piston 14*b* on the discharge valve 12 side, and the rod 232 extends through the through hole 14*f* formed in a side surface of the cylinder 14*a* in a manner protruding sideways from inside the cylinder 14*a*. The rod 232 is connected to the piston 14*b* in the cylinder 14*a*, and is also coupled to the clutch mechanism 230 outside the cylinder 14*a*. Furthermore, the gap 14*d* is formed between the rod 232 protruding from a side of the cylinder 14*a* and an inner wall of the through hole 14*f* of the cylinder 14*a*, and a part of flush water flowing into the cylinder 14*a* flows out through the gap 14*d*. Water flowing out from the gap 14*d* flows into the storage tank 10. Additionally, the gap 14*d* is relatively narrow and has great flow channel resistance, and thus, even in a state where water flows out from the gap 14*d*, pressure inside the cylinder 14*a* is increased by the flush water flowing into the cylinder 14*a* from the drive unit water supply passage 34*a*, and the piston 14*b* is pushed and moved toward the second end portion 14*h* against the energizing force from the spring 14*c*.

Based on operation of the solenoid valve 18, the first control valve 16 controls supply of water to the discharge valve hydraulic drive unit 214, and also controls supply and stop of water to the discharge portion 54. For this purpose, the first control valve 16 is provided on a flow channel for supplying flush water to the discharge portion 54 and the like as a valve controller described later, and controls supply of flush water to the discharge portion 54 and the like as the valve controller. The first control valve 16 thus supplies flush water to the discharge portion 54 and the like via the discharge valve hydraulic drive unit 214.

The float switch 42 is disposed inside the storage tank 10, and the float switch 42 stops supply of water from the first control valve 16 to the discharge valve hydraulic drive unit 214 when the water level in the storage tank 10 rises to the full water level WL.

Next, a configuration and an operation of the clutch mechanism 230 will be described with reference to FIG. 25 and the like.

The configuration and an operation principle of the clutch mechanism 230 according to the third embodiment are approximately the same as those of the clutch mechanism 130 according to the second embodiment. The clutch mechanism 230 according to the third embodiment is different from the clutch mechanism 130 according to the second embodiment in that the clutch mechanism 230 is a horizontally placed clutch mechanism that is horizontally provided at an end portion of the rod 232 that extends in the horizontal direction whereas the clutch mechanism 130 is a vertically placed clutch mechanism that is vertically provided at an end portion of the rod 32 that extends in the vertical direction. The configuration of the clutch mechanism 230 according to the third embodiment is approximately the same as that of the clutch mechanism 130 according to the second embodiment except that the clutch mechanism 230 is horizontally attached and is horizontally moved, and thus, description of common parts will be omitted and differences will be mainly described.

First, as shown in FIG. 25, the clutch mechanism 230 is provided on an end portion of the rod 232 extending sideways from the discharge valve hydraulic drive unit 214, and the clutch mechanism 230 couples/uncouples the end portion of the rod 232 on the discharge valve side and an upstream end of the connecting member 270. The clutch mechanism 230 is formed as a horizontally placed clutch mechanism that is moved in the horizontal direction, and that horizontally couples/uncouples the rod 232 and a clutch mechanism connecting portion 272 at an adjacent position in the horizontal direction. More specifically, the clutch mechanism 230 is formed to separate the rod 232 and the clutch mechanism connecting portion 272 in the horizontal direction or to engage the rod 232 and the clutch mechanism connecting portion 272 in the horizontal direction by movement of the hook member 130*b* described later. The clutch mechanism 230 is provided at an approximately same height as the rod 232. The clutch mechanism 230 includes the rotary shaft 130*a* attached to a lower end of the rod 232, the hook member 130*b* supported by the rotary shaft 130*a*, the engaging claw 30*c* provided at an end portion of the clutch mechanism connecting portion 272, described later, on the clutch mechanism side, and the stop plate 130*f* defining an upper limit of a pull-up position of the clutch mechanism 230. According to such a configuration, the clutch mechanism 230 is disconnected at a predetermined timing and at a predetermined pull-up height (a pull-up height for the discharge valve 12) to lower the discharge valve 12.

The hook member 130*b* is formed extending from the rotary shaft 130*a* in a V-shape that is wider on an upper side. Of the hook member 130*b*, a discharge valve hydraulic drive unit-side portion extending toward the discharge valve hydraulic drive unit from the rotary shaft 130*a* forms a discharge valve hydraulic drive unit-side end portion 130*e* of the hook member 130*b*, and the discharge valve hydraulic drive unit-side end portion 130*e* of the hook member 130*b* is formed at such a position and with such a length that the discharge valve hydraulic drive unit-side end portion 130*e* does not abut against the bottom surface of the discharge valve hydraulic drive unit 214 even in a state where the piston 14*b* is raised the most (a pushed-forward state). Of the hook member 130*b*, a discharge-valve-side portion extending toward the discharge valve from the rotary shaft 130*a* extends obliquely upward as a part of the V-shape, and then forms the hook portion 130*d* of the hook member 130*b* that extends back toward the clutch mechanism connecting portion 272. The engaging claw 30*c* is a plate-shaped claw. The bottom side of the engaging claw 30*c* is formed in the vertical direction. The stop plate 130*f* is formed such that the stop plate 130*f* abuts against the bottom surface of the discharge valve hydraulic drive unit 214 before the discharge valve hydraulic drive unit-side end portion 130*e* of the hook member 130*b* in the connected state comes in contact with the bottom surface of the discharge valve hydraulic drive unit 214, to thereby stop the discharge valve 12 and the like from being pulled up.

In the state shown in FIG. 25, the discharge valve 12 is seated on the drain port 10*a*, and the drain port 10*a* is closed. Furthermore, in this state, the discharge valve hydraulic drive unit 214 and the discharge valve 12 are coupled to each other, and in this coupled state, the hook portion 130*d* of the hook member 130*b* is engaged with the bottom side of the engaging claw 30*c* and the discharge valve 12 can be pulled up by the rod 232. According to such a configuration, for example, the clutch mechanism 230 may function as the timing control mechanism, and the clutch mechanism 230 may, during engagement with the discharge valve 12 via the connecting member 270, stop lowering of the discharge valve 12 and control the timing when the drain port is blocked. Furthermore, for example, the clutch mechanism 230, an acting portion 258, described later, and the like may function as the timing control mechanism.

The clutch mechanism 230 is disposed at a position closer to the discharge valve hydraulic drive unit 214 between the discharge valve hydraulic drive unit 214 and the discharge valve casing 213 (or the discharge valve 12). For example, in the standby state, the clutch mechanism 230 is disposed at a position that is closer to the discharge valve hydraulic drive unit 214 than a middle position of a length of the rod 232 and the connecting member 270 between the discharge valve hydraulic drive unit 214 and the discharge valve casing 213 (or the discharge valve 12) is. Additionally, the clutch mechanism 230 is disposed at a position closer to the discharge valve hydraulic drive unit 214 than an end portion, on the discharge valve hydraulic drive unit side, of a flexible member 274 formed of wire is. Furthermore, the clutch mechanism 230 is disposed at a position closer to the discharge valve hydraulic drive unit 214 than an end portion, on the discharge valve hydraulic drive unit side, of the clutch mechanism connecting portion 272 is.

Because the clutch mechanism 230 is disposed between the discharge valve hydraulic drive unit 214 and the discharge valve casing 213, at a position closer to the discharge valve hydraulic drive unit 214, a degree of freedom regarding setting of a position at which the clutch mechanism 230 is disconnected, a degree of freedom regarding an arrangement position of the clutch mechanism 230, and a degree of freedom regarding the structure of the clutch mechanism 230 may be increased compared to a case where the clutch mechanism 230 is disposed closer to the discharge valve casing 213, at a position close to a water surface. Furthermore, a degree of freedom regarding an arrangement position of the acting portion 258 or the like for disconnecting the clutch mechanism 230, and a degree of freedom regarding a structure of the acting portion 258 or the like may be increased. Moreover, a distance between the discharge valve hydraulic drive unit 214 and the clutch mechanism 230 in the standby state is set shorter than a distance between the discharge valve casing 213 (or the discharge valve 12) and the clutch mechanism 230 in the standby state. Moreover, a height difference between the discharge valve hydraulic drive unit 214 and the clutch mechanism 230 in the standby state is set smaller than a height difference between the discharge valve casing 213 (or the discharge valve 12) and the clutch mechanism 230 in the standby state.

The connecting member 270 connects the clutch mechanism 230 and the valve stem 12*a*. The connecting member 270 is longer than the rod 232. The connecting member 270 includes the clutch mechanism connecting portion 272 connected to the clutch mechanism 230, and the flexible member 274 for connecting the clutch mechanism connecting portion 272 and the valve stem 12*a*, the flexible member 274 being formed of wire. The clutch mechanism connecting portion 272 extends along a same axis as the rod 232. The clutch mechanism connecting portion 272 is formed into a rod shape having rigidity. The clutch mechanism connecting portion 272 forms the engaging claw 30*c*.

The flexible member 274 is disposed inside a tube 276 that extends from the discharge valve casing 213. A shape of the flexible member 274 can be changed according to a shape of the tube 276. The flexible member 274 is disposed being curved along a curved shape of the tube 276. The flexible member 274 is such that when one end portion is moved by a certain movement amount, the other end portion is also moved by the certain movement amount. The flexible member 274 thus transmits a pull-up operation from one end portion or a pull-down operation from the other end portion as a pull-up operation for the other end portion or a pull-down operation for the one end portion. The flexible member 274 allows the discharge valve hydraulic drive unit 214 and the discharge valve 12 to be connected regardless of the positions thereof, and may transmit the pull-up operation and the like. The discharge valve hydraulic drive unit 214 and the discharge valve 12 may thus be disposed more freely with regard to positions. The flexible member 274 may be formed of other connecting members such as a chain or a bead chain.

Referring back to FIG. 25, the water storage portion and the like of the flush water tank apparatus 204 will be described.

The flush water tank apparatus 204 further includes the discharge portion 54 for discharging flush water that is supplied, the water storage portion 156 for storing the flush water that is discharged through the discharge portion 54, a transmission portion 248 that is coupled to the water storage portion 156, and the acting portion 258 that is coupled to the transmission portion 248 to be vertically moved.

The discharge valve hydraulic drive unit 214, the discharge portion 54, the water storage portion 156, the transmission portion 248, and the acting portion 258 function, as a whole or in part, as the valve controller. The valve controller is formed to be able to disconnect the clutch mechanism 230 at a predetermined timing. At this time, the clutch mechanism 230 may function as the timing control mechanism. The flush water tank apparatus 204 includes such a valve controller. In a case where the first amount of flush water is selected by the remote controller 6 or the like, the valve controller is operated to disconnect the clutch mechanism 230 after a lapse of the first period of time, and thus lowers the discharge valve 12 after a lapse of the first period of time. Furthermore, in a case where the second amount of flush water is selected by the remote controller 6 or the like, the valve controller is operated to disconnect the clutch mechanism 230 after a lapse of the second period of time shorter than the first period of time, and thus lowers the discharge valve 12 after a lapse of the second period of time. In this manner, the valve controller is formed to be operated with the flush water that is supplied.

Additionally, such a valve controller is not limited to be a water-supply-type valve controller where the water storage portion 156, the acting portion 258 and the like are driven with flush water that is supplied to the water storage portion 156 as described above, and may be an electrically driven valve controller not including the water storage portion 156, where the acting portion 258 and the like are driven by a driving part that is electrically driven, or may be a physical valve controller where the acting portion 258 and the like are energized in a direction of disconnecting the clutch mechanism by a physical structure such as a spring, without using means such as an electric driving part, so as to disconnect the clutch mechanism at a predetermined timing.

In a case where the second amount of flush water is selected by the remote controller 6, the discharge portion 54 discharges the flush water that is supplied. Furthermore, the discharge portion 54 is provided to discharge the flush water also in a case where the first amount of flush water is selected by the remote controller 6. The discharge portion 54 is formed at the lower end of the drive unit discharge passage 34*b* in a manner extending downward. The discharge portion 54 is provided at a position higher than an upper surface of the discharge valve casing 213. The discharge portion 54 is disposed outside the discharge valve casing 213. The discharge portion 54 forms a discharge port that is tapered and that directs downward. Accordingly, flush water is accelerated downward by gravity, and a flow rate is further increased at the discharge port due to the narrowed flow channel. The discharge portion 54 is disposed more inward than a side wall of the water storage portion 156, above the full water level WL.

The water storage portion 156 is disposed above the discharge valve casing 213. The discharge hole 56*b* is formed at a lower part of a side wall of the water storage portion 156, and is formed as a small hole with a relatively small diameter.

The transmission portion 248 forms a rod-shaped member that extends downward in the vertical direction from a lower surface of the water storage portion 156. The transmission portion 248 is fixed to the lower surface of the water storage portion 156. The transmission portion 248 is not fixed to the rod 232, and is slidably disposed relative to the rod 232. A spring 249 is disposed outside the transmission portion 248, the spring 249 being provided between the water storage portion 156 and the discharge valve hydraulic drive unit 214. Accordingly, when a weight of the water storage portion 156 is reduced after the water storage portion 156 and the transmission portion 248 are lowered, the water storage portion 156 and the transmission portion 248 are raised again by the spring 249 to return to a standby position. The transmission portion 248 is coupled to the acting portion 258. The transmission portion 248 vertically moves according to vertical movement of the water storage portion 156 to cause the acting portion 258 to move vertically. In this manner, the transmission portion 248 and the acting portion 258 are to move vertically along a virtual line B2.

The acting portion 258 is formed in a manner capable of moving in an up-down direction at a position next to the first end portion 14*g* on the bottom surface of the discharge valve hydraulic drive unit 214 and above the rod 232. Additionally, in FIG. 25, a position of the acting portion 258 in the standby state is indicated by a solid line, and the acting portion 258 that is moved downward toward the rod 232 is indicated by a virtual line B3. When the transmission portion 248 is lowered, the acting portion 258 moves forward and downward toward the rod 232. A distal end portion 258*a* of the acting portion 258 may be positioned in a space between the hook member 130*b* that is open in the V-shape, in a state where the acting portion 258 is moved forward and the hook member 130*b* is pulled up the most (where the discharge valve hydraulic drive unit 214 is most approached). Furthermore, when the transmission portion 248 is raised, the acting portion 258 moves upward to retract in a direction away from the rod 232. The distal end portion 258*a* of the acting portion 258 is formed as a relatively large protruding portion with a semicircular cross-section. Together with operation of the transmission portion 248, the water storage portion 156 and the like, the acting portion 258 controls the timing of lowering the discharge valve 12 such that the timing when the drain port 10*a* is closed is earlier in a case where the second amount of flush water is selected than a timing in a case where the first amount of flush water is selected.

In a state where the water storage portion 156 and the transmission portion 248 are lowered, the acting portion 258 extends closer to the rod 232 than the discharge valve hydraulic drive unit-side end portion 130*e* of the hook member 130*b* does. The hook member 130*b* is not operated just by the acting portion 258 being moved to the space between the hook member 130*b* that is open in the V-shape. When supply of flush water to the discharge valve hydraulic drive unit 214 is stopped and the piston 14*b* is moved toward the discharge valve, the discharge valve hydraulic drive unit-side end portion 130*e* of the hook member 130*b* comes into contact with the acting portion 258 according to movement of the rod 232, and the hook member 130*b* is rotated and the clutch mechanism 230 is disconnected.

As a modification, a case will be described where a physical valve controller is structured instead of the water-supply-type valve controller according to the present embodiment.

In this modification, instead of the discharge portion 54 and the water storage portion 156 of the flush water tank apparatus 204, the flush water tank apparatus 204 includes a spring-type transmission portion that is formed by a spring that is fixed inside the storage tank 10, and an acting portion that is coupled to the spring-type transmission portion and that is vertically moved. At this time, the discharge valve hydraulic drive unit 214, the spring-type transmission portion and the acting portion function, as a whole or in part, as the valve controller. The valve controller is formed to be able to disconnect the clutch mechanism 230 at a predetermined timing. At this time, the clutch mechanism 230 may function as the timing control mechanism.

The spring-type transmission portion in the modification described above is disposed at a position higher than the discharge valve casing 213. Furthermore, the spring-type transmission portion is disposed above the rod 232. The spring-type transmission portion is fixed above the rod 232 in a manner extending downward. The spring-type transmission portion forms a spring member that extends downward in the vertical direction. The acting portion is fixed at a lower end of the spring-type transmission portion. The spring-type transmission portion is not fixed to the rod 232, and is disposed in a manner capable of sliding in the up-down direction relative to the rod 232. In a case where the hook member 130*b* of the clutch mechanism 230 acts on a sloped surface, described later, of the acting portion from the discharge valve side, the spring-type transmission portion receives a relatively great upward force from the sloped surface to compress upward so as not to apply a relatively large load on the hook member 130*b*. On the other hand, in a case where the hook member 130*b* of the clutch mechanism 230 acts on a vertical surface, described later, of the acting portion from the discharge valve hydraulic drive unit side, the spring-type transmission portion receives a relatively great horizontal force from the vertical surface, and thus, the spring-type transmission portion does not easily compress upward, and the spring-type transmission portion applies a relatively large load to the hook member 130*b* to rotate the hook member 130*b*, and the clutch mechanism 230 is thereby disconnected. In a case where no force is received from the hook member 130*b*, the spring-type transmission portion returns to its natural length to return to a standby position.

The acting portion in the modification described above is a structure a lower portion of which is approximately triangular in side view. At the lower portion of the acting portion, a surface on the discharge valve side is formed as a sloped surface sloping inward from an outer side, from an upper portion toward a lower portion, and a surface on the discharge valve hydraulic drive unit side is formed as a vertical surface extending in the vertical direction. In the standby state where the spring-type transmission portion is at its natural length, the acting portion is positioned at a height at which the acting portion can act on the hook member 130*b*. The acting portion is formed in a manner capable of being moved by the spring-type transmission portion in the up-down direction at a position next to the first end portion 14*g* on the bottom surface of the discharge valve hydraulic drive unit 214 and above the rod 232. When the spring-type transmission portion compresses, the acting portion moves upward away from the rod 232. A distal end portion of the acting portion may be positioned in a space between the hook member 130*b* that is open in the V-shape, in a state where the hook member 130*b* is moved forward and the hook member 130*b* is pulled up the most (where the discharge valve hydraulic drive unit 214 is most approached). The distal end portion of the acting portion forms, with the vertical surface and the sloped surface, a downward protruding portion. Together with operation of the discharge valve hydraulic drive unit 214, the transmission portion and the like, the acting portion controls the timing of lowering the discharge valve 12 such that the timing when the drain port 10*a* is closed is earlier in a case where the second amount of flush water is selected than a timing in a case where the first amount of flush water is selected.

In the standby state where the spring-type transmission portion is returned to the natural length after the hook member 130*b* temporarily pushes up the sloped surface of the acting portion to proceed to the discharge valve hydraulic drive unit 214 side, the acting portion in the modification described above extends closer to the rod 232 side than the discharge valve hydraulic drive unit-side end portion 130*e* of the hook member 130*b* does. The hook member 130*b* is not operated just by the acting portion being moved to the space between the hook member 130*b* that is open in the V-shape. When supply of flush water to the discharge valve hydraulic drive unit 214 is stopped and the piston 14*b* is moved toward the discharge valve, the discharge valve hydraulic drive unit-side end portion 130*e* of the hook member 130*b* comes into contact with the vertical surface of the acting portion according to movement of the rod 232, and the hook member 130*b* is rotated and the clutch mechanism 230 is disconnected.

Next, the flush water tank apparatus 204 according to the third embodiment of the present invention, and an operation of the flush toilet apparatus 1 provided with the flush water tank apparatus 204 will be described with reference to FIG. 25.

The configuration and an operation principle of clutch mechanism 230 according to the third embodiment are approximately the same as those of the clutch mechanism 130 according to the second embodiment. Furthermore, operation of the acting portion 258 in relation to the clutch mechanism 230 according to the third embodiment is approximately the same as the operation of the acting portion 158 in relation to the clutch mechanism 130 according to the second embodiment. Accordingly, also with respect to the operation of the acting portion 258 in relation to the clutch mechanism 230 according to the third embodiment, overlapping description and illustration will be omitted by referring to the description of the operation of the acting portion 158 in relation to the clutch mechanism 130 according to the second embodiment and to FIGS. 17 to 24.

First, in the toilet washing standby state shown in FIG. 25, the water level in the storage tank 10 is the predetermined full water level WL. In this state, both of the first control valve 16 and the second control valve 22 are closed. Flush water is not stored in the water storage portion 156, and the water storage portion 156 and the transmission portion 248 are energized to an upper position by the spring 249. The acting portion 258 is pulled by the transmission portion 248, and is at a position at which the acting portion 258 is retracted from the rod 232. Next, when the user pushes the large washing button on the remote controller 6, the remote controller 6 transmits an instruction signal for executing the large washing mode to the controller 40. When the small washing button is pushed, an instruction signal for executing the small washing mode is transmitted to the controller 40.

Next, operation of the large washing mode will be described with reference to FIG. 25.

When the instruction signal to perform large washing is received, the controller 40 causes the solenoid valve 18 provided at the first control valve 16 to operate, and causes the pilot valve 16*d* on the solenoid valve side to separate from the pilot valve port. When the first control valve 16 is opened, flush water flowing in from the water supply pipe 38 is supplied to the discharge valve hydraulic drive unit 214 via the first control valve 16. Thereby, the piston 14*b* of the discharge valve hydraulic drive unit 214 is pushed and moved; the discharge valve 12 is pulled up via the rod 232; and flush water in the storage tank 10 is discharged from the drain port 10*a* to the flush toilet main body 2. At this time, the pilot valve 16*d* is still in the open state, and the flush water flowing in from the water supply pipe 38 keeps being supplied to the discharge valve hydraulic drive unit 214 through the first control valve 16. Because the piston 14*b* is moved to the second position (a state where the piston 14*b* is pushed the most toward the second end portion 14*h*), and the drive unit water supply passage 34*a* and the drive unit discharge passage 34*b* are caused to communicate with each other through the inside of the cylinder 14*a*, the flush water is discharged through the discharge portion 54 into the water storage portion 156. Accordingly, after the discharge valve hydraulic drive unit 214 raises the discharge valve 12, supply of flush water from the first control valve 16 to the water storage portion 156 is started. Even in a state where the rod 232 is moved toward the discharge valve hydraulic drive unit and the stop plate 130*f* abuts against the bottom surface of the discharge valve hydraulic drive unit 214 due to movement of the piston 14*b* and the rod 232, the discharge valve hydraulic drive unit-side end portion 130*e* of the hook member 130*b* of the clutch mechanism 230 does not abut against the bottom surface of the discharge valve hydraulic drive unit 214. Accordingly, the clutch mechanism 230 remains connected. Accordingly, the discharge valve 12 is held in a pulled-up state. On the other hand, when supply of flush water to the water storage portion 156 is started and the water storage portion 156 and the transmission portion 248 are gradually lowered, the acting portion 258 starts a descending movement toward the space between the hook member 130*b* on the rod 232 side. Additionally, the controller 40 keeps the second control valve 22 closed.

As shown in FIGS. 18, 25 and the like, flush water keeps being supplied to the discharge valve hydraulic drive unit 214 via the first control valve 16. The piston 14*b* of the discharge valve hydraulic drive unit 214 is in a state where it is pushed up the most (a pushed-forward state), and the rod 232 and the clutch mechanism 230 are also in a state where they are pulled up the most. Because the piston 14*b* is at the second position (a most pushed-up state), flush water is supplied from the discharge valve hydraulic drive unit 214 to the discharge portion 54. When the water level of the flush water in the water storage portion 156 is approximately at the full water level in the water storage portion 156, the water storage portion 156 and the transmission portion 248 are lowered due to the weight of the flush water. When the transmission portion 248 is lowered, the acting portion 258 is lowered toward the rod 232. The distal end portion 258*a* of the acting portion 258 is positioned in the space between the hook member 130*b* that is staying still in a most pulled-up state. The discharge valve hydraulic drive unit-side end portion 130*e* of the hook member 130*b* is at a position higher than the distal end portion 258*a*, and is separate from the distal end portion 258*a*. Accordingly, the clutch mechanism 230 is still not disconnected and is kept in the holding state.

Next, as shown in FIGS. 19, 25 and the like, when the water level in the storage tank 10 drops, the float switch 42 detecting the water level in the storage tank 10 is switched off. When the float switch 42 is switched off, the pilot valve 22*c* provided at the second control valve 22 is opened. Accordingly, flush water is supplied from the second control valve 22 into the storage tank 10 via the water supply passage 50. In a case where the large washing mode is selected when the pilot valve 22*c* is opened, the controller 40 keeps the pilot valve 16*d* on the solenoid valve 18 open. Flush water flowing in from the water supply pipe 38 keeps being discharged through the discharge portion 54 into the water storage portion 156 via the first control valve 16 and the discharge valve hydraulic drive unit 214. Accordingly, the amount of flush water in the water storage portion 156 is not reduced, and the water level in the water storage portion 156 is maintained approximately at the full water level. Therefore, the water storage portion 156 and the transmission portion 248 are in a lowered state, and the distal end portion 258*a* of the acting portion 258 is positioned in the space between the hook member 130*b*.

Next, as shown in FIGS. 20, 25 and the like, in a case where the large washing mode is selected, the controller 40 closes the solenoid valve 18 and closes the first control valve 16 after a lapse of the first period of time from when the solenoid valve 18 is opened (when flushing is started). The timing when the controller 40 closes the solenoid valve 18 (when the first period of time elapses) is set taking into account a timing of starting lowering of the piston 14*b* and disconnecting the clutch mechanism 230 in such a way that the discharge valve 12 is seated on the drain port 10*a* to block the drain port 10*a* when the water level in the storage tank 10 drops to the predetermined water level WL1, as described later. Because the first control valve 16 is closed, supply of flush water to the discharge valve hydraulic drive unit 214 and the discharge portion 54 is stopped. At a time immediately after supply of flush water is stopped, flush water is stored in the water storage portion 156 almost up to full in the water storage portion 156, and the water storage portion 156 is lowered by the weight of the flush water. Accordingly, the distal end portion 258*a* of the acting portion 258 is positioned in the space between the hook member 130*b* and is stopped.

Furthermore, because supply of flush water to the discharge valve hydraulic drive unit 214 is stopped, the flush water in the cylinder 14*a* gradually flows out from the gap 14*d*, and the piston 14*b* is pushed down by the energizing force from the spring 14*c*, and the rod 232 is thus moved in a right direction on the surface of the drawing, toward the discharge valve. Accordingly, the discharge valve hydraulic drive unit-side end portion 130*e* of the hook member 130*b* abuts against the distal end portion 258*a*, and the discharge valve hydraulic drive unit-side end portion 130*e* is rotated counterclockwise around the rotary shaft 130*a*. This rotation causes the lower portion of the hook member 130*b* and the hook portion 130*d* to rotate and to be raised (see FIG. 20). Engagement between the hook portion 130*d* and the engaging claw 30*c* is thus released. The clutch mechanism 230 is thereby disconnected, and the discharge valve 12 is lowered. Flush water that is supplied from the second control valve 22 into the storage tank 10 via the water supply passage 50 keeps being supplied.

As shown in FIGS. 21, 25 and the like, the discharge valve 12 that is lowered is seated on the drain port 10*a*, and the drain port 10*a* is closed. In this manner, in the case where the large washing mode is performed, the discharge valve 12 is held until the water level in the storage tank 10 drops from the full water level WL to the predetermined water level WL1, and the first amount of flush water is drained into the flush toilet main body 2. Then, flush water that is stored in the water storage portion 156 is gradually drained through the discharge hole 56*b*, and the water level of the flush water in the water storage portion 156 is lowered. When there is no more flush water in the water storage portion 156 or when the flush water is reduced, the water storage portion 156 and the transmission portion 248 are raised again by the spring 249 to return to the standby position. Accordingly, following the rise of the transmission portion 248, the acting portion 258 retracts in the direction away from the rod 232. When the flush water in the cylinder 14*a* of the discharge valve hydraulic drive unit 214 flows out, the piston 14*b* moves to return further toward the discharge valve.

Because the float switch 42 is still in the off state, the open state of the second control valve 22 is maintained, and supply of water to the storage tank 10 is continued. Flush water that is supplied via the water supply passage 50 reaches the water supply passage branch portion 50*a*, and a part of the flush water that is branched at the water supply passage branch portion 50*a* flows into the overflow pipe 10*b*, and the rest is stored in the storage tank 10. The water level in the storage tank 10 rises due to the flush water flowing into the storage tank 10 in a state where the discharge valve 12 is closed.

As shown in FIGS. 22, 25 and the like, when the water level in the storage tank 10 rises to the predetermined full water level WL, the float switch 42 is switched on. When the float switch 42 is turned on, the pilot valve 22*c* on the float switch side is closed. Thereby, the pilot valve 22*c* enters the closed state. Therefore, the pressure in the pressure chamber 22*b* rises, the main valve body 22*a* of the second control valve 22 is closed, and water supply is stopped.

Furthermore, the flush water in the cylinder 14*a* of the discharge valve hydraulic drive unit 214 gradually flows out from the gap 14*d*, and the piston 14*b* is pushed down by the energizing force from the spring 14*c*, and the rod 232 is thus moved toward the discharge valve. When being lowered to the position of the engaging claw 30*c*, the hook portion 130*d* is lowered along the sloped surface of the engaging claw 30*c*, and is rotated to the original position due to gravity after climbing over the engaging claw 30*c* so as to be engaged again with the engaging claw 30*c*, and the clutch mechanism 230 is connected, and the rod 232 and the valve stem 12*a* are coupled. The standby state before toilet flushing is started is thus reached again.

Next, operation in the small washing mode will be described with reference to FIGS. 17 to 19, FIG. 22, FIG. 23, FIG. 24, and FIG. 25.

As shown in FIG. 25, the standby state for toilet flushing is the same as in the large washing mode.

When the instruction signal to perform small washing is received, the controller 40 causes the solenoid valve 18 provided at the first control valve 16 to operate, and opens the first control valve 16. Then, the operation until a state where the water storage portion 156 and the transmission portion 248 are lowered and the distal end portion 258*a* of the acting portion 258 is positioned in the space between the hook member 130*b* is reached, as shown in FIGS. 17 to 19, FIG. 25 and the like, is the same as that in the large washing mode. Accordingly, description of the operation in the small washing mode up to this point is omitted by referring to FIGS. 17 to 19, FIG. 25 and the like, and to the description of the operation in the large washing mode.

Next, as shown in FIG. 23, FIG. 25 and the like, in a case where the small washing mode is selected, the controller 40 closes the solenoid valve 18 and closes the first control valve 16 after a lapse of the second period of time from when the solenoid valve 18 is opened (when flushing is started). The second period of time is set as a period of time that is shorter than the first period of time. The timing when the controller 40 closes the solenoid valve 18 (when the second period of time elapses) is set taking into account a timing of starting lowering of the piston 14*b* and disconnecting the clutch mechanism 230 in such a way that the discharge valve 12 is seated on the drain port 10*a* to block the drain port 10*a* when the water level in the storage tank 10 drops to the predetermined water level WL2, as described later. Because the first control valve 16 is closed, supply of flush water to the discharge valve hydraulic drive unit 214 and the discharge portion 54 is stopped. At a time immediately after supply of flush water is stopped, flush water is stored in the water storage portion 156 almost up to full in the water storage portion 156, and the water storage portion 156 is lowered by the weight of the flush water. Accordingly the distal end portion 258*a* of the acting portion 258 is positioned in the space between the hook member 130*b* and is stopped.

Furthermore, because supply of flush water to the discharge valve hydraulic drive unit 214 is stopped, the flush water in the cylinder 14*a* gradually flows out from the gap 14*d*, and the piston 14*b* is pushed down by the energizing force from the spring 14*c*, and the rod 232 is thus moved toward the discharge valve. Accordingly, the discharge valve hydraulic drive unit-side end portion 130*e* of the hook member 130*b* abuts against the distal end portion 258*a*, and the discharge valve hydraulic drive unit-side end portion 130*e* is rotated counterclockwise around the rotary shaft 130*a*. This rotation causes the lower portion of the hook member 130*b* and the hook portion 130*d* to rotate and to be raised. Engagement between the hook portion 130*d* and the engaging claw 30*c* is thus released. The clutch mechanism 230 is thereby disconnected, and the discharge valve 12 is lowered. Flush water that is supplied from the second control valve 22 into the storage tank 10 via the water supply passage 50 keeps being supplied.

As shown in FIG. 24, FIG. 25 and the like, the discharge valve 12 that is lowered is seated on the drain port 10*a*, and the drain port 10*a* is closed. In this manner, in the case where the small washing mode is performed, the discharge valve 12 is held until the water level in the storage tank 10 drops from the full water level WL to the predetermined water level WL2, and the second amount of flush water smaller than the first amount of flush water is drained into the flush toilet main body 2. Then, flush water that is stored in the water storage portion 156 is gradually drained through the discharge hole 56*b*, and the water level of the flush water in the water storage portion 156 is lowered. When there is no more flush water in the water storage portion 156 or when the flush water is reduced, the water storage portion 156 and the transmission portion 248 are raised again by the spring 249 to return to the standby position. Accordingly, following the rise of the transmission portion 248, the acting portion 258 retracts in the direction away from the rod 232. When the flush water in the cylinder 14*a* of the discharge valve hydraulic drive unit 214 flows out, the piston 14*b* is also further lowered.

Because the float switch 42 is still in the off state, the open state of the second control valve 22 is maintained, and supply of water to the storage tank 10 is continued. Flush water that is supplied via the water supply passage 50 reaches the water supply passage branch portion 50*a*, and a part of the flush water that is branched at the water supply passage branch portion 50*a* flows into the overflow pipe 10*b*, and the rest is stored in the storage tank 10. The flush water flowing into the overflow pipe 10*b* flows into the flush toilet main body 2, and is used to refill the bowl 2*a*. The water level in the storage tank 10 rises due to the flush water flowing into the storage tank 10 in a state where the discharge valve 12 is closed. Then, when the water level in the storage tank 10 rises to the predetermined full water level WL, the float switch 42 is switched on. The following operation of the flush water tank apparatus 204 until the standby state is reached again is the same as the operation in the large washing mode as shown in FIG. 22, and a description thereof is omitted.

Heretofore, the third embodiment has been described. Structures of the first embodiment, the second embodiment, the third embodiment, and each modification may be freely and wholly or partially recombined or extracted to be changed.

With the flush water tank apparatus 204 according to the third embodiment of the present invention described above, the discharge valve hydraulic drive unit 214 is disposed outside the discharge valve casing 213 inside which the discharge valve 12 is disposed, the discharge valve hydraulic drive unit 214 being disposed so as to space out from the discharge valve casing 213, and the clutch mechanism 230 is disposed at a position on a discharge valve hydraulic drive unit side between the discharge valve hydraulic drive unit 214 and the discharge valve casing 213. Therefore, the clutch mechanism 230 may be disposed at a position on a discharge valve hydraulic drive unit side between the discharge valve casing 213 and the discharge valve hydraulic drive unit 214, and a degree of freedom regarding setting of a position at which the clutch mechanism 230 is disconnected, and a degree of freedom regarding an arrangement position of the clutch mechanism 230 may be increased.

REFERENCE SIGNS LIST

1 flush toilet apparatus
2 flush toilet main body
4 flush water tank apparatus
6 remote controller
10 storage tank
10*a* drain port
12 discharge valve
14 discharge valve hydraulic drive unit
26 float
26*a* float
30 clutch mechanism
46 holding mechanism
48 transmission portion
54 discharge portion
56 water storage portion
56*b* discharge hole
104 flush water tank apparatus
130 clutch mechanism
148 transmission portion
156 water storage portion

What is claimed is:

1. A flush water tank apparatus for supplying flush water to a flush toilet, the flush water tank apparatus comprising:

a storage tank which stores the flush water to be supplied to the flush toilet and in which a drain port for discharging the stored flush water to the flush toilet is formed;

a discharge valve opening and closing the drain port and suppling flush water and stopping the supply of the flush water to the flush toilet;

a discharge valve hydraulic drive unit for driving the discharge valve by using a water supply pressure of tap water that is supplied;

a clutch mechanism coupling the discharge valve and the discharge valve hydraulic drive unit to pull up the discharge valve by a driving force of the discharge valve hydraulic drive unit, and disconnecting at a predetermined timing to lower the discharge valve;

a flush water amount selection portion capable of selecting between a first amount of flush water for flushing the flush toilet and a second amount of flush water smaller than the first amount of flush water;

a timing control mechanism stopping lowering of the discharge valve while engaging with the discharge valve and controlling a timing of closing the drain port; and a valve controller coupled to the timing control mechanism, the valve controller being provided to operate at a timing according to an amount of flush water selected by the flush water amount selection portion, wherein in a case where the first amount of flush water is selected by the flush water amount selection portion, the valve controller causes the timing control mechanism to be engaged with the discharge valve, causes the timing control mechanism to operate such that engagement between the timing control mechanism and the discharge valve is released according to a first period of time having passed, and causes the discharge valve to be lowered according to the first period of time having passed, and in a case where the second amount of flush water is selected by the flush water amount selection portion, the valve controller causes the timing control mechanism to be engaged with the discharge valve, causes the timing control mechanism to operate such that engagement between the timing control mechanism and the discharge valve is released according to a second period of time shorter than the first period of time having passed, and causes the discharge valve to be lowered according to the second period of time having passed.

2. The flush water tank apparatus according to claim 1, further comprising:

a control valve provided on a flow channel supplying the flush water to the valve controller, the control valve controlling supply of the flush water to the valve controller; and a controller controlling the control valve, wherein the valve controller is formed to be operated by supplied the flush water.

3. The flush water tank apparatus according to claim 2, wherein supply of the flush water from the control valve to the valve controller is started after the discharge valve is raised by the discharge valve hydraulic drive unit.

4. The flush water tank apparatus according to claim 2, wherein the control valve is provided to also control supply of the flush water to the discharge valve hydraulic drive unit.

5. The flush water tank apparatus according to claim 2, wherein the control valve supplies the flush water to the valve controller via the discharge valve hydraulic drive unit.

6. The flush water tank apparatus according to claim 1, wherein the valve controller comprises a water storage portion for storing the flush water, in which a discharge hole through which the flush water stored is drained is formed at a lower part of the water storage portion, a discharge portion discharging the flush water into the water storage portion, and a float provided inside the water storage portion, the float moving vertically according to a water level in the water storage portion, the timing control mechanism comprises an engaging portion that is capable of engaging with the discharge valve depending on a position of the float, the timing control mechanism places the engaging portion at a position allowing engagement with the discharge valve, in a case where the flush water is stored in the water storage portion and the float is raised, and the timing control mechanism moves the engaging portion to a position where engagement with the discharge valve is released, in a case where the float is lowered.

7. The flush water tank apparatus according to claim 6, wherein supply of the flush water from a control valve to the valve controller is started after the clutch mechanism is disconnected.

8. The flush water tank apparatus according to claim 1, wherein the discharge valve hydraulic drive unit is disposed outside a discharge valve casing inside which the discharge valve is disposed, the discharge valve hydraulic drive unit being disposed so as to space out from the discharge valve casing, and the clutch mechanism is disposed at a position on a discharge valve hydraulic drive unit side between the discharge valve hydraulic drive unit and the discharge valve casing.

9. The flush water tank apparatus according to claim 1, wherein the valve controller includes a discharge portion discharging supplied the flush water, in a case where the second amount of flush water is selected by the flush water amount selection portion, a water storage portion storing the flush water discharged from the discharge portion, and a float provided inside the water storage portion, the float moving vertically according to a water level in the water storage portion, and the timing control mechanism is coupled to the float, is operated according to a vertical movement of the float, and controls a timing of lowering of the discharge valve such that a timing when the drain port is closed is earlier in a case where the second amount of flush water is selected than a timing in a case where the first amount of flush water is selected.

10. The flush water tank apparatus according to claim 9, wherein the discharge valve hydraulic drive unit comprises a cylinder into which supplied water flows, a piston slidably disposed inside the cylinder and driven by a pressure of the flush water flowing into the cylinder, and a rod connected to the piston to drive the discharge valve, and a volume of the flush water that can be stored in the water storage portion, between the water storage portion and the float, is smaller than a volume of the cylinder.

11. The flush water tank apparatus according to claim 9, wherein the discharge portion forms a discharge port that directs downward.

12. The flush water tank apparatus according to of claim 9, wherein at least a part of the water storage portion is positioned below a stopped water level in the storage tank.

13. The flush water tank apparatus according to claim 9, wherein a discharge hole through which the flush water stored is drained is formed in the water storage portion.

14. The flush water tank apparatus according to claim 13, wherein the discharge hole of the water storage portion is formed at a lower part of a side wall of the water storage portion, and is formed as an opening that directs toward an opposite side from the discharge valve in a plan view.

15. The flush water tank apparatus according to claim 13, wherein an instantaneous flow rate of the flush water that is drained through the discharge hole is smaller than an instantaneous flow rate of the flush water that is discharged from the discharge portion.

16. A flush toilet apparatus comprising:

the flush water tank apparatus according to claim 1; and the flush toilet washed by flush water supplied from the flush water tank apparatus.

17. A flush water tank apparatus for supplying flush water to a flush toilet, the flush water tank apparatus comprising:

a storage tank which stores the flush water to be supplied to the flush toilet and in which a drain port for discharging the stored flush water to the flush toilet is formed;

a discharge valve opening and closing the drain port and suppling flush water and stopping the supply of the flush water to the flush toilet;

a discharge valve hydraulic drive unit for driving the discharge valve by using a water supply pressure of tap water that is supplied;

a clutch mechanism coupling the discharge valve and the discharge valve hydraulic drive unit to pull up the discharge valve by a driving force of the discharge valve hydraulic drive unit, and disconnecting to lower the discharge valve;

a flush water amount selection portion capable of selecting between a first amount of flush water for flushing the flush toilet and a second amount of flush water smaller than the first amount of flush water; and a valve controller formed to be capable of disconnecting the clutch mechanism at a predetermined timing, wherein in a case where the first amount of flush water is selected by the flush water amount selection portion, the valve controller is operated to disconnect the clutch mechanism according to a first period of time having passed and to lower the discharge valve according to the first period of time having passed, and in a case where the second amount of flush water is selected by the flush water amount selection portion, the valve controller is operated to disconnect the clutch mechanism according to a second period of time shorter than the first period of time having passed and to lower the discharge valve according to the second period of time having passed.

* * * * *